US008172269B2

(12) United States Patent
Tanaka et al.

(10) Patent No.: US 8,172,269 B2
(45) Date of Patent: May 8, 2012

(54) FILE INCLUDING A CURVED RETAINING PORTION ENABLING AN EDGE OF A BINDING BODY TO CURVE

(75) Inventors: Kanji Tanaka, Ashiya (JP); Yoshiteru Arimoto, Hannan (JP); Mitsunori Maeda, Amagasaki (JP)

(73) Assignee: Lihit Lab., Inc., Osaka (JP)

( * ) Notice: Subject to any disclaimer, the term of this patent is extended or adjusted under 35 U.S.C. 154(b) by 699 days.

(21) Appl. No.: 12/202,503

(22) Filed: Sep. 2, 2008

(65) Prior Publication Data

US 2009/0058069 A1 Mar. 5, 2009

(30) Foreign Application Priority Data

Sep. 4, 2007 (JP) ..... 2007-229449
Oct. 26, 2007 (JP) ..... 2007-278860

(51) Int. Cl.
*B42D 1/00* (2006.01)

(52) U.S. Cl. ..... 281/27.1

(58) Field of Classification Search ..... 281/27.1, 281/21.1, 35

See application file for complete search history.

(56) References Cited

U.S. PATENT DOCUMENTS 1,602,816 A * 10/1926 Fellows ..... 281/23
4,615,541 A * 10/1986 Kwauka ..... 281/29
4,948,173 A * 8/1990 Hincks et al. ..... 462/80
5,456,496 A * 10/1995 Kadish ..... 281/21.1

FOREIGN PATENT DOCUMENTS

JP 05-032279 A 2/1993
JP 6-239056 A 8/1994
JP 07-011434 U 2/1995
JP 7-52581 A 2/1995
JP 8-1536 U 11/1996

* cited by examiner

*Primary Examiner* — Joanne Silbermann
*Assistant Examiner* — Kristina Junge
(74) *Attorney, Agent, or Firm* — Keating & Bennett, LLP

(57) ABSTRACT

A file includes a binding body which is superimposed with a plurality of binding sheets, a curved retaining portion which is curved in a direction in which the binding body extends when the cover is opened, a curved subsidiary portion arranged to fix a back portion thereof in a desired configuration. The binding body is provided adjacent to the curved retaining portion and has an arch-shape in a direction away from the inner side of a spine portion and the curved retaining portion is connected with a width less than a width of the spine portion to the inner side of the curved subsidiary portion at the outer side of the curved retaining portion to enable the end edge adjacently provided on the binding body to curve.

11 Claims, 69 Drawing Sheets

FILE INCLUDING A CURVED RETAINING PORTION ENABLING AN EDGE OF A BINDING BODY TO CURVE

BACKGROUND OF THE INVENTION

1. Field of the Invention

This invention relates to files, and particularly, to files including a front cover portion and a back cover portion adjacently provided on both sides of a spine portion and further including clear pockets fastened between the front cover portion and the back cover portion, such as clear books and card albums.

2. Description of the Related Art

Conventionally, a file including clear pockets includes pockets that are made of clear films. The file including clear pockets is produced in an open state in which pockets are welded and fixed to the cover and file binding pockets are produced by melting the central portion of a stack of several pockets and welding the stack of pockets to the back portion of the cover.

In the file, the efficiency of page spread decreases when approaching both ends of the file due to the structure of the welded stack of pockets. Japanese Patent Application No. 5-32279, Japanese Utility Model Application No. 7-11434, and Japanese Patent Application No. 5-205490 disclose a file having an improved uniform spread at its center or at both ends by respectively welding each of a plurality of pockets to a cover.

Conventional files including pockets increasingly form a curve from a flat state as spread approaches the center by the thickness of the documents therein, even in a file in which each of the pockets is respectively welded to the cover, and as a result, efficiency of spread decreases.

SUMMARY OF THE INVENTION

To overcome the problems described above, preferred embodiments of the present invention provide a file including binding sheets which can be easily spread flat when spreading a binding body.

In accordance with a preferred embodiment of the present invention, a file includes a binding body which is superimposed with a plurality of binding sheets, a curved retaining portion which is curved in the direction of the pocket sheets extending adhered and connected on the end edge of a group of pocket sheets when the cover is opened, and a curved subsidiary portion including a back that is fixed in a desired shape in a region on a front cover side and a region on a back cover side of a spine portion between the front cover portion and the back cover portion, wherein the binding body is provided adjacent to the curved retaining portion by providing an arch-shape in the direction of a front cover portion and back cover portion extending from the inner side of the spine portion, and the curved retaining portion is connected with a width less than the width of the spine portion to the inner side of the curved subsidiary portion at the outer side of the curved retaining portion to enable the end edge adjacently provided on the binding body to curve.

The binding body is preferably superimposed with a plurality of binding sheets and connected on the end edge which is connected to the front cover, wherein the curved retaining portion includes a front cover portion connected to the cover body between the front cover portion and the back cover portion, wherein the cover body includes a hinge portion between the front cover side and the back cover side, wherein said binding body is arranged such that the end edge of the group of pocket sheets connected to the cover body curves toward the side of the binding sheets extending when the cover body is opened, and wherein the curved subsidiary portion is spaced from the binding body and connected with the width less than the width of the spine portion at the outer side of the hinge portion of said front cover portion and the hinge portion of said back cover portion to enable the end edge of the binding body which is connected to the cover to curve.

The curved retaining portion may preferably include the hinge portion on the front cover side provided on the front cover portion, the hinge portion on the back cover side provided on the back cover portion, and an interjacent connecting portion interposed between said hinge portion on the front cover side and said hinge portion on the back cover side, and wherein said interjacent connecting portion is arranged to curve toward the direction of the binding sheets extending along with the end edge of the binging body connected to the cover by its weight when the cover body is opened.

The curved retaining portion may preferably include the hinge portion on the front cover side connected to the front cover portion, the hinge portion on the back cover side connected to the back cover portion, and the interjacent connecting portion interposed between the hinge portion on said front cover side and the hinge portion on said back cover side, and wherein the region on the front cover side leading to the hinge portion on the front cover side and the region on the back cover side leading to the hinge portion on the back cover side intersect at substantial right angles to the interjacent connecting portion when a load is not applied and define the interjacent connecting portion toward the direction of the binding sheets so as to be lifted with the elasticity adjacent to the hinge portion on the front cover side and the hinge portion on the back cover side when the cover is opened.

The distance between a folding portion of the curved subsidiary portion and the back cover portion may preferably be substantially equal to or less than the distance between the hinge portion on the front cover side of said curved retaining portion and the inner surface of the curved subsidiary portion and between the hinge portion on the back cover side and the inner surface of the curved subsidiary portion, wherein the hinge portion on the front cover side and the hinge portion on the back cover side are positioned adjacent to the end edge in the cross direction of the back cover portion when the cover body is closed, wherein the interjacent connecting portion between the hinge portion on the front cover side and the hinge portion on the back cover side is arranged to curve away from the back cover portion when the cover body is opened and the width of between the hinge portion on the front cover side and the hinge portion on the back cover side is less than the width of the back cover portion.

The interjacent connecting portion of the curved retaining portion may preferably be deformed plastically by hot pressing onto a synthetic resin sheet body so as to provide flexibility by reducing its thickness.

The binding body may preferably superimpose the plurality of binding sheets and is connected on the end edge which is connected to the cover, wherein the curved retaining portion is defined by the end edge connected to said binding body and a connecting body connecting the cover, wherein the cover body includes the front cover portion, the back cover portion, and the spine portion between said front cover portion and said back cover portion, defines the folding portion arranged to be spaced from the spine portion between the front cover portion and the back cover portion, the binding sheets are connected via said connecting body and the curved subsidiary portion is provided between the folding portion and the spine portion and in the spine portion, wherein said binding body is arranged to curve along the end edge of the binging body connected to the cover toward the direction in which the binding sheets extend when the cover body is opened, and wherein the curved retaining portion is connected adjacent to the folding portion of the front cover portion and the folding portion of the back cover portion and is spaced from the binding body to enable the end edge connected to the cover of the binding body with the short width to curve.

The connecting body may preferably include a connecting portion on the front cover side connected to the side of the front cover portion, a connecting portion on the back cover side connected to the side of the back cover portion and the interjacent connecting portion interposed between the connecting portion on the front cover side and said connecting portion on the back cover side, wherein the interjacent connecting portion connects the end edge connected to the cover of the binding body and is arranged to curve toward the binding sheets extending along with the end edge connected to the cover of the binding body by tension of the connecting portion on the front cover side and the connecting portion on the back cover side when the cover body is opened, and wherein the hinge portion is provided between the connecting portion on the front cover side and the interjacent connecting portion and between the connecting portion on the back cover side and the interjacent connecting portion.

The connecting body may preferably include the connecting portion on the front cover side connected to the side of the front cover portion, the connecting portion on the back cover side connected to the side of the back cover portion, and the interjacent connecting portion interposed between said connecting portion on the front cover side and the connecting portion on the back cover side, wherein the hinge portion on the front cover side and the hinge portion on the back cover side are disposed between the connecting portion on the front cover side and the interjacent connecting portion and between the connecting portion on the back cover side and the interjacent connecting portion, and wherein the connecting portion on the front cover side leading to the hinge portion on the front cover side and the connecting portion on the back cover side leading to the hinge portion on the back cover side intersect at substantial right angles with the interjacent connecting portion when a load is not applied and define the interjacent connecting portion toward the direction of the binding sheets as to be lifted with the elasticity adjacent to the hinge portion on the front cover side and the hinge portion on the back cover side when the cover is opened.

The distance between the folding portion of said front cover portion and the folding portion of said back cover portion may preferably be substantially the equal to or less than the distance between the hinge portion on the front cover side of said connecting body and the inner surface of the front cover portion and between the hinge portion on the back cover side and the inner surface of the back cover portion, wherein the hinge portion on the front cover side and the hinge portion on the back cover side are positioned adjacent to the end edge of the back cover portion when the cover body is closed, and wherein the interjacent connecting portion between the hinge portion on the front cover side and the hinge portion on the back cover side is arranged to curve away from the back cover portion when the cover body is opened and the width between the hinge portion on the front cover side and the hinge portion on the back cover side is less than the width of the back cover portion.

The interjacent connecting portion of the binding body may preferably be deformed plastically by hot press onto a synthetic resin sheet body so as to provide flexibility by reducing its thickness.

The binding sheets may preferably include pockets combined with thermoplastic resin sheets, wherein each binding sheet is hot-adhered to another on the end edge connected to the cover thereof, and wherein the end edge connected to the cover is arranged to curve inwardly when the binding sheets are opened.

The connecting body may preferably include a rigid sheet body made of a thermoplastic synthetic resin, include through-holes in the region connected to the binding body, and be arranged so as to curve.

According to various preferred embodiments of the present invention, a file includes a binding body which is superimposed with a plurality of binding sheets, a curved retaining portion which is curved toward the direction in which the pocket sheets extend, adhered and connected on the end edge of a group of pocket sheets when the cover is opened; and a curved subsidiary portion which fixes its back in a desired configuration in a region on a front cover side and a region on a back cover side of a spine portion between the front cover and the back cover. In this file, the binding body is provided adjacent to the curved retaining portion by providing an arch-shape toward the direction of a front cover portion and back cover portion extending from the inner side of the spine portion and the curved retaining portion is connected with the width less than the width of the spine portion to the inner side of the curved subsidiary portion at the outer side of the curved retaining portion to enable the end edge provided on the binding body to curve. Therefore, the file which can be easily spread flat when the binding body is spread is provided.

The binding body may preferably be superimposed with a plurality of binding sheets and connected on the end edge which is connected to the front cover. In this file, the curved retaining portion includes a front cover portion connected to the cover body between the front cover portion and the back cover portion, the cover body includes a hinge portion between the front cover side and the back cover side, the binding body is arranged such that the end edge of the group of pocket sheets connected to the cover body curve toward the side in which the binding sheets extend when the cover body is opened, and the curved subsidiary portion is spaced from the binding body and connected with the width less than the width of the spine portion at the outer side of the hinge portion of the front cover portion and the hinge portion of the back cover portion to enable the end edge of the binding body which is connected to the cover to curve. Therefore, the file which can be easily spread flat when the binding body is spread is provided.

The curved retaining portion may preferably include the hinge portion on the front cover side provided on the front cover portion, the hinge portion on the back cover side provided on the back cover portion, and an interjacent connecting portion interposed between the hinge portion on the front cover side and the hinge portion on the back cover side, and the intervenient assembly is arranged to curve toward the direction of the binding sheets extending along with the end edge of the binging body connected to the cover by its weight when the cover body is opened. Therefore, the file, which can be easily spread flat when the binding body is spread by expanding the portion provided adjacent to the interjacent connecting portion of the binding body, is provided.

The curved retaining portion may preferably include the hinge portion on the front cover side connected to the front cover portion, the hinge portion on the back cover side connected to the back cover portion and the interjacent connecting portion interposed between the hinge portion on the front cover side and the hinge portion on the back cover side, and the region on the front cover side extending to the hinge portion on the front cover side and the region on the back cover side extending to the hinge portion on the back cover side intersect at substantially right angles to the interjacent connecting portion when a load is not applied and define the interjacent connecting portion toward the direction of the binding sheets so as to be lifted with the elasticity adjacent to the hinge portion on the front cover side and the hinge portion on the back cover side when the cover is opened. Therefore, the binding sheets can be easily spread flat when the binding body is spread by curving the curved retaining portion away from the spine portion and expanding the portion provided adjacent to the curved retaining portion of the binding body.

The distance between a folding portion of the curved subsidiary portion and the back cover portion may preferably be substantially the equal to or less than the distance between the hinge portion on the front cover side of the curved retaining portion and the inner surface of the curved subsidiary portion and between the hinge portion on the back cover side and the inner surface of the curved subsidiary portion, and the hinge portion on the front cover side and the hinge portion on the back cover side are positioned adjacent to the end edge in the cross direction of the back cover portion when the cover body is closed. In this file, the interjacent connecting portion interposed between the hinge portion on the front cover side and the hinge portion on the back cover side is arranged to curve away from the back cover portion when the cover body is opened and the width between the hinge portion on the front cover side and the hinge portion on the back cover side is less than the width of the back cover portion. Therefore, the binding sheets can be easily spread flat when the binding body is spread by curving the curved retaining portion away from the spine portion and expanding the portion provided adjacent to the curved retaining portion of the binding body.

The interjacent connecting portion of the curved retaining portion may preferably be deformed plastically by hot press onto a synthetic resin sheet body so as to provide flexibility by reducing its thickness. By partially processing a region of the interjacent connecting portion, flexibility of the region can be easily increased.

The binding body may preferably superimpose the plurality of binding sheets and is connected on the end edge which is connected to the cover, and the curved retaining portion is defined by the end edge connected to the binding body and a connecting body connecting the cover. In this file, the cover body includes the front cover portion, the back cover portion, and the spine portion between the front cover portion and the back cover portion, the folding portion arranged to be spaced from the spine portion between the front cover portion and the back cover portion, the binding sheets are connected via said connecting body and the curved subsidiary portion is provided between the folding portion and the spine portion and in the spine portion. The binding body is arranged to curve along the end edge of the binging body connected to the cover in the direction that the binding sheets extend when the cover body is opened, and the curved retaining portion is connected adjacent to the folding portion of the front cover portion and the folding portion of the back cover portion so as to be spaced from the binding body in the cross direction to enable the end edge connected to the cover of the binding body with the short width to curve. Therefore, the binding sheets can be easily spread flat when the binding body is spread by curving the curved retaining portion away from the spine portion and expanding the portion adjacently provided to the curved retaining portion of the binding body.

The connecting body may preferably include a connecting portion on the front cover side connected to the side of the front cover portion, a connecting portion on the back cover side connected to the side of the back cover portion, and the interjacent connecting portion interposed between the connecting portion on the front cover side and the connecting portion on the back cover side, the interjacent connecting portion connects the end edge connected to the cover of the binding body and is arranged to curve toward the binding sheets extending along with the end edge connected to the cover of the binding body by tension of the connecting portion on the front cover side and the connecting portion on the back cover side when the cover body is opened, and the hinge portion is provided between the connecting portion on the front cover side and the interjacent connecting portion and between the connecting portion on the back cover side and the interjacent connecting portion. Therefore, the binding sheets can be easily spread flat when the binding body is spread by expanding the portion provided adjacent to the interjacent connecting portion of the binding body.

The connecting body may preferably include the connecting portion on the front cover side connected to the side of the front cover portion, the connecting portion on the back cover side connected to the side of the back cover portion, and the interjacent connecting portion interposed between said connecting portion on the front cover side and the connecting portion on the back cover side, the hinge portion on the front cover side and the hinge portion on the back cover side are provided between the connecting portion on the front cover side and the interjacent connecting portion and between the connecting portion on the back cover side and the interjacent connecting portion; and the connecting portion on the front cover side extending to the hinge portion on the front cover side and the connecting portion on the back cover side extending to the hinge portion on the back cover side intersect at substantial right angles to the interjacent connecting portion when a load is not applied and define the interjacent connecting portion toward the direction of the binding sheets so as to be lifted with the elasticity adjacent to the hinge portion on the front cover side and the hinge portion on the back cover side when the cover is opened. Therefore, the binding sheets can be easily spread flat when the binding body is spread by curving the interjacent connecting portion away from a spine portion and expanding the portion adjacently provided to the interjacent connecting portion of the binding body.

The distance between the folding portion of the front cover portion and the folding portion of the back cover portion may preferably be substantially equal to or less than the distance between the hinge portion on the front cover side of the connecting body and the inner surface of the front cover portion and between the hinge portion on the back cover side and the inner surface of the back cover portion, the hinge portion on the front cover side and the hinge portion on the back cover side are positioned adjacent to the end edge of the back cover portion when the cover body is closed, and the interjacent connecting portion between the hinge portion on the front cover side and the hinge portion on the back cover side is arranged to curve away from the back cover portion when the cover body is opened and the width between the hinge portion on the front cover side and the hinge portion on the back cover side is less than the width of the back cover portion. Therefore, the binding sheets can be easily spread flat when the binding body is spread by curving the connecting body away from the spine portion and expanding the portion adjacently provided to the curved retaining portion of the binding body.

The interjacent connecting portion of the binding body may preferably be deformed plastically by hot press onto a synthetic resin sheet body so as to provide flexibility by reducing its thickness. By partially processing a region of the interjacent connecting portion, flexibility of the region can be easily increased.

The binding sheets may preferably include pockets combined with thermoplastic resin sheets, each binding sheet is hot-adhered to another on the end edge connected to the cover thereof, and the end edge connected to the cover is arranged to curve inwardly when the binding sheets is opened. Therefore, the binding sheets can be easily spread flat when the binding body is spread by expanding the connecting portion of the binding body adjacently provided to the curved retaining portion.

The connecting body may preferably include a rigid sheet body made of thermoplastic synthetic resin, including through-holes in the region connected to the binding body, and arranged to curve. Therefore, the binding sheets can be easily spread flat when the binding body is spread by expanding the connecting portion of the binding body provided adjacent to the connecting body.

The above and other objects, features, and advantages of this invention will become more readily apparent from the following description of detailed description of preferred embodiments with reference to the accompanying drawings In this specification and scope of the claims, the terms generally used are adopted for the cover height of the file and the cover width of the spine and the width of the spine, H is for the cover height, W is for the cover width and T, for the width of the spine in FIG. 66 for your reference.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
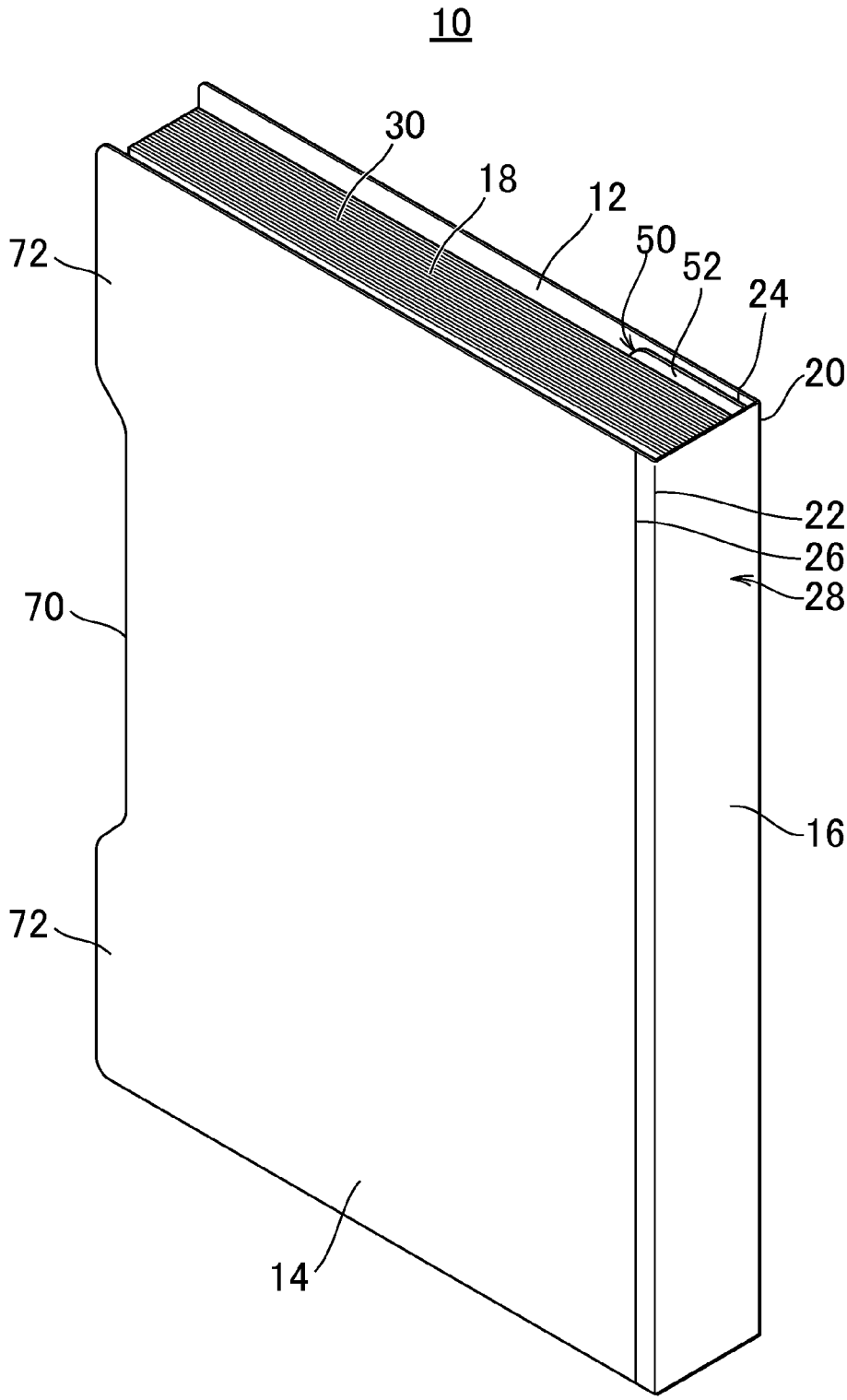
FIG. 1 is a schematic perspective view of a pocket file in accordance with a preferred embodiment of the present invention.
Figure 2:
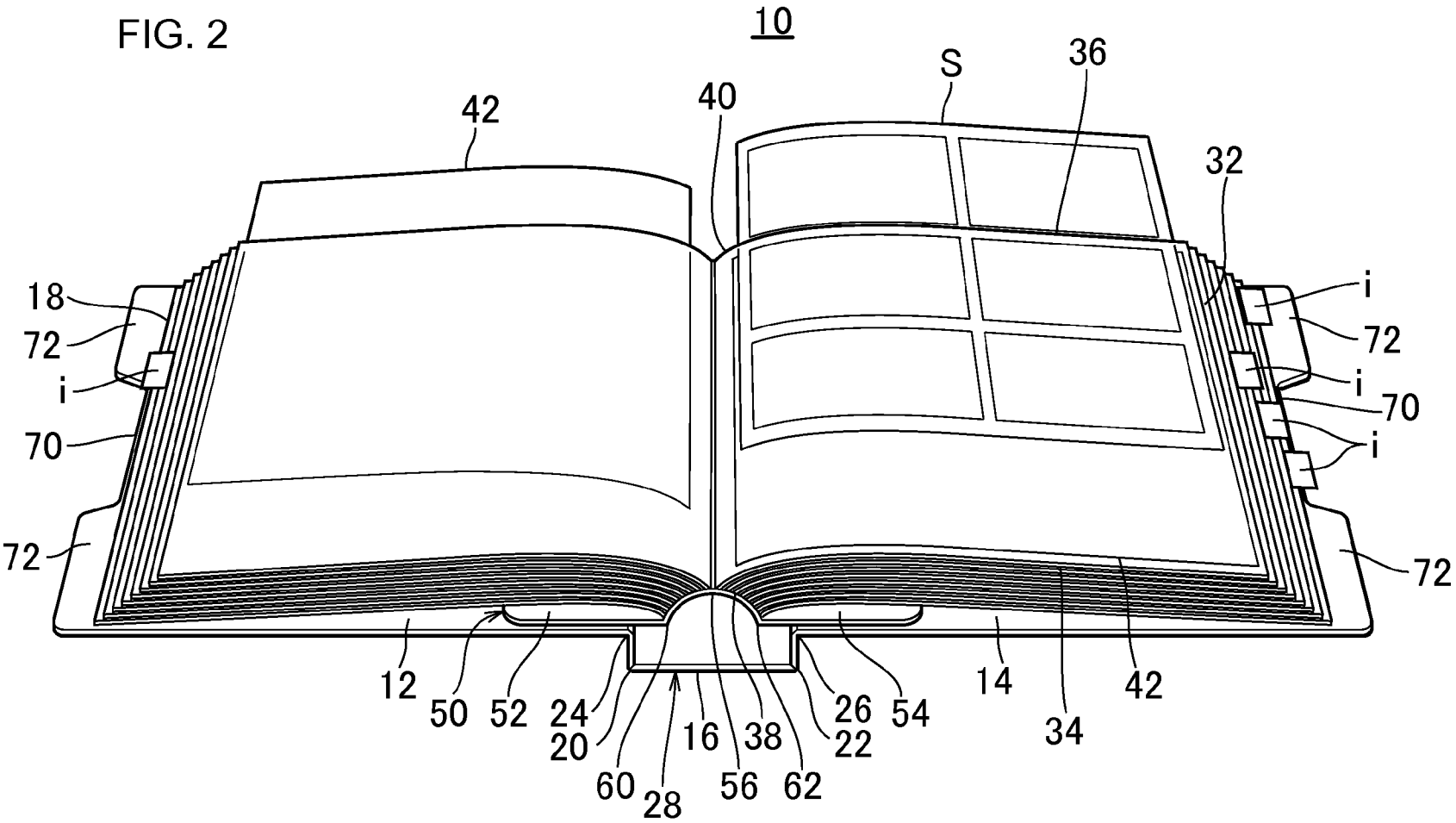
FIG. 2 is a schematic perspective view, of the file of FIG. 1 in an opened state.
Figure 3:
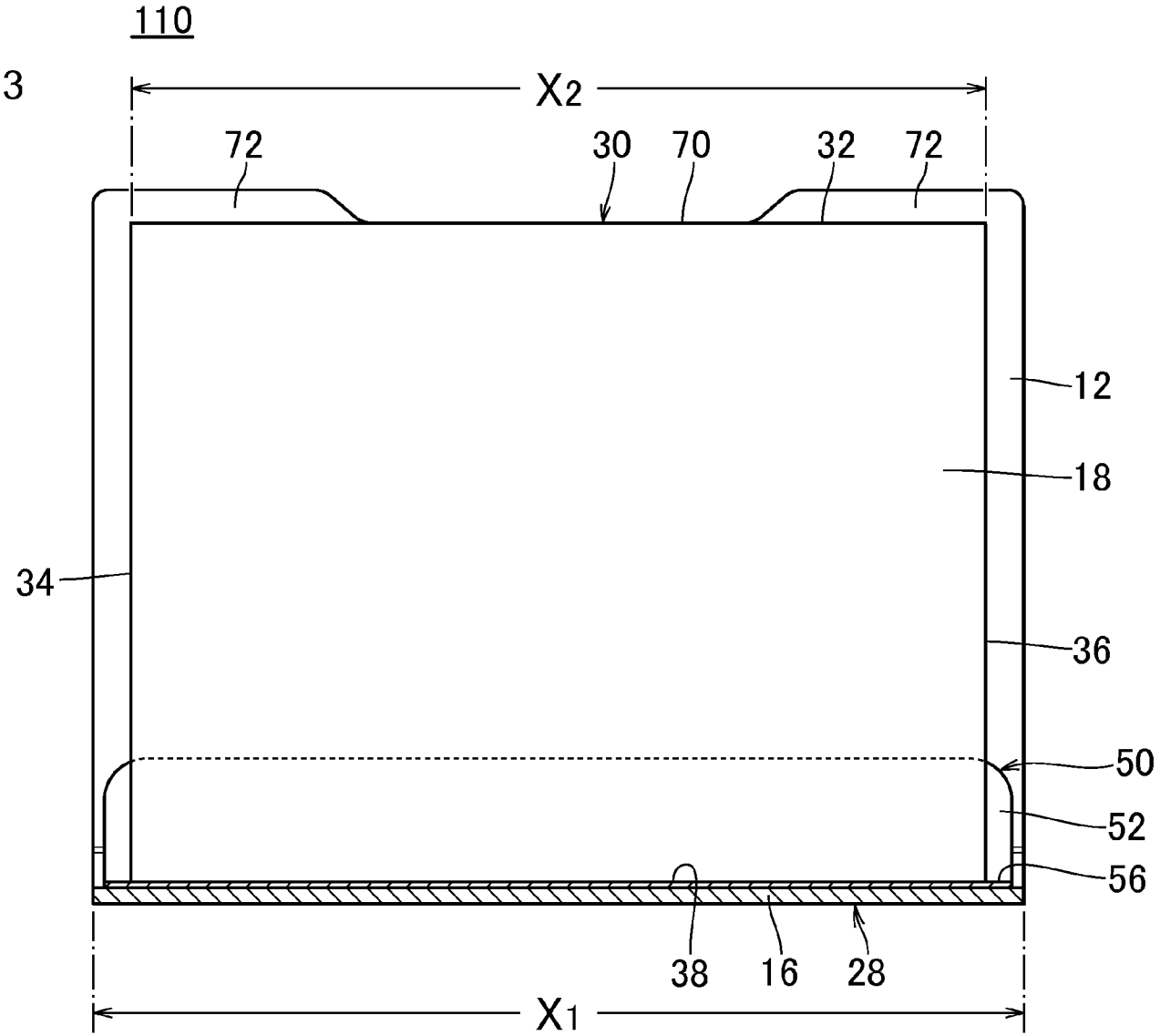
FIG. 3 is a schematic longitudinal sectional view of the file of FIG. 1 in a closed state.

FIG. 1 is a schematic perspective view of a pocket file in accordance with a preferred embodiment of the present invention and FIG. 2 is a schematic perspective view of the pocket file in an opened state as shown in FIG. 1. FIG. 3 is a schematic longitudinal section view of the pocket file in a closed state as shown in FIG. 1.

A file 10 includes a cover body including a front cover portion 12 preferably made of a synthetic-resin, such as polypropylene, for example, a back cover portion 14, and a spine portion 16 extending between the front cover portion 12 and the back cover portion 14. A group of pocket sheets 30, which define a binding body, superimposes a pocket sheet 18 as a binding sheet and is welded and connected to a connecting end edge of the group of pocket sheets 30 by being fastened to the group of pocket sheets 30 connected at an end edge which is connected to the spine portion 16.

The file 10 preferably includes a curved retaining portion configured to curve the end edge of the group of pocket sheets 30 toward the side of the pocket sheet 18 extending at the inner side of the spine portion 16 between the front cover portion 12 and the back cover portion 14 when the cover is opened. The file 10 further includes a curved subsidiary portion which is fixed the back of the cover body in a desired shape in a region on a front cover side and a region on a back cover side of the spine portion 16 between the front cover portion 12 and the back cover portion 14.

The front cover portion 12 and the back cover portion 14 are arranged to cross the spine portion 16 at a substantially right angle via a linear front adjacently providing portion 20 and a linear back adjacently providing portion 22 crossing from the top edge to the bottom edge in the direction of the height of the front cover portion 12 and the back cover portion 14.

The pocket sheets 18 are flexibly arranged between a portion at which the pocket sheet 18 is fastened to the spine portion 16 and a portion disposed above a front folding portion 24 and a back folding portion 26.

The pocket sheet 18 includes a linear outer end edge 32, a linear bottom edge 34 and a opening edge 36 provided at a top end edge opposite from the bottom edge 34 and is connected to the inner surface of the spine portion 16 at an inner end edge 38 opposite from the linear outer end edge 32.

The pocket sheet 18 preferably includes a pocket portion 40 configured to accommodate an object to be bound S, such as documents, for example, and is fitted for a mount 42 extending in the direction away from a portion at which the spine portion 16 is fastened to be inserted from a portion above the front folding portion 24 and the back folding portion 26 in the inner side of the pocket portion 40.

As shown in any one of FIGS. 3 to 6, the front folding portion 24 and the back folding portion 26 extending from the top edge to the bottom edge are arranged adjacent to the front connecting portion 20 and the back connecting portion 22 of the front cover portion 12, the back cover portion 14 and the spine portion 16, and the grip portion 28 is provided in a region extending from the front folding portion 24 on the front cover portion 12 to the spine portion 16, the region extending from the back folding portion 26 on the back cover portion 14 to the spine portion 16, and the spine portion 16.

In the grip portion 28, the connecting portion on a front cover side 52 including the front folding portion 24 as an axis moves upwardly in the region on the spine portion 16 on the front cover side between the front cover portion 12 and the back cover portion 14, and the connecting portion on a back cover side 54 including the back folding portion 26 as an axis moves upwardly and the grip portion 28 forms the curved subsidiary portion which enables a connecting portion 50 as a curved subsidiary portion to arch upwardly, i.e. in a direction away from the spine portion 16, when the front cover portion 12 and the back cover portion 14 are substantially horizontal, and the grip portion 28 becomes parallel to the horizontal spine portion 16.

On the front cover portion 12 and the back cover portion 14, the front folding portion 24 and the back folding portion 26 are preferably parallel or substantially parallel to the front adjacently providing portion 20 and the back adjacently providing portion 22 in the direction extending from the top edge to the bottom edge thereof adjacent to the front adjacently providing portion 20 and the back adjacently providing portion 22.

Figure 4:
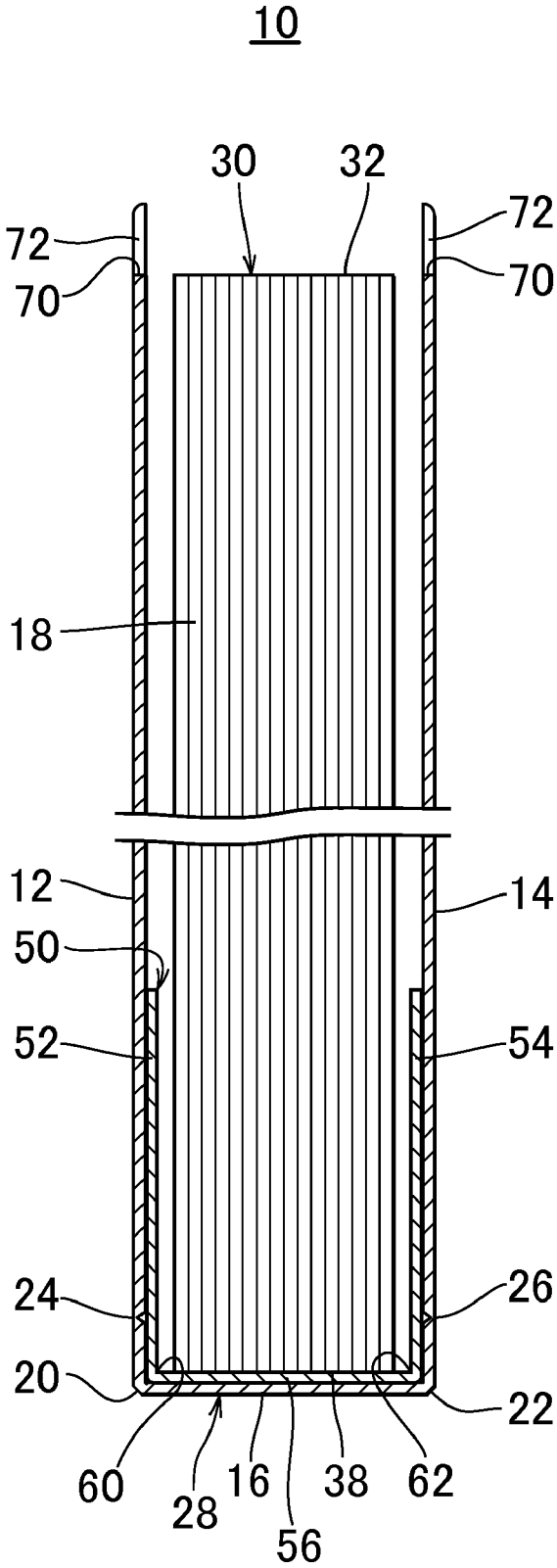
FIG. 4 is a schematic transverse sectional view of the file of FIG. 1 in a closed state.
Figure 5:
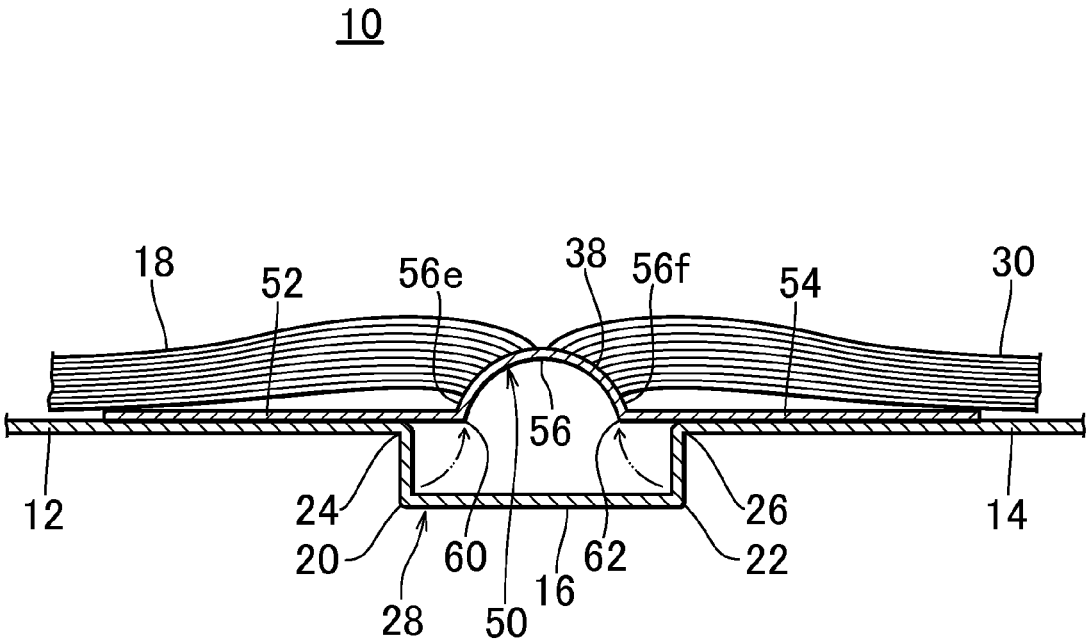
FIG. 5 is a schematic transverse sectional view of the file of FIG. 1 in an opened state.

The length of the inner surface of the spine portion 16 and the front folding portion 24 and the length of the inner surface of the spine portion 16 and the back folding portion 26 are preferably equal or substantially equal (shown in FIG. 4).

The mount 42 is provided such that the front folding portion 24 and the back folding portion 26 are not adjacent to the mount 42.

The grip portion 28 preferably has an angular structure such that the user can set the spine portion 16 on his palm, grip the grip portion 28 with his fingers and open the pocket sheet 18.

On the front cover portion 12 and the back cover portion 14, a recess for searching 70 is preferably provided on the free end edge side opposite from the spine portion 16, i.e. the left side end edge of the front cover portion 12 and the right side end edge of the back cover portion 14, in the approximate middle of the direction of the height thereof.

The outer end edge of the recess for searching 70 and the outer end edge 32 of the pocket sheet 18 are substantially aligned with one another. Accordingly, with one hand, folding the file 10 with the cover closed, especially gripping the grip portion 28 and placing the other hand on the recess for searching 70 enables flipping the front cover portion 12 or the back cover portion 14 and the pocket sheet 18.

Figure 20:
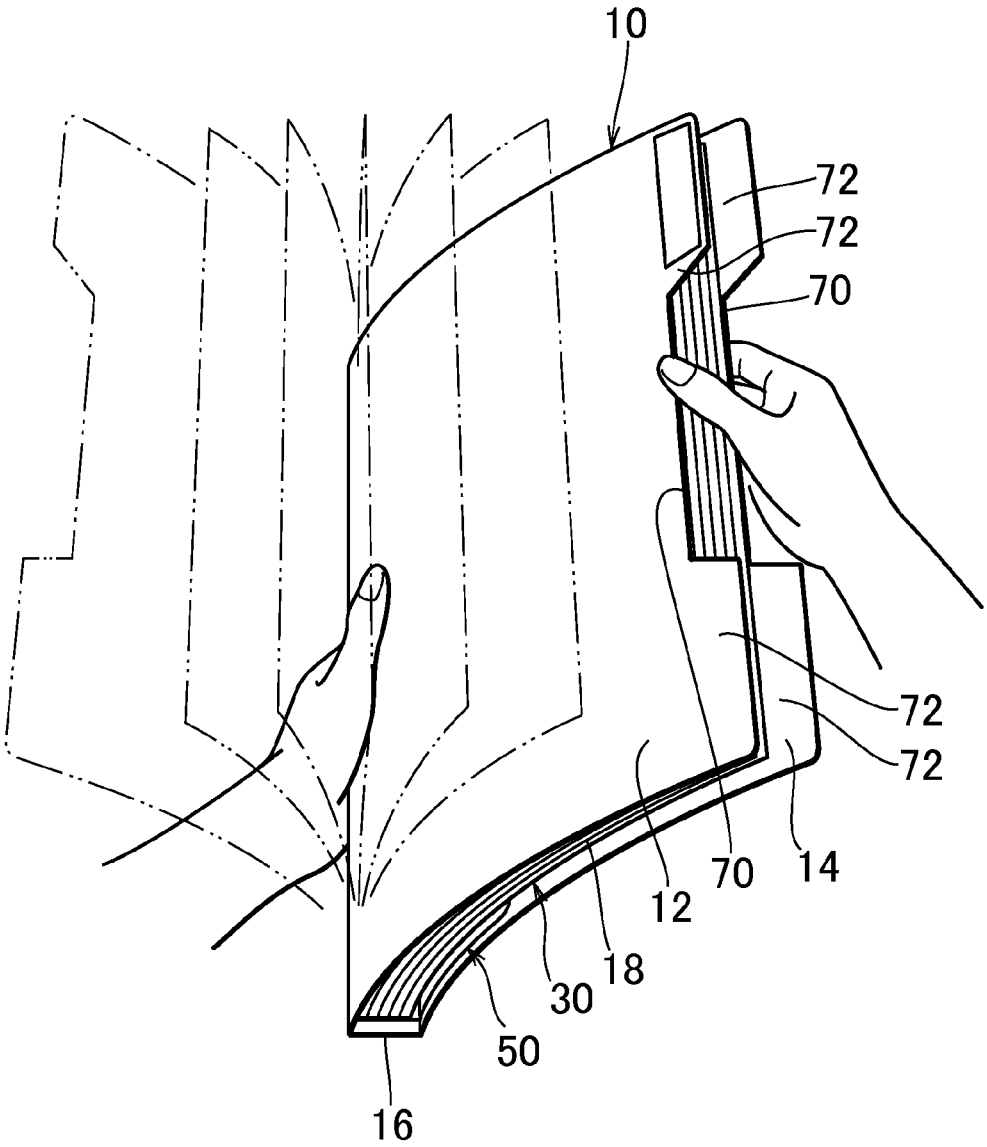
FIG. 20 is a schematic perspective view of the use of the file according to a preferred embodiment of the present invention.

The file 10 can be flipped from the pocket sheet 18 positioned on the upper side to the pocket sheet positioned on the lower side with the user's fingers placed on the outermost portion of the outer end edge 32 of the pocket sheet 18 and slightly bending the front cover portion 12 or the back cover portion 14 in the recess for searching 70 as shown in FIG. 20.

On the front cover portion 12 and the back cover portion 14, a pair of a projection portions 72 on the upper side and the lower side are preferably respectively provided so as to cover the index i provided on the pocket sheet 18 such that the projection portion 72 projects towards the outer end edge 32 of the pocket sheet 18 on the outside of the region that the recess portion for searching 70 is provided.

The end edge of the group of pocket sheets 30 connected to the spine portion 16 when the cover body is opened is curved in a direction away from the spine portion 16.

The pocket sheet 18 preferably includes pockets combined with thermoplastic resin sheets, for example. Each of the pocket sheets 18 is hot-adhered to another pocket sheet at the end edge thereof that is connected to the cover, and the end edge connected to the spine portion 16 is arranged to curve inwardly when the pocket sheet 18 is opened.

The group of pocket sheets 30 is connected by the end edge connected thereto and the connecting portion 50 connecting the front cover portion 12 and the back cover portion 14.

The connecting body 50 is preferably defined by a substantially square rigid plate body when viewed in a planar view and made of thermoplastic synthetic resin, for example, and includes the curved retaining portion which curves the group of pocket sheets 30, that are welded and connected at the connecting end edge of the group of pocket sheets 30, towards a direction of the pocket sheet 18 which defines the binding body extending.

The connecting body 50 is preferably connected adjacent to the front folding portion 24 of the front cover portion 12 and the back folding portion 26 of the back cover portion 14 and may be spaced from the group of the pocket sheets 30 in a crossing direction such that the connecting body 50 enables the end edge of the group of pocket sheet 30 connected to the cover to curve with the width less than the width of the spine portion 16 of the cover body.

The connecting body 50 preferably includes a connecting portion on the front cover side 52 connected to the side of the front cover portion 12, a connecting portion on the back cover side 54 connected to the side of the back cover portion 14 and an interjacent connecting portion 56 interposed between the connecting portion on the front cover side 52 and the connecting portion on the back cover side 54. The interjacent connecting portion 56 is connected to the end edge of the group of pocket sheets 30 connected to the cover and is configured so as to curve away from the spine portion 16 along with the end edge of the group of the pocket sheets 30 connected to the cover by the tension of the connecting portion on the front cover side 52 and the connecting portion on the back cover side 54 when the cover is opened.

The interjacent connecting portion 56 is preferably relatively flexible and is arranged to curve away from the spine portion 16 by the weight of the pocket sheet 18 being in a spread state.

The connecting body 50 preferably includes a through hole 58 that is provided in the region connected to the binding body.

The connecting body 50 preferably includes a plurality of rectangular planar shaped through holes 58 that are spaced from one another and relative flexibility is provided thereto. In this preferred embodiment, three through holes are provided, i.e., an upper through hole 58*a*, a lower through hole 58*b*, and a middle through hole 58*c*.

In this preferred embodiment, in the interjacent connecting portion 56, a pair bridge portions 56*a* and 56*b* extend between the connecting portion on the front cover side 52 and the connecting portion on the back cover side 54 at the upper edge and the lower edge respectively. A bridge portion 56*c* extends between the upper through hole 58*a* and the middle through hole 58*c* and a bridge portion 56*d* extends between the middle through hole 58*c* and the lower through hole 58*b*. Therefore, the adhesion region of the connecting portion 50 and the group of pocket sheets 30 is provided by the bridge portions 56*a* to 56*d*.

Further, a longitudinal bridge portion 56*e* is preferably provided between a hinge portion on the front cover side 60 and the upper through hole 58*a*, the lower through hole 58*b* and the middle through hole 58*c*, and a longitudinal bridge portion 56*f* is preferably provided between a hinge portion on the back cover side 62 and the upper through hole 58*a*, the lower through hole 58*b* and the middle through hole 58*c*.

On the connecting portion 50, the hinge portion on the front cover side 60 provided between the connecting portion on the front cover side 52 and the interjacent connecting portion 56 and the hinge portion on the back cover side 62 provided between the connecting portion on the back cover side 54 and the interjacent connecting portion 56 are arranged parallel or substantially parallel to each other.

The distance between the spine portion 16 and the front folding portion 24 of the front cover portion 12 and the back folding portion 26 of the back cover portion 14, respectively, is preferably substantially equal to or shorter than the distance between the hinge portion on the front cover side 60 of the connecting body 50 and the inner surface of the front cover portion 12 and between the hinge portion on the back cover side 62 and the inner surface of the back cover portion 14. The hinge portion on the front cover side 60 and the hinge portion on the back cover side 62 are arranged adjacent to the end edge of the spine portion 16 in a crossing direction when the cover is closed.

The interjacent connecting portion 56 between the hinge portion on the front cover side 60 and the hinge portion on the back cover side 62 is arranged to curve away from the spine portion 16 when the front cover portion 12 is opened and also the width between the hinge portion on the front cover side 60 and the hinge portion on the back cover side 62 is preferably less than the width of the spine portion 16.

The hinge portion on the front cover side 60 is positioned inward of the front folding portion 24 and the hinge portion on the back cover side 62 is positioned inward of the back adjacently providing portion 22 such that the width (T2) between the hinge portion on the front cover side 60 and the hinge portion on the back cover side 62 is less than the width (T1) between the front adjacently providing portion 20 and the back adjacently providing portion 22 when the cover body is opened, i.e. when the connecting portion on the front cover side 52 and the connecting portion on the back cover side 54 are adjacent to one another in the horizontal plane in a flat state and the front cover portion 12 and the back cover portion 14 are adjacent to one another in the horizontal plane in the flat state.

Additionally, although the width (T1) between the front adjacently providing 20 and the back adjacently providing portion 22 and the width (T3) between the hinge portion on the front cover side 60 and the hinge portion on the back cover side 62 are substantially equal, (T3) is preferably less than the width (T1) by the thickness of the front adjacently providing portion 20 and the back adjacently providing portion 22, since the hinge portion on the front cover side 60 and the hinge portion on the back cover side 62 is fastened to the inner surface of the front adjacently providing portion 20 and the back adjacently providing portion 22 when the cover body is closed, i.e. when the front cover portion 12 and the back cover portion 14 are parallel or substantially parallel and the connecting portion on the front cover side 52 and the connecting portion on the back cover portion 54 are parallel or substantially parallel.

Next, a method of manufacturing the file 10 shown in FIG. 1 according to a preferred embodiment of the present invention will be described below with referring to FIGS. 6 through 14.

First, a synthetic resin sheet body, such as polypropylene or other suitable material, is prepared, Thompson processing is applied thereto and the cover material 80 is removed, which will be the cover of the file and will define a cover material 80 in a combined size of the front cover portion 12, the back cover portion 14 and the spine portion 16 together.

Next, a spine index paper Z is pasted to the surface of the spine area, which will later become the spine portion 16, with an adhesive agent (Spine index paper pasting step).

Figure 6:
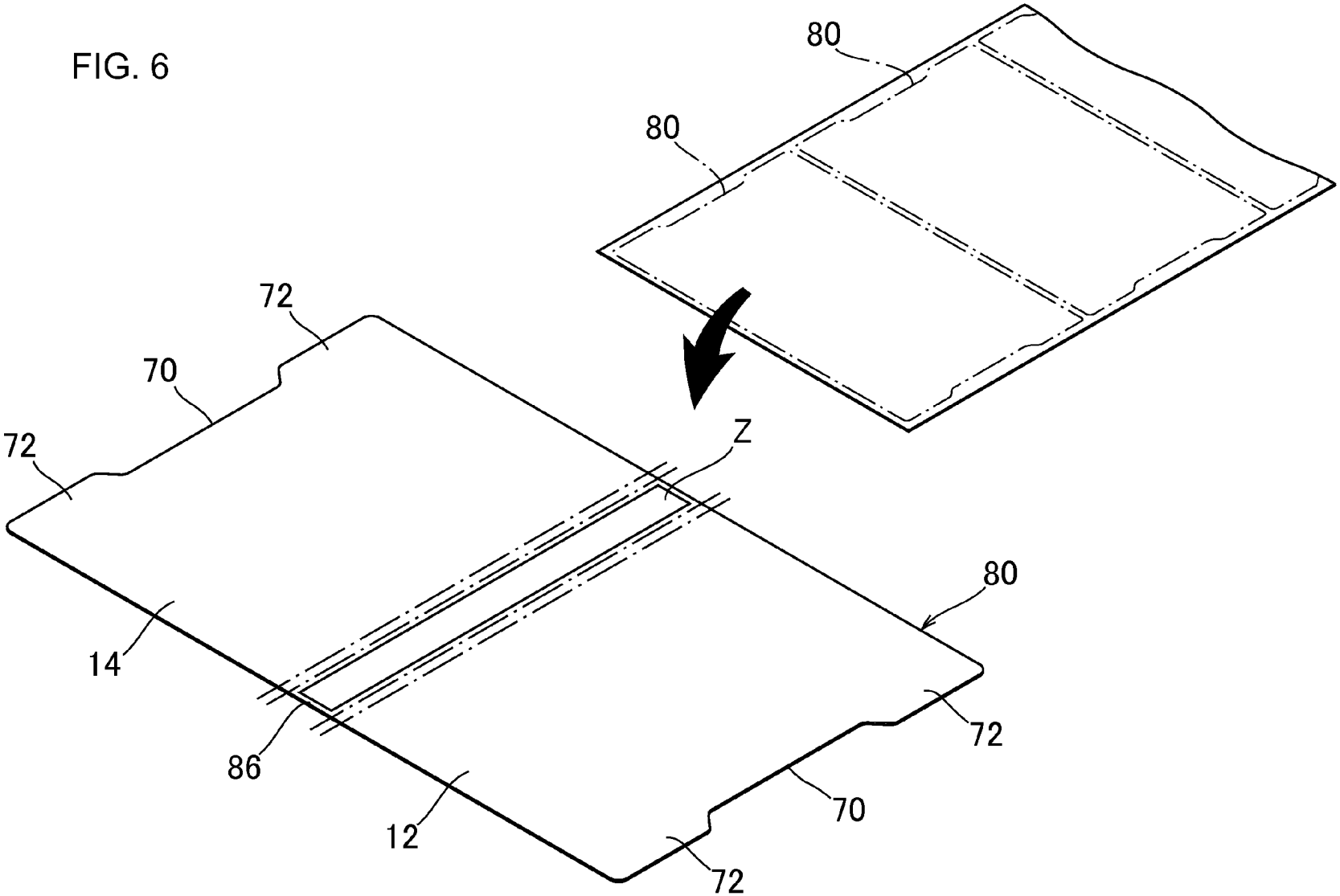
FIG. 6 is a schematic perspective view of a method of manufacturing the file of FIG. 1.
Figure 7A:
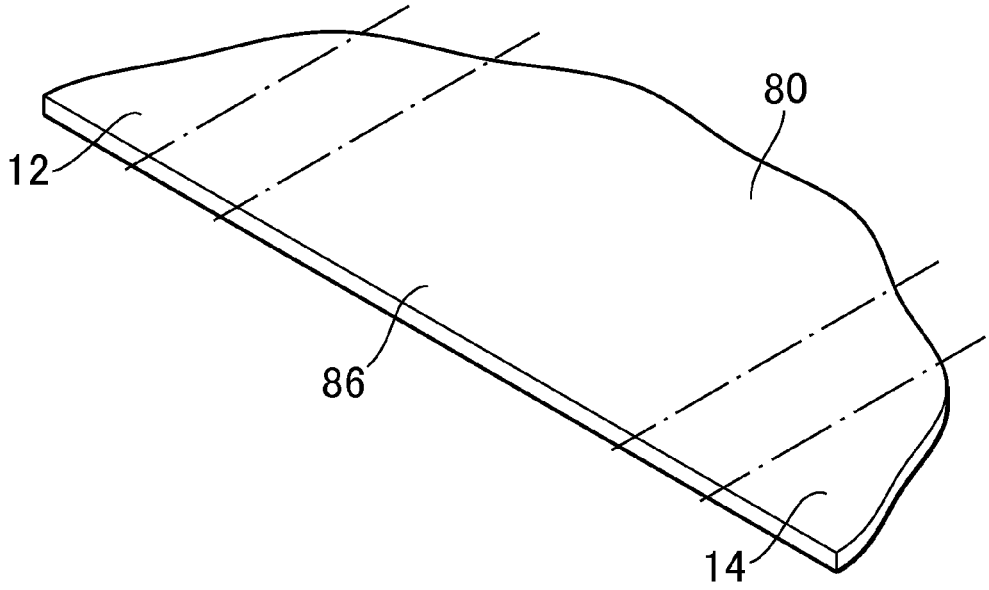
FIGS. 7A and 7B are schematic perspective views of the method of manufacturing the file of FIG. 1.
Figure 7B:
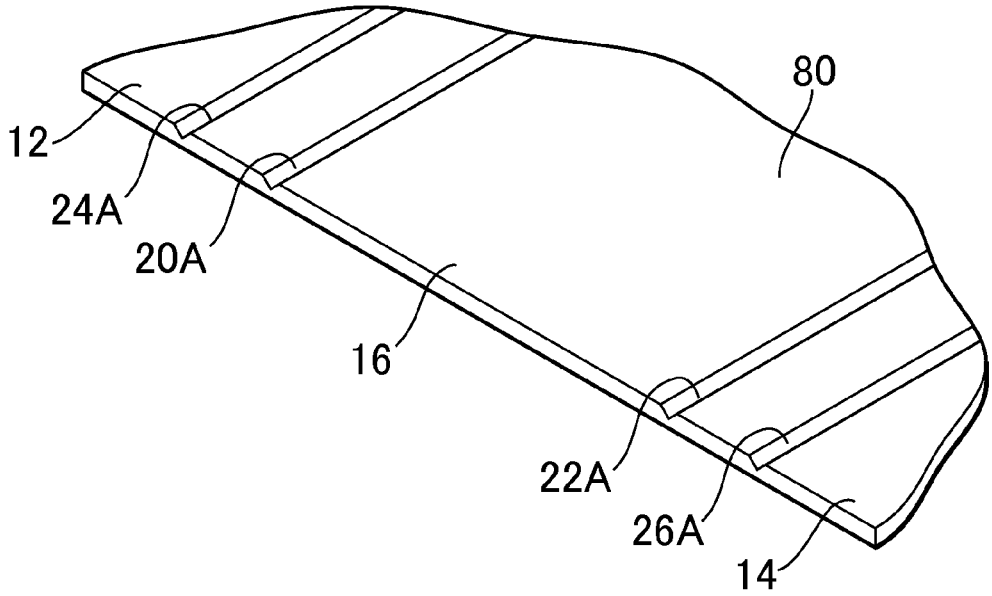

For example, as shown in FIGS. 6, 7A, and 7B, when a thermoplastic resin sheet is used as the cover material 80, the heat-press molding is applied with the V-shape heater (not shown) to V-shape slots 20A, 22A, 24A and 26A which have a substantially V-shaped cross-section and are parallel to one another to form the front adjacently providing portion 20, the back adjacently providing portion 22, the front folding portion 24 and the back folding portion 26. Then, the cover material 80 is formed to enable folding (V-shape slot molding step).

Figure 8:
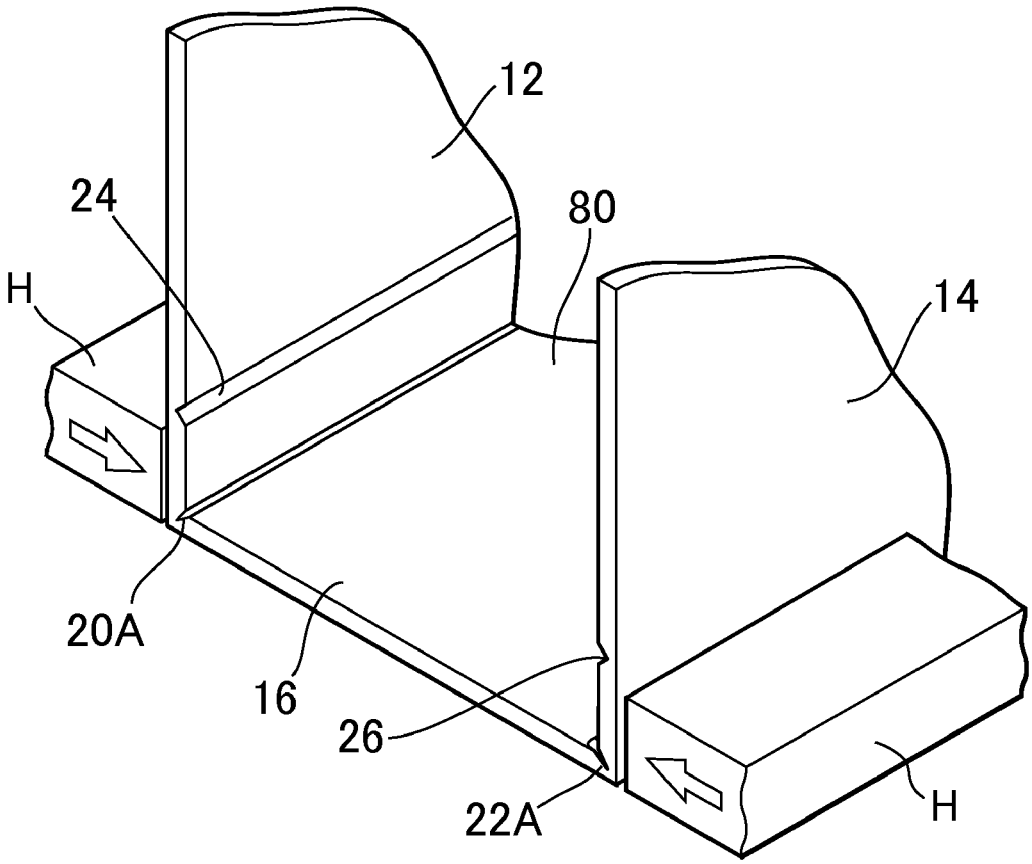
FIG. 8 is a schematic perspective view of the method of manufacturing the file of FIG. 1.

Next, as shown in FIG. 8, heat is applied to the V-shape slots 20A, 22A, 24A and 26A, the V-shape slots 20A, 22A, 24A and 26A are folded corresponding the front adjacently providing portion 22 and the back adjacently providing portion 24, and the front adjacently providing portion 20 and the back adjacently providing portion 22 are molded by joining and solidifying the melted slot walls (adjacently providing portion formation step).

Then, the cover including the grip portion 28 is formed so as to include the front cover portion 12, the back cover portion 14, the spine portion 16 between the front cover portion 12 and the back cover portion 14, the front folding portion 24 including the V-shape slot 24A, and the back folding portion 26 including the V-shape slot 26A.

First, a plurality of pocket sheets 18 is superimposed, and the edge faces of the inner end edge 38 are heated. Consequently, the region which is slightly inward of the inner end edge 38 is melted to fasten the plurality of pocket sheets 18 together. To apply hot welding to the inner end edge 38 of the pocket sheets 18, a hot plate is pressed to the inner end edge 38, the inner end edges 38 are welded and the edge faces of the inner end edge 38 facing one another are adhered to form the group of pocket sheets 30. Adhesion and welding can also be performed with a hot-melt adhesive agent or by ultrasonic horn.

The group of pocket sheets 30 includes pockets combined with thermoplastic resin sheets, each binding sheet is hot adhered to another on the end edge connected to the cover thereof, and the end edge connected to the cover is formed to curve inwardly when the pocket sheet 18 is opened.

Figure 9:
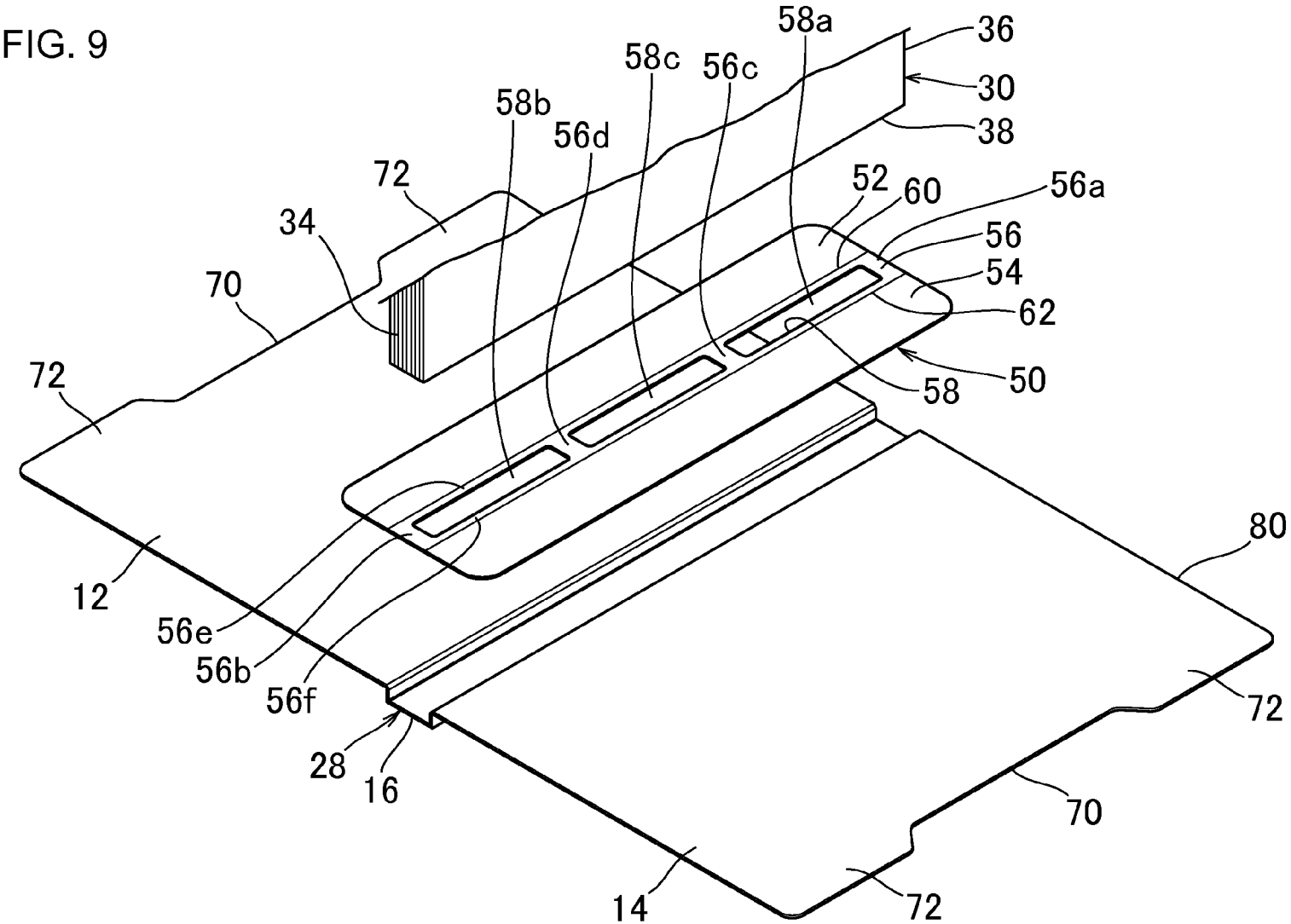
FIG. 9 is a schematic perspective view of the method of manufacturing the file of FIG. 1.
Figure 10:
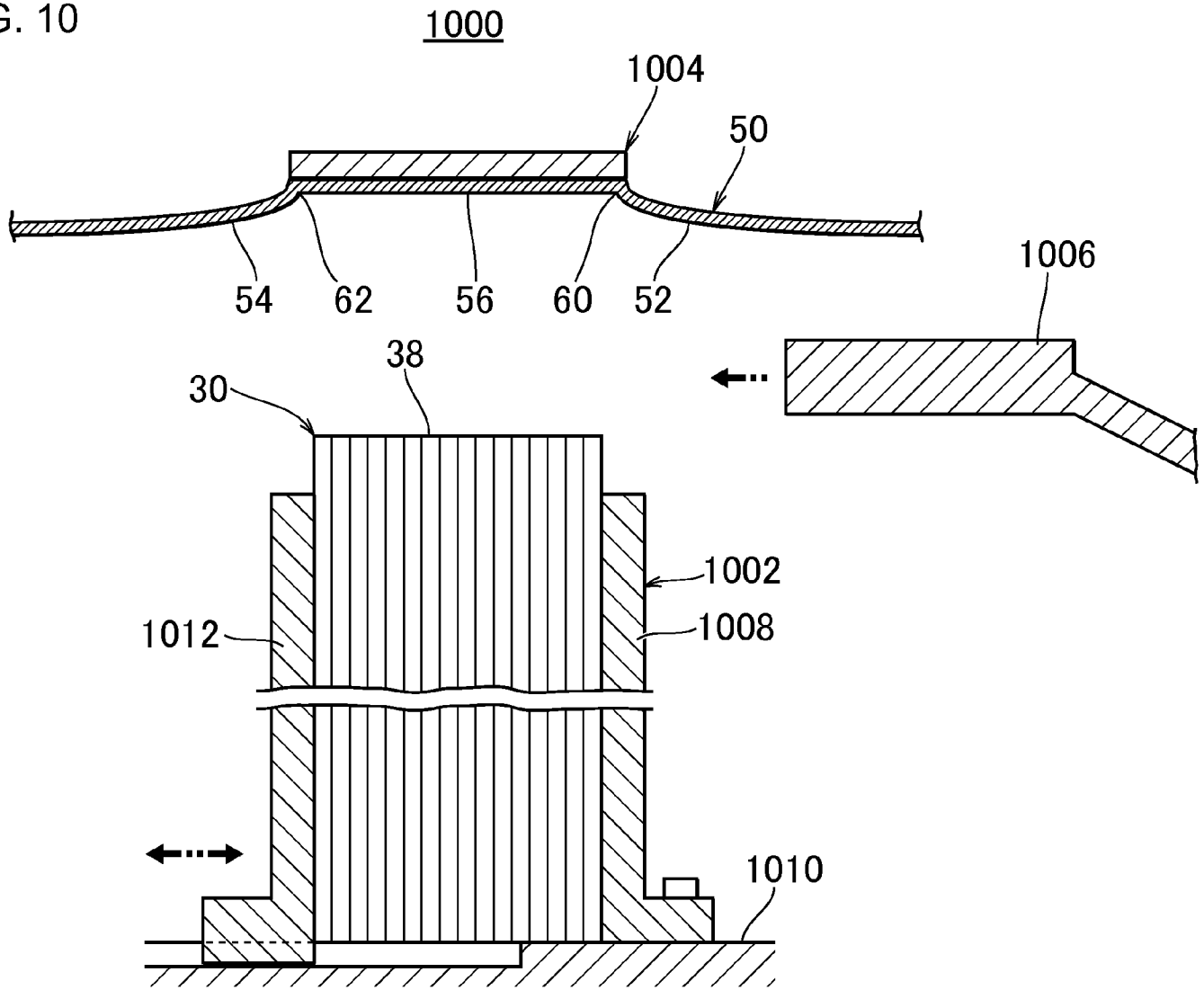
FIG. 10 is a schematic cross-sectional view of the method of manufacturing the file of FIG. 1 including a group of pocket sheets in a preparatory state.
Figure 11:
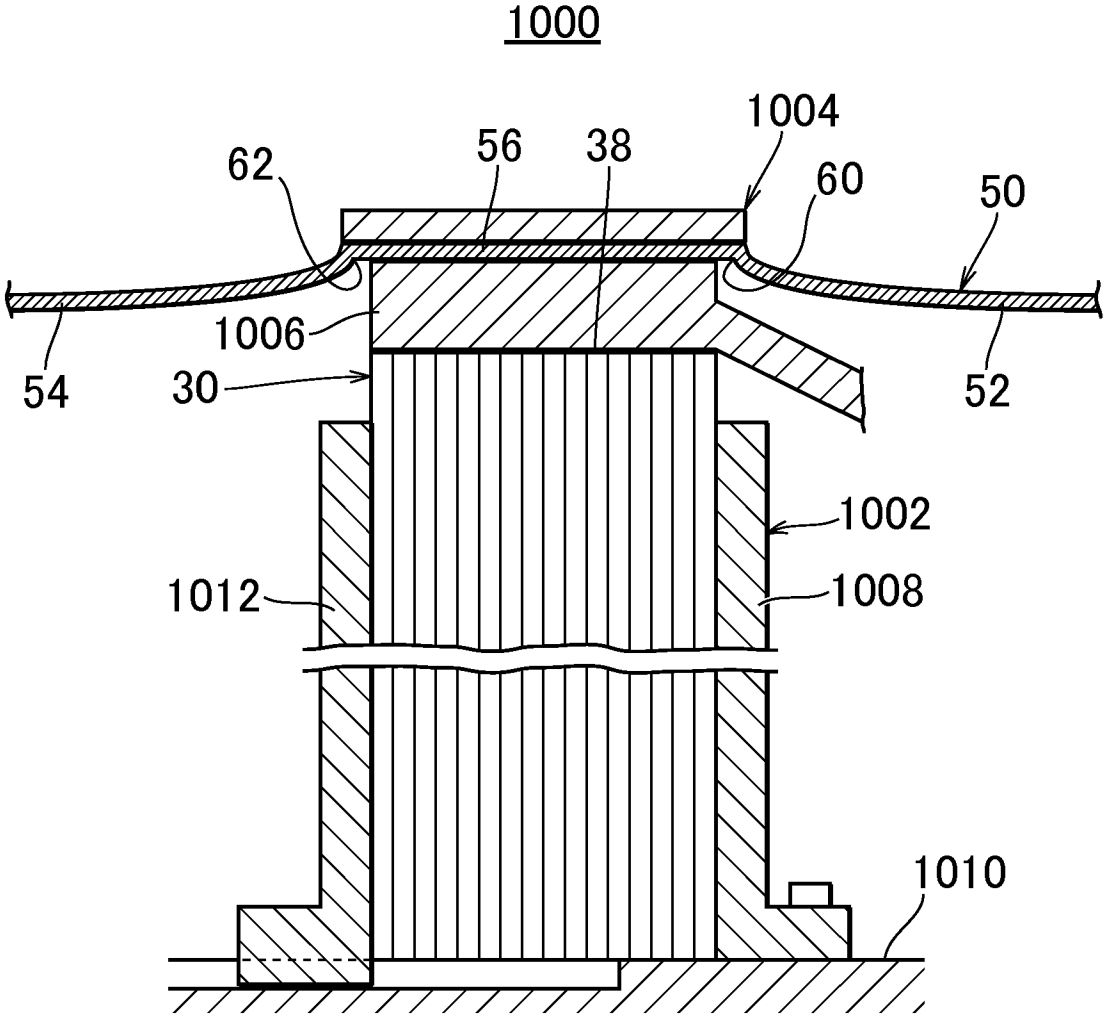
FIG. 11 is a schematic cross-sectional view of the method of manufacturing the file of FIG. 1 including a method of connecting the group of pocket sheets and a connecting body.
Figure 12:
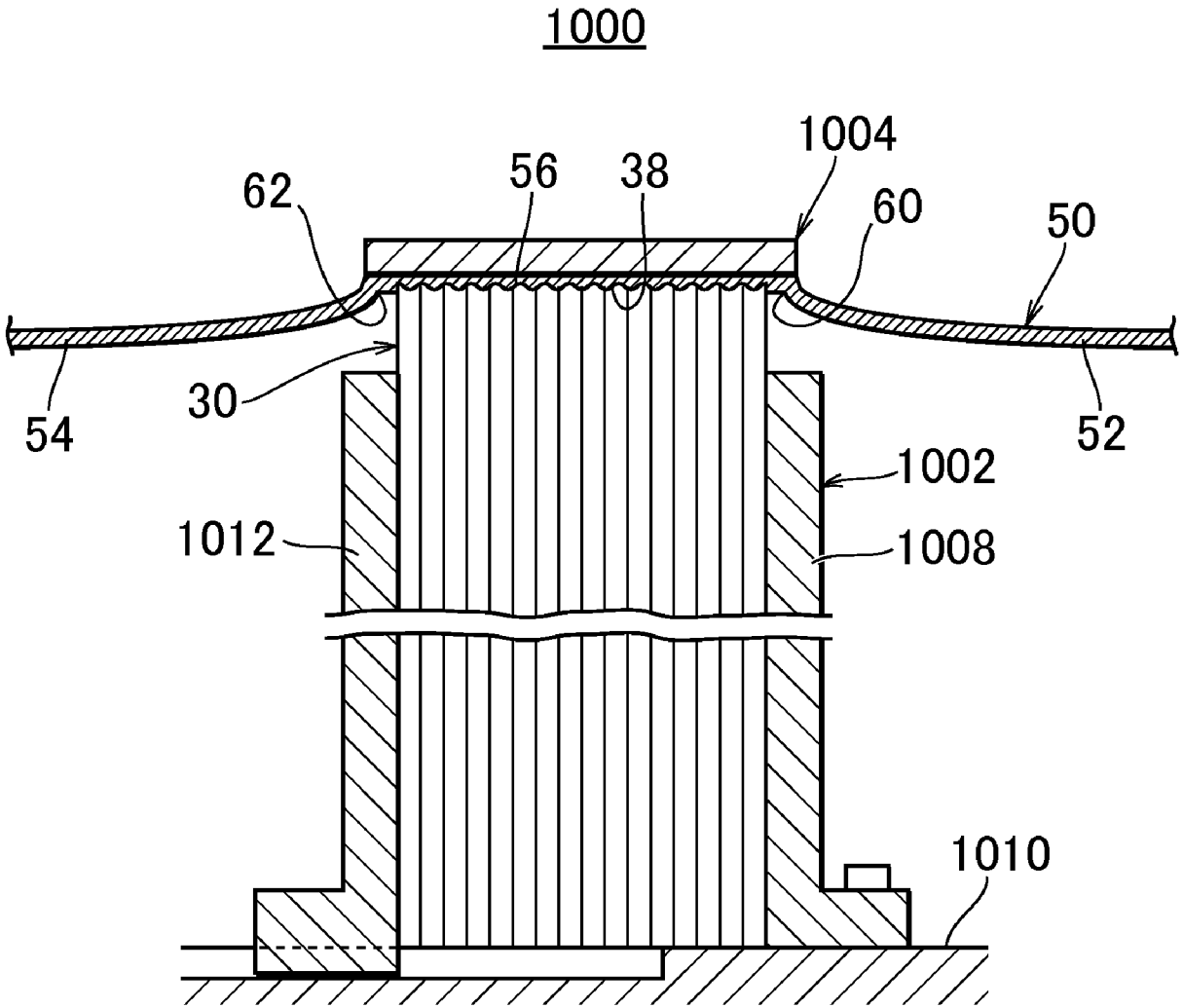
FIG. 12 is a schematic cross-sectional view of the method of manufacturing the file of FIG. 1 including the connecting method of the group of pocket sheets and the connecting body.
Figure 13:
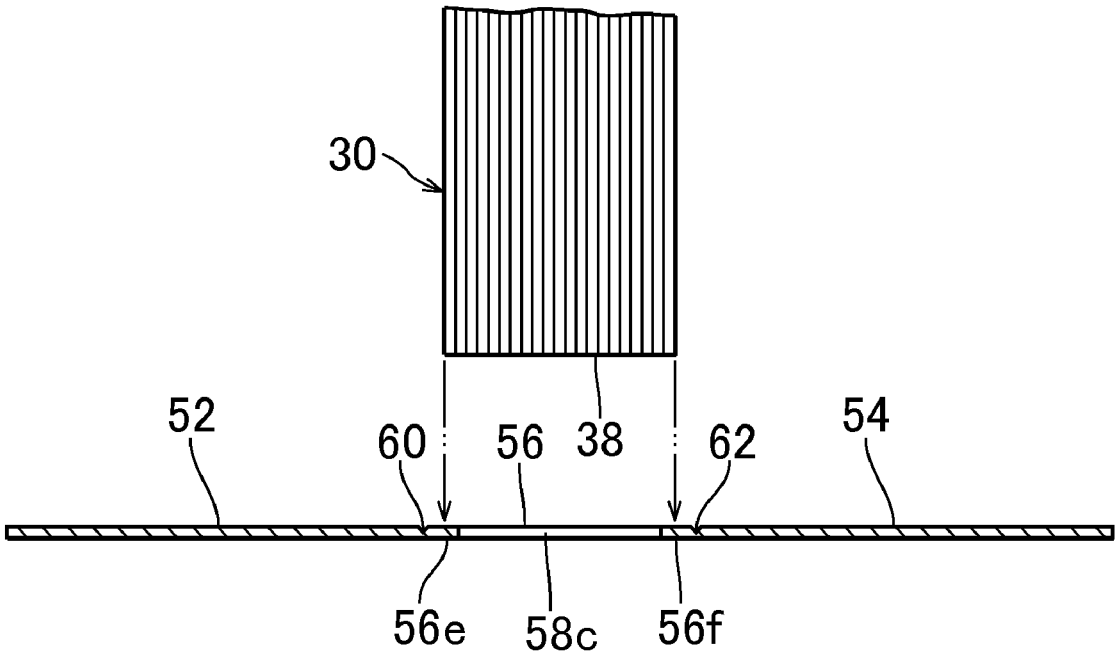
FIG. 13 is a schematic transverse sectional view of a fastening method of a cover body and the connecting body.
Figure 14:
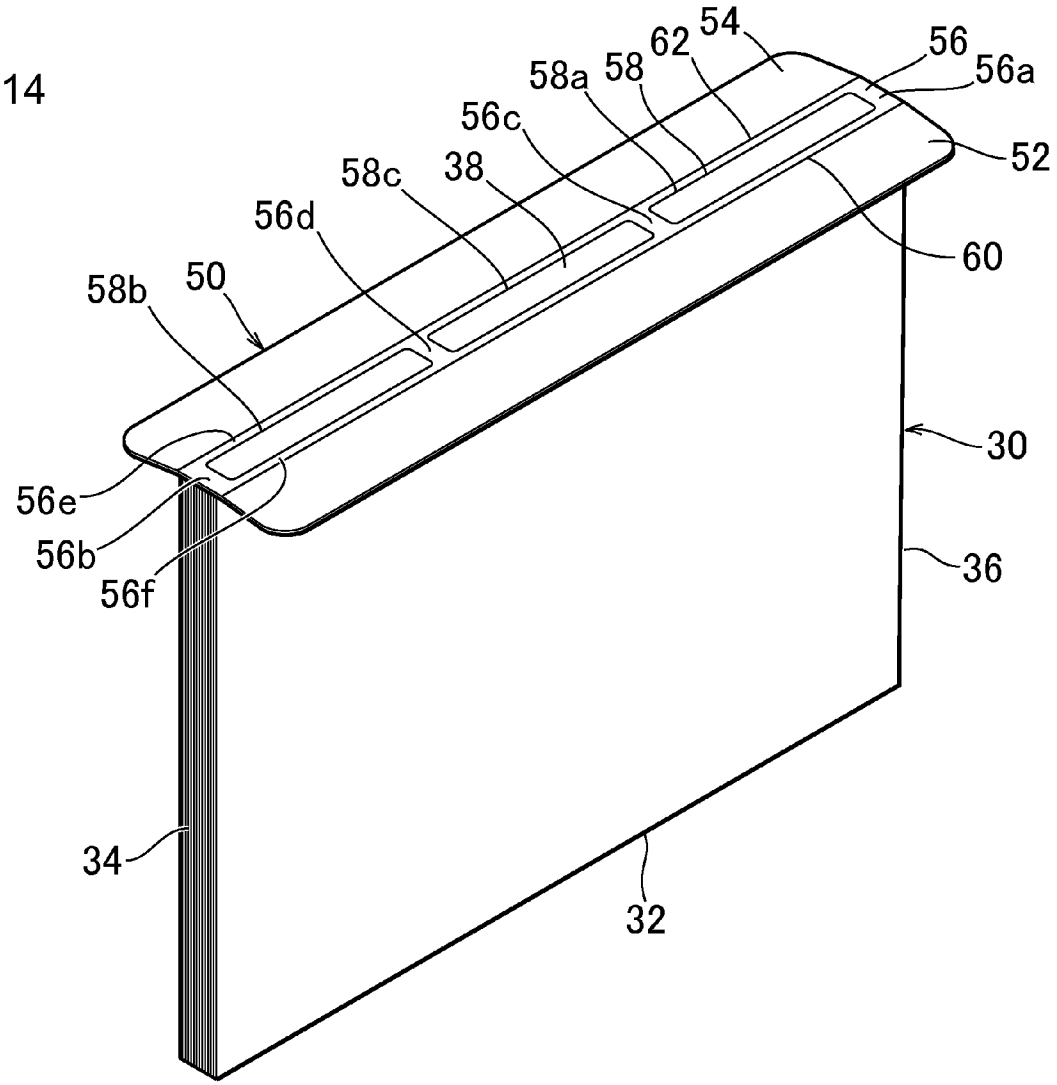
FIG. 14 is a schematic perspective view of the method of manufacturing the file of FIG. 1.
Figure 15:
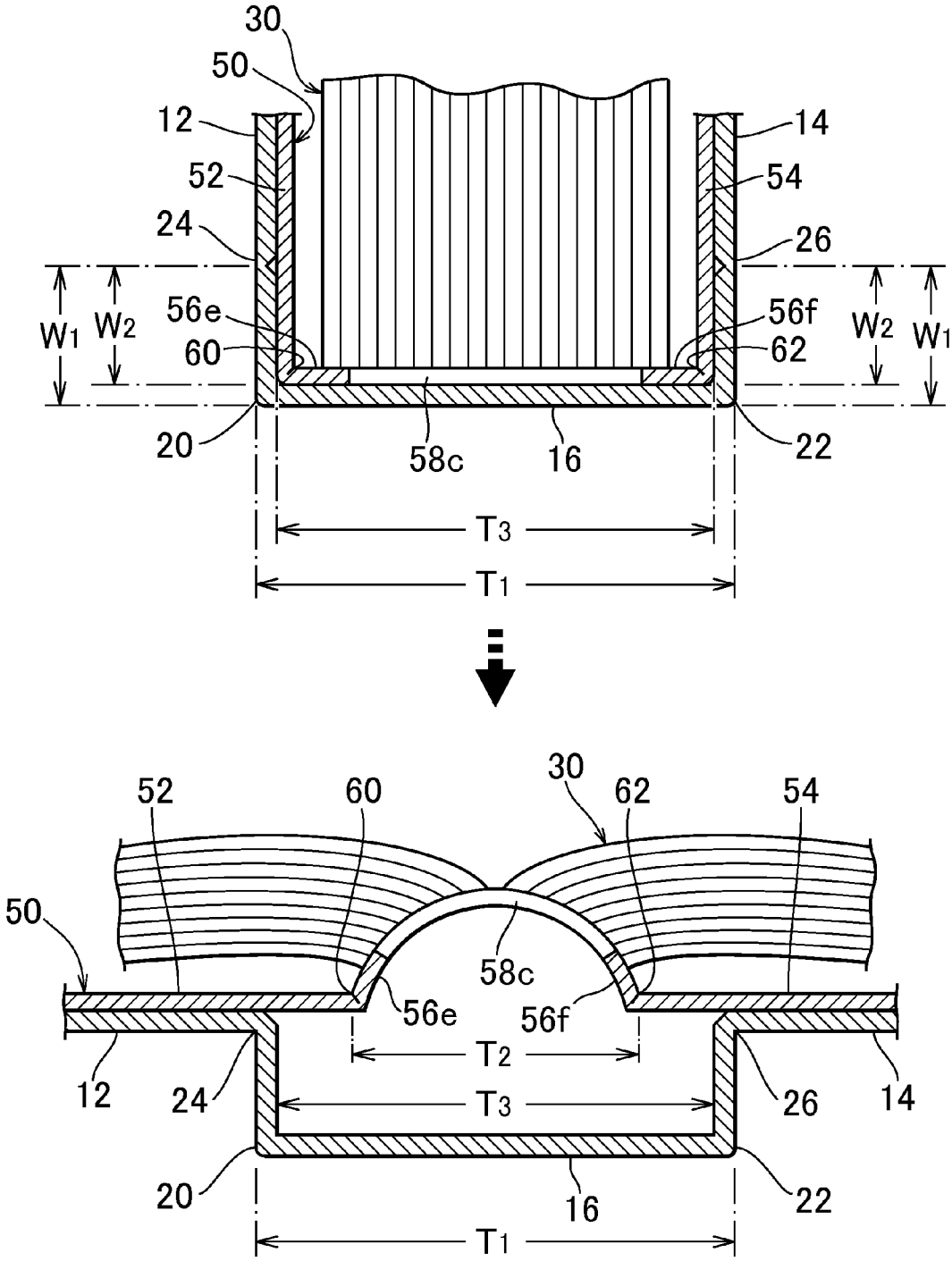
FIG. 15 is a schematic transverse sectional view of an operation of the file of FIG. 1.

Next, a method for fixing the group of pocket sheets 30 to the spine portion 16 will be described with referring to FIGS. 9 and 13.

First, the connecting portion 50 having substantially square planar shape including a synthetic resin sheet body, such as polypropylene or other suitable material, is prepared.

The connecting body 50 includes the connecting portion on the front cover side 52 connected to the side of the front cover portion 12, the connecting portion on the back cover side 54 connected to the side of the back cover portion 14 and the interjacent connecting portion 56 interposing between the connecting portion on the front cover side 52 and the connecting portion on the back cover portion 54.

The interjacent connecting portion 56 is connected to the end edge connected to the cover of the binding body and is formed to curve away from the spine portion 16 along with the end edge connected to the cover of the group of the pocket sheets 30 by the tension of the connecting portion on the front cover portion 52 and the connecting portion on the back cover portion 54 when the cover is opened.

The connecting body 50 preferably includes a through hole 58 in the region connected to the group of pocket sheets 30 and is configured so as to curve. The group of pocket sheets 30 is adhered to the inner surface of the bridge portions 56*a*, 56*b*, 56*c* and 56*d* of the connecting body 50 and also to the inner surface of the longitudinal bridge portion 56*e* and 56*f* with a slight space between the hinge portion on the front cover side 60 and the hinge portion on the back cover side 62.

The group of pocket sheets 30 is applied hot welding to the upper surface of the interjacent connecting portion 56.

The hinge portion on the front cover side 60 and the hinge portion on the back cover side 62 are formed between the connecting portion on the front cover side 52 and the interjacent connecting portion 56 and between the connecting portion on the back cover side 54 and the interjacent connecting portion 56.

The distance between the spine portion 16 and the front folding portion 24 of the front cover portion 12 and the back folding portion 26 of the back cover portion 14 respectively is preferably substantially equal to or less than the distance between the hinge portion on the front cover side 60 of the connecting body 50 and the inner surface of the front cover portion 12 or the hinge portion on the back cover side 62 and the inner surface of the back cover portion 14. The hinge portion on the front cover side 60 and the hinge portion on the back cover side 62 are preferably arranged adjacent to the end edge of the spine portion 16 in a crossing direction when the cover is closed.

The interjacent connecting portion 56 between the hinge portion on the front cover side 60 and the hinge portion on the back cover side 62 is configured to curve away from the spine portion 16 and the width between the hinge portion on the front cover side 60 and the hinge portion on the back cover side 62 is preferably less than the width of the spine portion 16 when the front cover portion 12 is opened.

Next, a method for adhering the group of pocket sheets 30 to the cover material 80 will be described.

The connecting body 50 is connected adjacent to the front folding portion 24 of the front cover portion 12 and the back folding portion 26 of the back cover portion 14 and preferably spaced from the group of the pocket sheets 30 in the crossing direction such that the connecting body 50 enables the end edge connected to the cover of the group of pocket sheets 30 to curve with the width less than the width of the spine portion 16 of the cover body.

The connecting body 50 is welded to the connecting portion on the front cover side 52 connected to the side of the front cover portion 12 and the inner surface of the front cover portion 12 and also to the connecting portion on the back cover side 54 on the side of the back cover portion 14 and the inner surface of the back cover portion 14 and is crosslinked between the front cover portion 12 and the back cover portion 14.

In accordance with a preferred embodiment of the present invention, the connecting body 50 includes the connecting portion on the front cover side 52 connected to the side of the front cover portion 12, the connecting portion on the back cover side 54 connected to the side of the back cover portion 14 and the interjacent connecting portion 56 interposed between the connecting portion on the front cover side 52 and the connecting portion on the back cover portion 54. The interjacent connecting portion 56 is connected to the end edge connected to the cover of the binding body and is configured to curve away from the spine portion 16 along with the end edge connected to the cover of the binding body by the tension of the connecting portion on the front cover portion 52 as the rigid body and the connecting portion on the back cover portion 54 as the rigid body when the cover body is opened.

In the connecting body 50, the hinge portion is preferably provided between the connecting portion on the front cover side 52 and the interjacent connecting portion 56 and between the connection portion on the back cover side 54 and the interjacent connecting portion 56.

The distance (W1) between the spine portion 16 and the front folding portion 24 of the front cover portion 12 and the back folding portion 26 of the back cover portion 14, respectively, is preferably substantially equal to the distance (W2) between the hinge portion on the front cover side 60 of the connecting body 50 and the inner surface of the front cover portion 12 or the hinge portion on the back cover side 62 and the inner surface of the back cover portion 14 and (W2) is less than (W1) by the thickness of the spine portion 16.

The hinge portion in the front cover side 60 and the hinge portion on the back cover side 62 are positioned adjacent to the end edge of the spine portion 16 in a crossing direction when the cover body is closed. The hinge portion on the front cover side 60 and the hinge portion on the back cover side 62 are configured to curve away from the spine portion 16 when the cover body is opened and the width between the hinge portion on the front cover side 60 and the hinge portion on the back cover side 62 is less than the width of the spine portion 16. Accordingly, when the cover body is opened and the group of pocket sheets 30 is spread thereby, the pocket sheet 18 is relatively flat.

Figure 18:
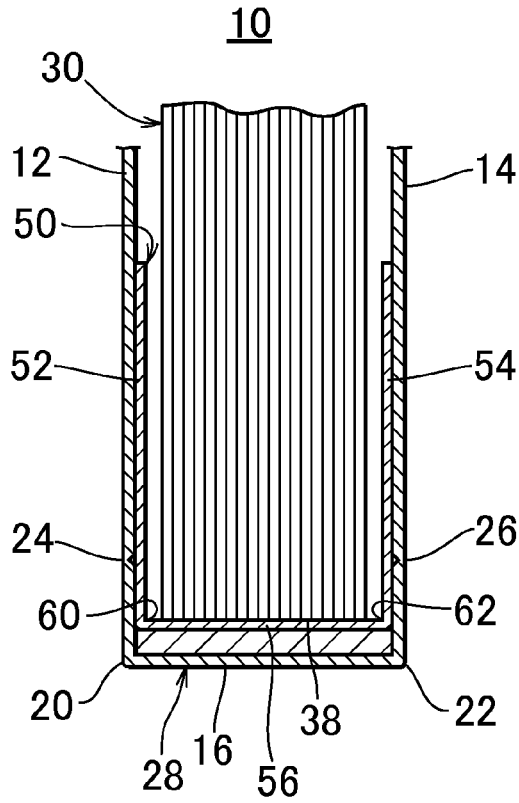
FIG. 18 is a modified example of a schematic view of the file of FIG. 1 in which the cover is in a closed state.
Figure 19:
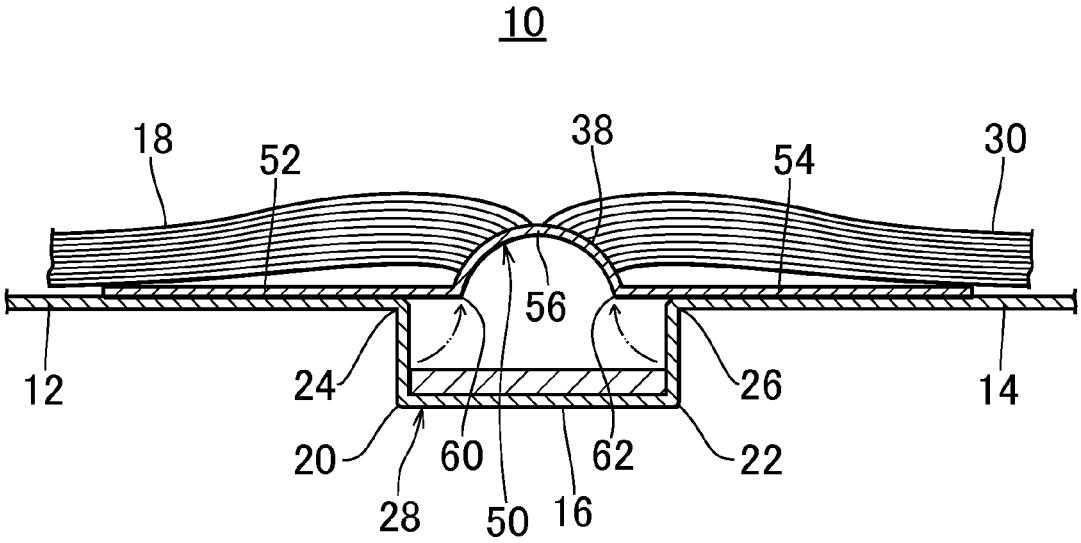
FIG. 19 is a modified example of a schematic view of the file of FIG. 1 in which the cover is in an opened state.

The present invention is not limited to the preferred embodiments previously described. For example, in the connecting body 50, as shown in FIGS. 18 and 19, the distance between the spine portion 16 and the front folding portion 24 of the front cover portion 12 and the back folding portion 26 of the back cover portion 14, respectively, may preferably be less than the distance between the hinge portion on the front cover side 60 of the connecting body 50 and the inner surface of the front cover portion 12 or the hinge portion on the back cover side 62 and the inner surface of the back cover portion 14.

By using this method, the region of the interjacent connecting portion 56 may we weighed down with the group of pocket sheets 30 toward the side of the spine portion 16. Therefore, to retain the interjacent connecting portion 56 and the spine portion 16 so as to be substantially parallel, a void between the interjacent connecting portion 56 and the spine portion 16 may be filled with foam or other suitable material.

Figure 16:
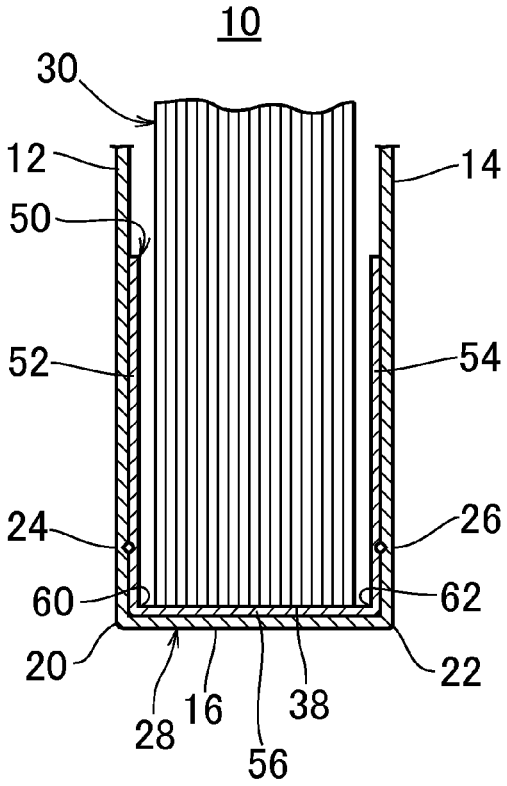
FIG. 16 is a modified example of a schematic view of the file of FIG. 1 in which the cover is in a closed state.
Figure 17:
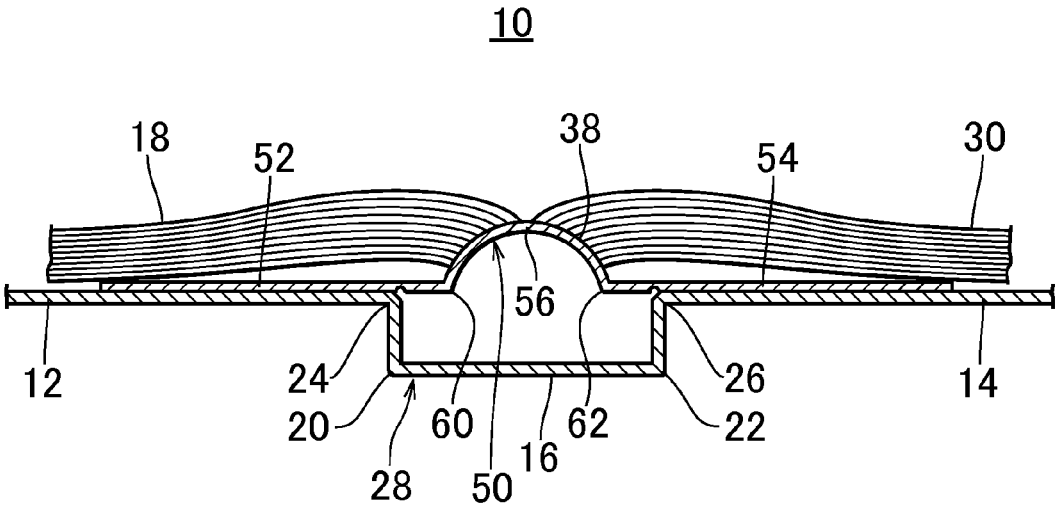
FIG. 17 is a modified example of a schematic view of the file of FIG. 1 in which the cover is in an opened state.

Additionally, as shown in FIGS. 16 and 17, the hinge portion is disposed adjacent to the front folding portion 24 at the connecting portion on the front cover side 52 and the back folding portion 26 at the connecting portion on the back cover side 54. The group of pocket sheets 30 may preferably be configured to be spread flat by curving the interjacent connecting portion 56 away from the spine portion 16 due to the weight of the pocket sheet 18 when the pocket sheet 18 is opened toward the sides of the front cover portion 12 and the back cover portion 14.

Figure 21:
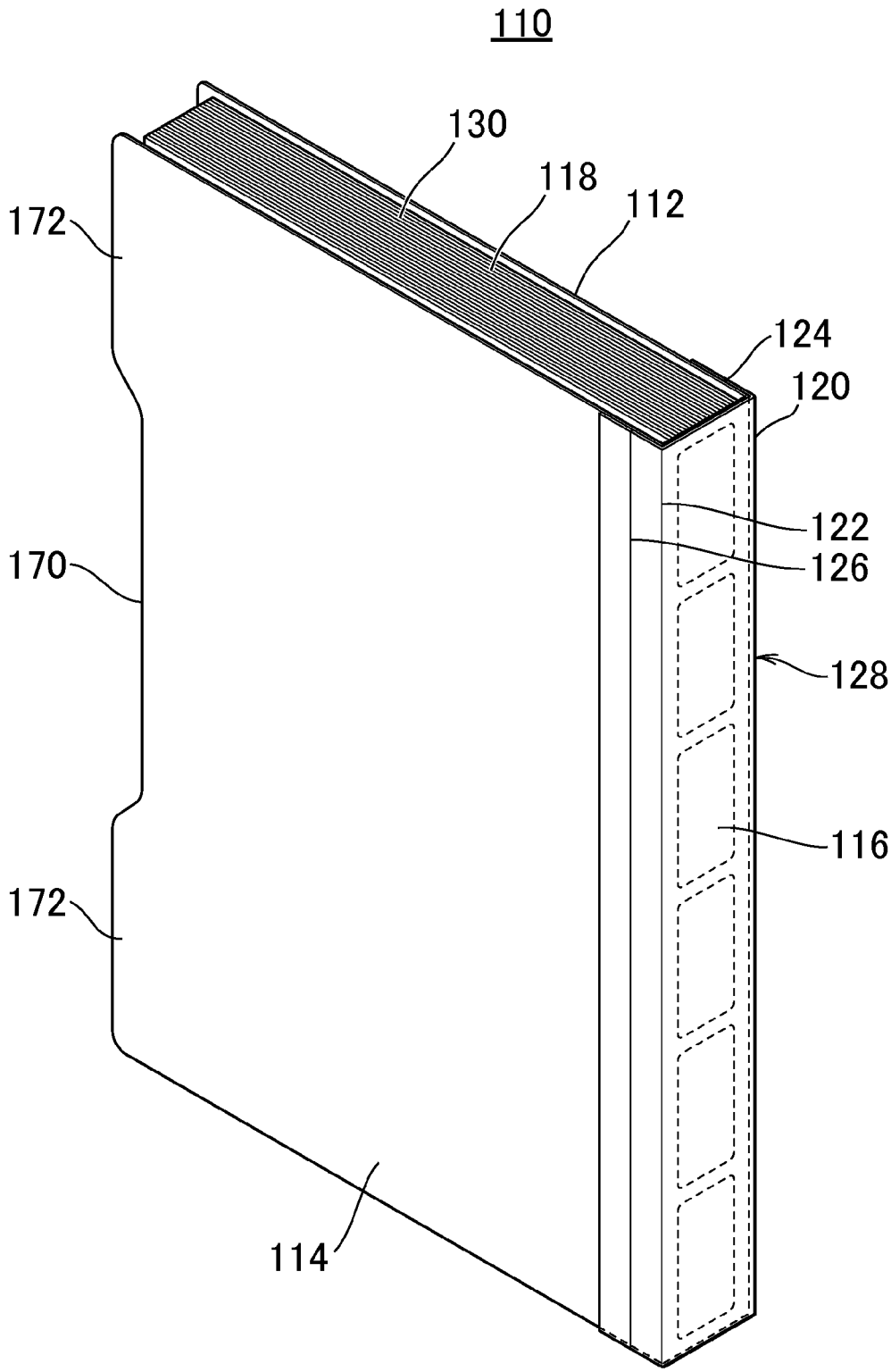
FIG. 21 is a schematic perspective view of the file pocket according to another preferred embodiment of the present invention.
Figure 22:
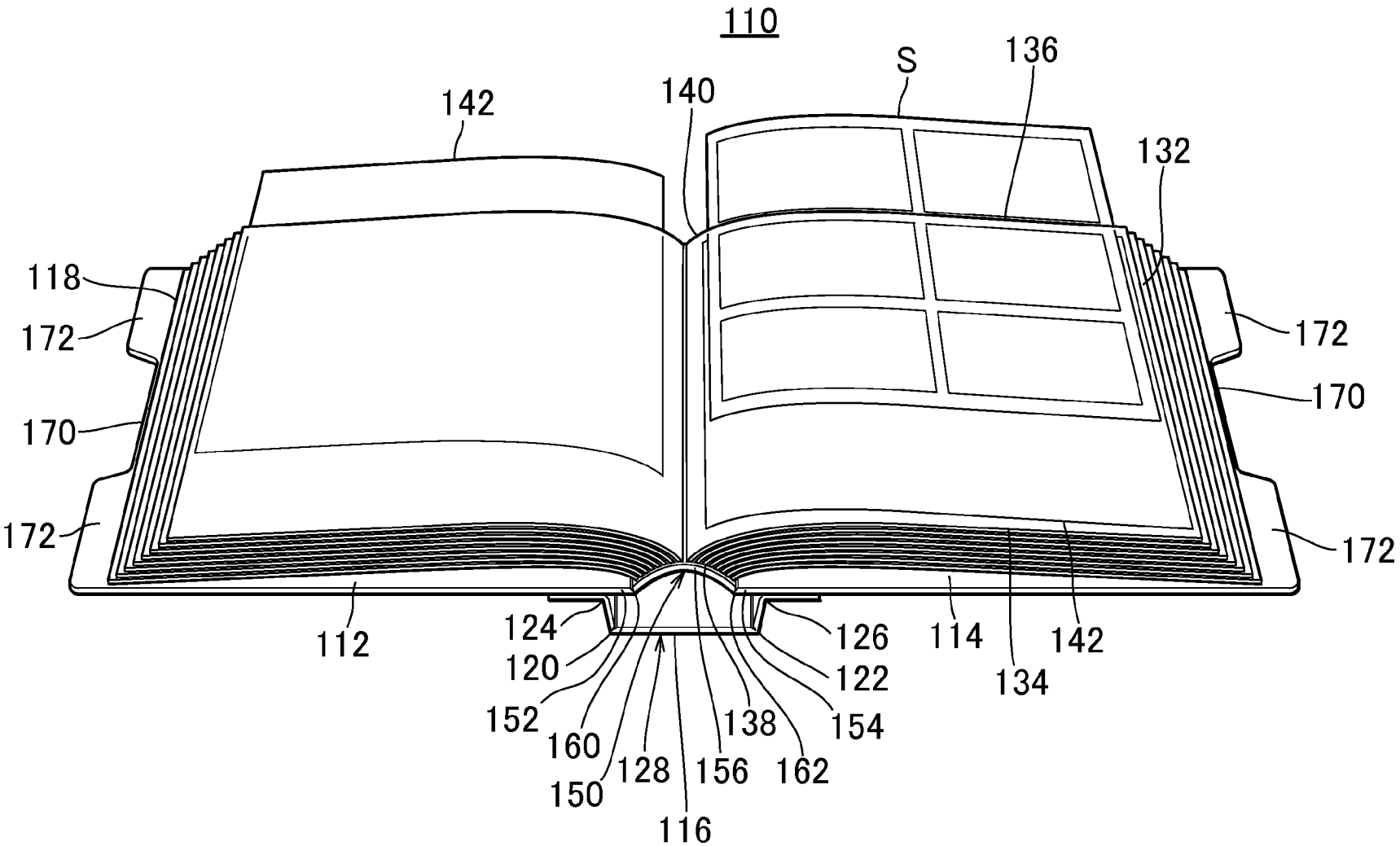
FIG. 22 is a schematic perspective view of the pocket file of FIG. 21 in an opened state.
Figure 23:
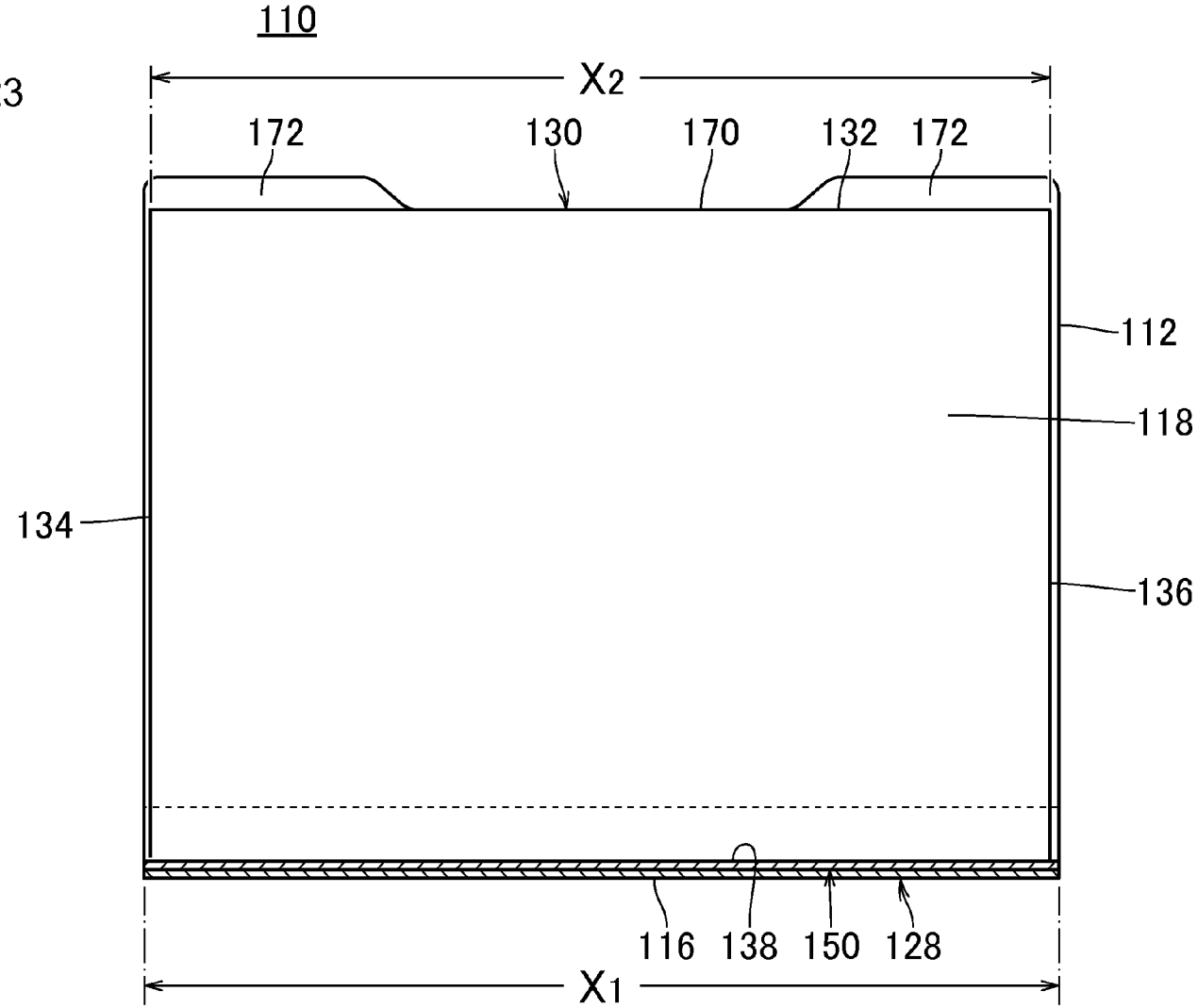
FIG. 23 is a schematic transverse sectional view of the pocket file of FIG. 21 in a closed state.

FIG. 21 is a schematic perspective view of the pocket file in accordance with an embodiment of the present invention, FIG. 22 is a schematic perspective view of the pocket file in accordance with an opened state as shown in FIG. 21. FIG. 23 is a schematic transverse sectional view of the pocket file in a closed state as shown in FIG. 21.

A file 110 includes a cover body including a front cover portion 112 made of synthetic-resin, such as polypropylene, for example, a back cover portion 114, and a spine portion 116 provided between the front cover portion 112 and the back cover portion. A group of pocket sheets 130 superimposes a pocket sheet 118 and is welded and connected to a connecting end edge of the group of pocket sheets 130 by being fastened the group of pocket sheets 130 as the binding body connected at an end edge which is connected to the spine portion 116.

The file 110 preferably includes a curved subsidiary portion which is fixed to the back of the cover body in regions on a front cover side and on a back cover side of the spine portion 116 between the front cover portion 112 and the back cover portion 114 and the curved retaining portion configured to curve the end edge of the group of pocket sheets 130 towards a direction of the pocket sheet 118 extending at the inner side of the spine portion 116 adjacently provided between the front cover portion 112 and the back cover portion 114 when the cover is opened.

The front cover portion 112 and the back cover portion 114, as shown in FIGS. 23 through 26, define a curved subsidiary portion which causes the back of the binding body to have a particular shape in a region on a front cover side and a region on a back cover side of the spine portion 116 between the front cover portion 112 and the back cover portion 114. In this embodiment, the curved subsidiary portion is defined by an independent curved subsidiary member 128.

The front cover portion 112 and the back cover portion 114 are provided adjacent to the spine portion 116 so as to extend at a substantially right angle via a linear front folding portion 124 and a linear back folding portion 126 and a linear front adjacently providing portion 120 and a linear back adjacently providing portion 122 extending from the top edge to the bottom edge in the direction of the distance of the front cover portion 112 and the back cover portion 114 when the cover body is closed.

The pocket sheets 118 are flexibly provided between a portion at which the pocket sheet 118 is fastened to the inner side of the spine portion 116 between the front cover portion 112 and the back cover portion 114 and a portion disposed at least above a front folding portion 124 and a back folding portion 126 (when the cover body is closed).

The pocket sheets 118 include a linear outer end edge 132, a linear bottom edge 134, and an opening edge 136 provided at a top end edge which is opposite to the bottom edge 134 and is connected to the inner surface of the spine portion 116 at an inner end edge 138 opposite to the linear outer end edge 132.

The pocket sheet 118 includes a pocket portion 140 arranged to accommodate an object to be bound S, such as documents, and includes a mount 142 extending in a direction away from a portion at which the spine portion 116 is fastened to be inserted from a portion above the front folding portion 124 and the back folding portion 126 (when the cover body closed) in the inner side of the pocket portion 140.

The group of pocket sheets 130 is connected by a curved retaining portion 150 provided adjacent to the front cover portion 112 and the back cover portion 114 at the connecting end edge connected to the group of pocket sheets 130.

The curved retaining portion 150 is preferably defined by a substantially square rigid plate body when viewed in a planar view that is made of thermoplastic synthetic resin and includes the curved retaining portion which curves the group of pocket sheets 130 that are welded and connected thereto at the connecting end edge of the group of pocket sheets 130, in a direction away from the spine portion 116 when the cover body is opened.

The curved retaining portion 150 is connected adjacent to the outer side of the hinge portion on a front cover side 160 and the outer side of the hinge portion on a back cover side 162 and is preferably spaced from the group of the pocket sheets 130 in the crossing direction such that the curved retaining portion 150 enables the end edge connected to the cover of the group of pocket sheet 130 to curve with a width that is less than the width of the spine portion 116 of the curved subsidiary portion 128.

The curved retaining portion 150 includes the connecting portion on a front cover side 152 adjacently provided in the side of the front cover portion 112, the connecting portion on a back cover side 154 adjacently provided in the side of the back cover portion 114, and an interjacent connecting portion 156 interposed between the connecting portion on the front cover side 152 and the connecting portion on the back cover portion 154. The interjacent connecting portion 156 is connected to the end edge connected to the cover of the group of pocket sheets 130 and is configured to curve away from the spine portion 116 along with the end edge connected to the cover of the group of the pocket sheets 130 by the tension of the connecting portion on the front cover side 152 and the connecting portion on the back cover side 154 when the cover is opened.

The curved retaining portion 150 is relatively flexible and is configured to arch away from the spine portion 116 by the weight of the pocket sheet 118 being in a spread state.

The front cover portion 112 and the connecting portion on the front cover side 152 are defined by unified flat plate, and the back cover portion 114 and the connecting portion on the back cover side 154 are also defined by a unified flat plate.

The curved retaining portion 150 is preferably a thermoplastic synthetic resin sheet body, such as polypropylene or other suitable material, for example, having a square planar shape and includes a through hole 58 in the region connected to the binding body and is configured so as to curve.

The curved retaining portion 150 includes a plurality of rectangular planar shaped through holes 158 which are spaced from one another and flexibility is provided thereto. In this preferred embodiment, 6 through holes are provided, an upper through hole 158*a*, a lower through hole 158*b*, and middle through holes 158*c*1, 158*c*2, 158*c*3 and 158*c*4.

In this preferred embodiment, in the interjacent connecting portion 156, bridge portions 156*a* and 156*b* are provided between the connecting portion on the front cover side 152 and the connecting portion on the back cover side 154 at the upper edge and the lower edge, respectively. Bridge portions 156*c*1, 156*c*2, 156*c*3 and 156*c*4 are provided between middle through holes 158*c*1 and 158*c*4 and the bridge portion 56*c*5 is provided between the middle through hole 158*c*4 and the lower through hole 158*b*. Therefore, the adhesion region of the group of pocket sheets 130 and the interjacent connecting portion 156 is provided.

Further, a longitudinal bridge portion 156*e* is provided between a hinge portion on the front cover side 160 and the upper through hole 158*a*, the lower through hole 158*b* and the middle through holes 158*c*1, 158*c*2, 158*c*3, and 158*c*4, and a longitudinal bridge portion 156*f* is provided between a hinge portion on the back cover side 162 and the upper through hole 158*a*, the lower through hole 158*b* and the middle through holes 158*c*1, 158*c*2, 158*c*3 and 158*c*4.

The longitudinal bridge portion 156*e* and the longitudinal bridge portion 156*f* are successively arranged so as to extend from the top edge to the bottom edge of the cover body.

On the curved retaining portion 150, the hinge portion on the front cover side 160 provided between the connecting portion on the front cover side 152 and the interjacent connecting portion 156 and the hinge portion on the back cover side 162 provided between the connecting portion on the back cover side 154 and the interjacent connecting portion 156 are parallel or substantially parallel to each other.

The distance between the spine portion 116 and the front folding portion 124 of the front cover portion 112 and the back folding portion 126 of the back cover portion 114, respectively, is preferably substantially equal or less than the distance between the hinge portion on the front cover side 160 of the curved retaining portion 150 and the inner surface of the front cover portion 112 and the hinge portion on the back cover side 162 and the inner surface of the back cover portion 114. The hinge portion on the front cover side 160 and the hinge portion on the back cover side 162 are preferably arranged adjacent to the end edge of the spine portion 116 in a crossing direction when the cover body is closed.

The interjacent connecting portion 156 between the hinge portion on the front cover side 160 and the hinge portion on the back cover side 162 is configured to curve away from the spine portion 116 when the front cover portion 112 is opened and the width between the hinge portion on the front cover side 160 and the hinge portion on the back cover side 162 is preferably less than the width of the spine portion 116.

The front cover portion 112 and the back cover portion 114, as shown in FIGS. 23 through 26, define a curved subsidiary portion which causes the back of the binding body to have a particular shape in a region on a front cover side and a region on a back cover side of the spine portion 116 between the front cover portion 112 and the back cover portion 114. In this preferred embodiment, the curved subsidiary portion is defined by an independent curved subsidiary member 128.

The curved subsidiary member 128 is preferably a thermoplastic synthetic resin sheet body, such as polypropylene or other suitable material, and has a substantially square planar shape. The front folding portion 124 and the back folding portion 126 extending from the upper edge to the lower edge are successively provided and the curved subsidiary portion 128 is provided in the region from the front folding portion 124 on the front cover portion 112 to the spine portion 116, the region from the back folding portion 126 on the back cover portion 114 to the spine portion 116 and the spine portion 116.

In curved subsidiary member 128, the connecting portion on the front cover side 152 including the front folding portion 124 as an axis moves upwardly in the region on the spine portion 116 on the front cover side extending between the front cover portion 112 and the back cover portion 114, and the connecting portion on the back cover side 154 including the back folding portion 126 as an axis moves upwardly and the curved subsidiary portion 128 defines the curved subsidiary portion which enables the curved retaining portion 150 to arch upwardly, i.e. in the direction away from the spine portion 116, when the front cover portion 112 and the back cover portion 114 are substantially horizontal and parallel to the curved subsidiary member 128 of the horizontal spine portion 116.

On the front cover portion 112 and the back cover portion 114, the front folding portion 124 and the back folding portion 126 are parallel or substantially parallel to the front adjacently providing portion 120 and the back adjacently providing portion 122 in a direction of their heights extending from the top edge to the bottom edge thereof adjacent to the front adjacently providing portion 120 and the back adjacently providing portion 122.

Figure 24:
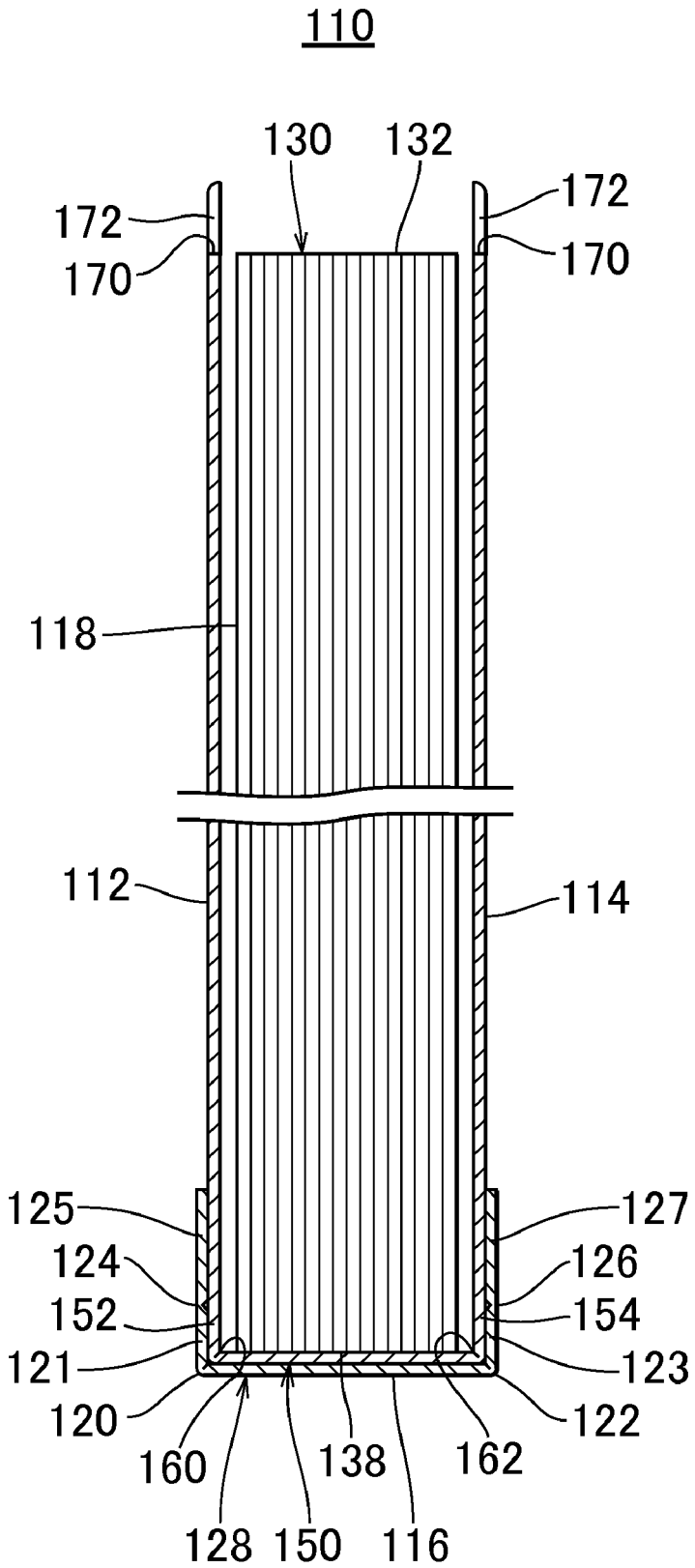
FIG. 24 is a schematic transverse sectional view of the pocket file of FIG. 21 in a closed state.
Figure 25:
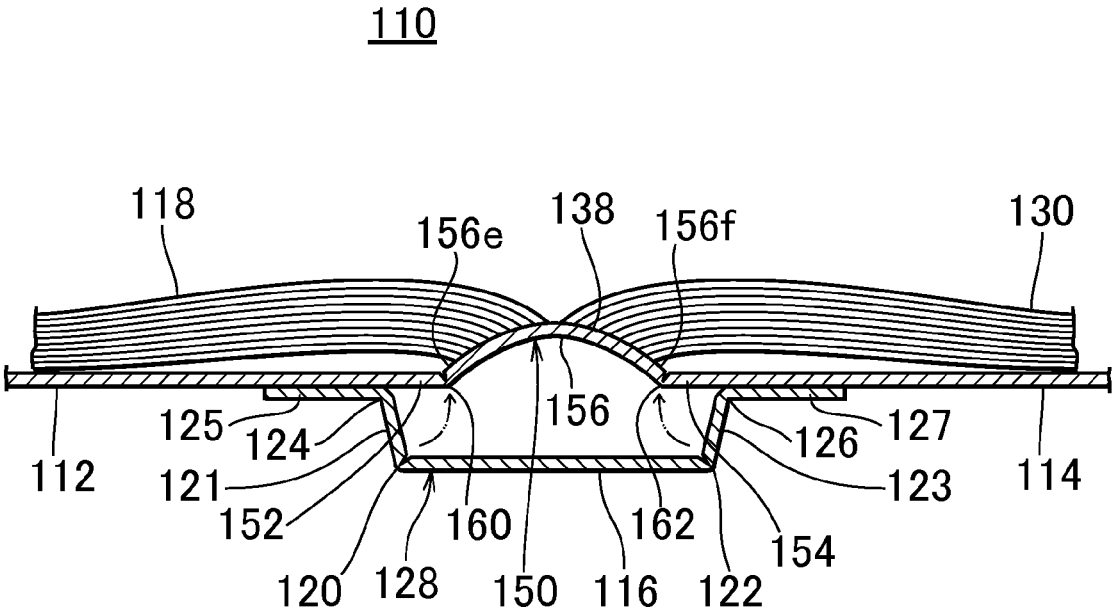
FIG. 25 is a schematic transverse sectional view of the pocket file of FIG. 21 in an opened state.

The length of the inner surface of the spine portion 116 and the front folding portion 124 and the length of the inner surface of the spine portion 116 and the back folding portion 126 are preferably equal or substantially equal to each other (shown in FIG. 24).

A square shape retaining portion 121 adjacently provided via the front adjacently providing portion 120 on the side of the front adjacently providing portion 120 of the spine portion 116 is provided and a square shape retaining portion 123 adjacently provided via the back adjacently providing portion 122 on the side of the back adjacently providing portion 122 is provided.

A square shape fastening portion on the front cover side 125 is adjacently provided via the front folding portion 124 on the side of the front folding portion 124 of the shape retaining portion 121 and a square shape fastening portion on the back cover side 127 is adjacently provided via the back folding portion 126 on the side of the back folding portion 126.

The curved subsidiary member 128 has an angular structure such that the user can set the spine portion 116 on his palm, grip the grip portion 128 with his fingers, and open the pocket sheet 118.

On the front cover portion 112 and the back cover portion 114, a recess for searching 170 is preferably provided on the free end edge side opposite to the spine portion 116, i.e. the left side end edge of the front cover portion 112 and the right side end edge of the back cover portion 114, in the approximate middle of the direction of the height thereof.

The outer end edge of the recess for searching 170 and the outer end edge 132 of the pocket sheet 118 are preferably substantially aligned. Accordingly, with one hand, folding the file 110 with the cover closed, especially gripping the curved subsidiary portion 128 and placing the other hand to the recess for searching 170 enables flipping of the front cover portion 112 or the back cover portion 114 and the pocket sheet 118.

The file 110 can be flipped from the pocket sheet 118 positioned on the upper side to the pocket sheet positioned on the lower side with the user's fingers placed the outermost portion of the outer end edge 132 of the pocket sheet 118 and slightly bend the front cover portion 112 or the back cover portion 114 in the recess for searching 170 as shown in FIG. 20.

On the front cover portion 112 and the back cover portion 114, a pair of projection portions 172 are provided on the upper side and the lower side, respectively, to cover the index i provided on the pocket sheet 118 such that the projection portion 172 is projected toward the outer side from the end edge for spreading, i.e. the outer end edge 132, of the pocket sheet 118 on the outside of the region in which the recess portion for searching 170 is provided.

The end edge of the group of pocket sheets 130 connected to the spine portion 116 when the cover body is opened is curved away from the spine portion 116.

The pocket sheet 118 includes pockets combined with thermoplastic resin sheets, each pocket sheet 118 is hot-adhered to another pocket sheet 118 on the end edge connected to the cover thereof, and the end edge connected to the spine portion 116 is configured so as to curve inwardly when the pocket sheet 118 is opened.

The hinge portion on the front cover side 160 is preferably arranged inwardly from the front folding portion 124 and the hinge portion on the back cover side 162 is preferably arranged inwardly from the back adjacently providing portion 122 such that the width (T2) between the hinge portion on the front cover side 160 and the hinge portion on the back cover side 162 is preferably less than the width (T1) between the front adjacently providing portion 120 and the back adjacently providing portion 122 when the cover body is opened, i.e. when the connecting portion on the front cover side 152 and the connecting portion on the back cover side 154 are apposed at the horizontal plane in a flat state and the front cover portion 112 and the back cover portion 114 are adjacent to one another in the horizontal plane in the flat state.

Additionally, although the width (T1) between the front adjacently providing portion 120 and the back adjacently providing portion 122 and the width (T3) between the hinge portion on the front cover side 160 and the hinge portion on the back cover side 162 are substantially equal, (T3) is less than T1 by the thickness of the front adjacently providing portion 120 and the back adjacently providing portion 122 than (T1) since the hinge portion on the front cover side 160 and the hinge portion on the back cover side 162 is fastened to the inner surface of the front adjacently providing portion 120 and the back adjacently providing portion 122 when the cover body is closed, i.e. when the front cover portion 112 and the back cover portion 114 are parallel or substantially parallel and the connecting portion on the front cover side 152 and the connecting portion on the back cover portion 154 are parallel or substantially parallel.

Next, a method of manufacturing the file 110 shown in FIG. 21 according to a preferred embodiment of the present invention will be described below with referring to FIGS. 27 through 32.

First, a plurality of pocket sheets 118 is superimposed, and the edge faces of the inner end edge 138 that face one another are heated. Consequently, the region which is slightly inward from the inner end edge 138 is melted to fasten the plurality of pocket sheets 118 together. To apply hot welding to the inner end edge 138 of the pocket sheets 118, a hot plate is pressed to the inner end edge 138, the vicinity of the inner end edge 138 is welded and the edge surfaces of the inner end edge 138 facing one another are adhered to form the group of pocket sheets 130. Adhesion and welding can be performed using a hot-melt adhesive agent or by ultrasonic horn.

The group of pocket sheets 130 preferably includes pockets combined with thermoplastic resin sheets, each binding sheet is hot adhered to another on the end edge connected to the cover thereof, and the end edge connected to the cover is configured to curve inwardly when the pocket sheet 118 is opened.

Next, a method for fixing the group of pocket sheets 130 to the curved retaining portion 150 of the cover body will be described with referring to FIGS. 29 through 34.

First, a synthetic resin sheet body, such as polypropylene or other suitable material is prepared, Thompson processing is applied thereto and the cover material 180 is removed, which will define the cover of the file and will form a cover material 180 including the combination of the front cover portion 112, the back cover portion 114, and the curved retaining portion 150.

For forming the curved retaining portion 150 with the cover material 180 preferably made of a thermoplastic synthetic resin sheet body, such as polypropylene or other suitable material, for example, in a square planar shape, the curved retaining portion 150 is formed by demarcating the interjacent connecting portion 156 interposed between the connecting portion on the front cover side 152 connected to the front cover portion 112 and the connecting portion on the back cover side 154 connected to the back cover portion 114 from the cover material 180.

The interjacent connecting portion 156 is connected to the end edge connected to the cover of the binding body and is configured to curve away from the spine portion 116 along with the end edge connected to the cover of the group of the pocket sheets 130 by the tension of the connecting portion on the front cover portion 152 and the connecting portion on the back cover portion 154 when the cover is opened.

The curved retaining portion 150 is preferably made of a thermoplastic synthetic resin sheet body, such as polypropylene or other suitable material, for example, in a square planar shape and includes the through hole 158 in the region connected to the group of pocket sheets 130 and is configured so as to curve. The group of pocket sheets 130 is adhered to the inner surface of the bridge portions 156*a*, 156*b*, 156*c*1, 156*c*2, 156*c*3, 156*c*4 and 156*c*5 of the curved retaining portion 150 and to the inner surface of the longitudinal bridge portion 156*e* and 156*f* with a space between the hinge portion on the front cover side 160 and the hinge portion on the back cover side 162.

Hot welding is applied to the group of pocket sheets 130 along the upper surface of the interjacent connecting portion 156.

The curved retaining portion 150 is defined by the hinge portion on the front cover side 160 and the hinge portion on the back cover side 162 between the connecting portion on the front cover side 152 and the interjacent connecting portion 156 and between the connecting portion on the back cover side 154 and the interjacent connecting portion 156.

The distance between the spine portion 116 and the front folding portion 124 of the front cover portion 112 and the back folding portion 126 of the back cover portion 114, respectively, is preferably substantially equal to or less than the distance between the hinge portion on the front cover side 160 of the curved retaining portion 150 and the inner surface of the front cover portion 112 or the hinge portion on the back cover side 162 and the inner surface of the back cover portion 114. The hinge portion on the front cover side 160 and the hinge portion on the back cover side 162 are arranged adjacent to the end edge of the spine portion 116 in crossing direction when the cover is closed.

The interjacent connecting portion 156 interposed between the hinge portion on the front cover side 160 and the hinge portion on the back cover side 162 is configured to curve away from the spine portion 116 and the width between the hinge portion on the front cover side 160 and the hinge portion on the back cover side 162 is preferably less than the width of the spine portion 116 when the front cover portion 112 is opened.

Next, a method for adhering the group of pocket sheets 130 to the cover material 180 will be described.

The curved retaining portion 150 is connected adjacent to the hinge portion on the front cover side 160 of the front cover portion 112 and the hinge portion on the back cover side 162 of the back cover portion 114 and spaced from the group of the pocket sheets 130 in the crossing direction such that the connecting body 150 enables the end edge connected to the cover of the group of pocket sheet 130 to curve with the width less than the width of the spine portion 116 of the cover body.

The connecting body 150 is welded to the connecting portion on the front cover side 152 connected to the side of the front cover portion 112 and the outer surface of the front cover portion 112 and to the connecting portion on the back cover side 154 on the side of the back cover portion 114 and the outer surface of the back cover portion 114 and extends between the front cover portion 112 and the back cover portion 114.

In accordance with a preferred embodiment of the present invention, the curved retaining portion 150 includes the connecting portion on the front cover side 152 connected to the side of the front cover portion 112, the connecting portion on the back cover side 154 connected to the side of the back cover portion 114, and the interjacent connecting portion 156 interposed between the connecting portion on the front cover side 152 and the connecting portion on the back cover portion 154. The interjacent connecting portion 156 is connected to the end edge connected to the cover of the binding body and is configured to curve away from the spine portion 116 along with the end edge connected to the cover of the binding body by the tension of the connecting portion on the front cover portion 152 and the connecting portion on the back cover portion 154 when the cover body is opened.

In the curved retaining portion 150, the hinge portion on the front cover side 160, and the hinge portion on the back cover side 162 are arranged between the connecting portion on the front cover side 152 and the interjacent connecting portion 156 and between the connection portion on the back cover side 154 and the interjacent connecting portion 156.

Next, in order to form the curved subsidiary portion 128, a thermoplastic synthetic resin sheet is prepared, Thompson processing is applied thereto, and the curved subsidiary portion 128 is punched out in a square planar shape.

Further, a spine index paper Z is pasted to the surface of the spine area, which will become the spine portion 116, using an adhesive agent (Spine index paper pasting step).

Figure 26:
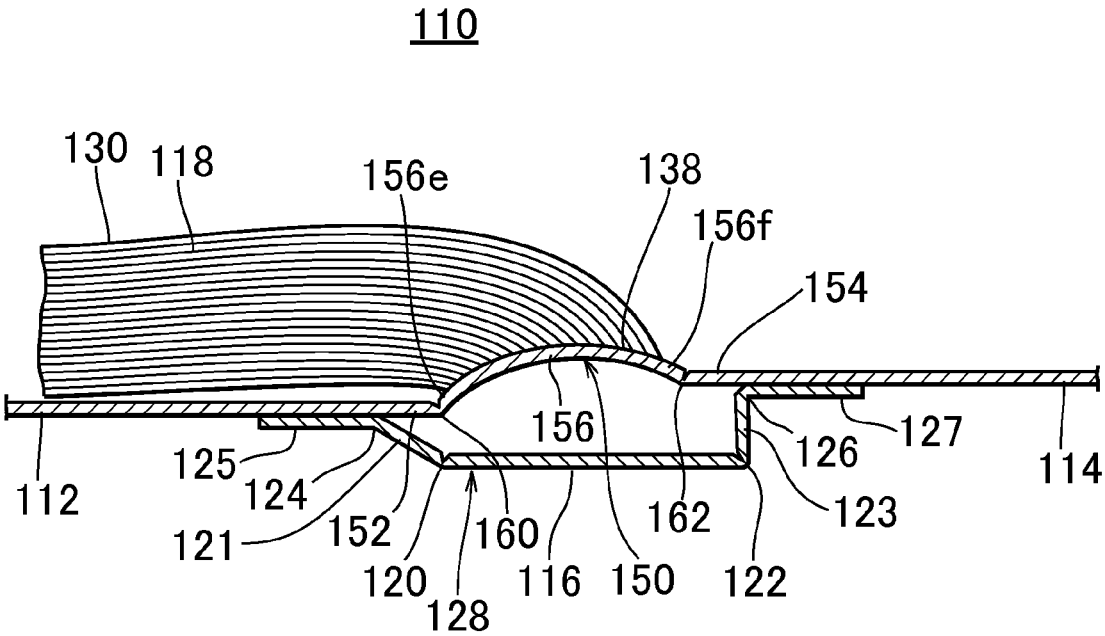
FIG. 26 is a schematic transverse sectional view of the pocket file of FIG. 21 in an opened state.
Figure 27:
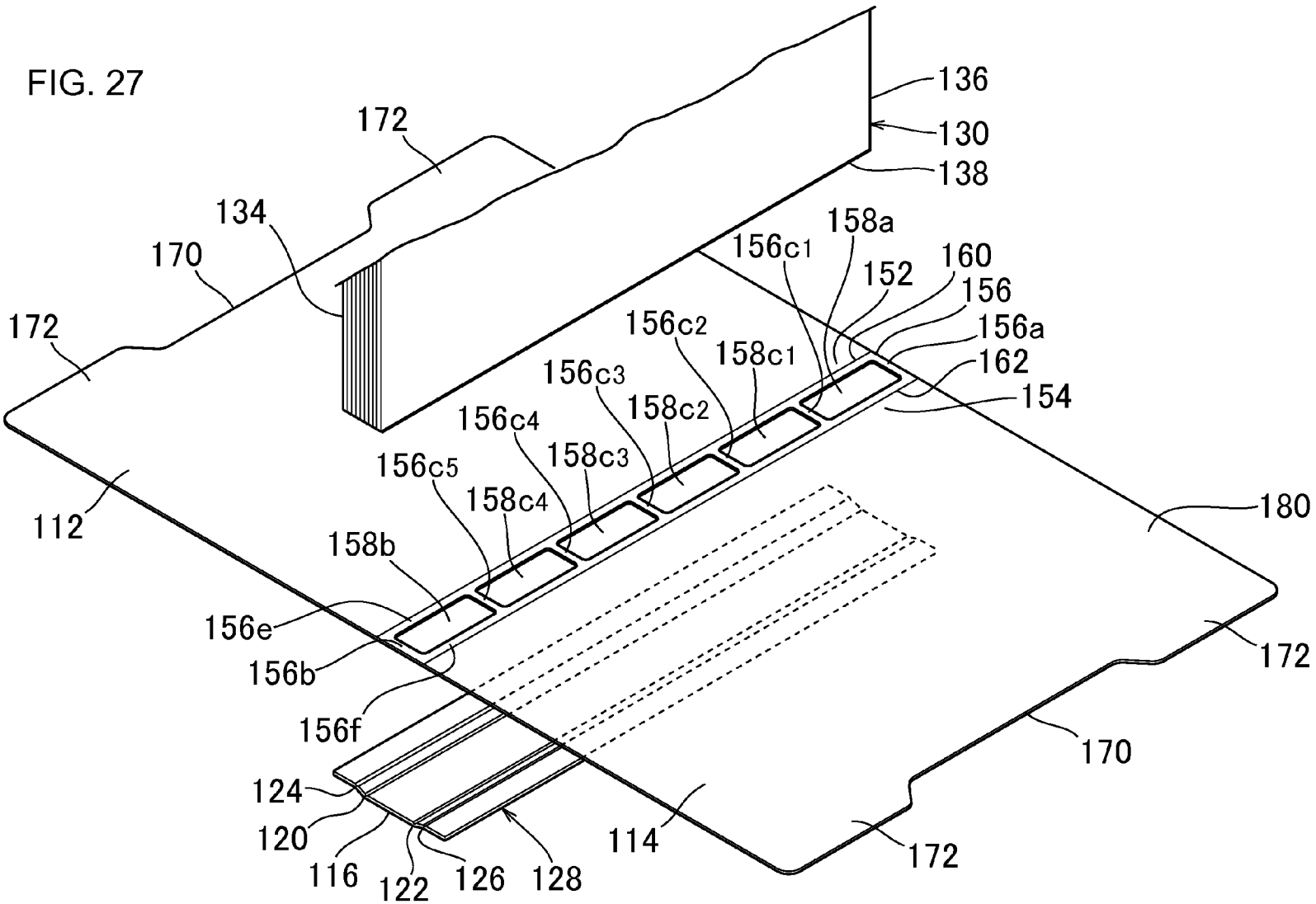
FIG. 27 is a schematic perspective view of the method of manufacturing the file of FIG. 21.
Figure 28:
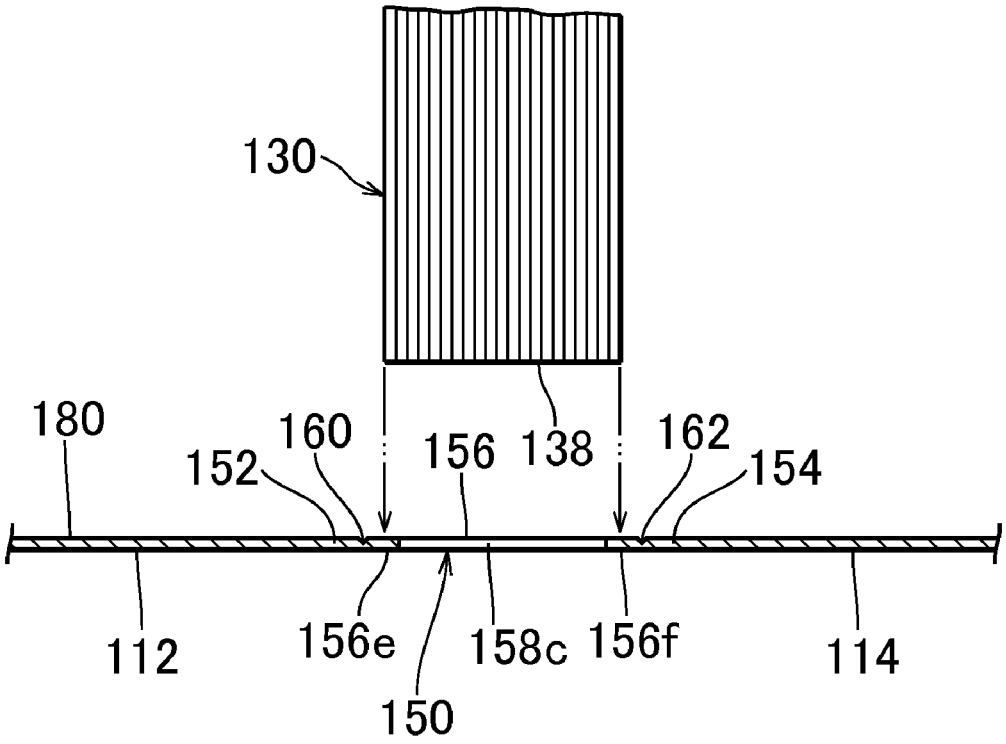
FIG. 28 is a schematic cross-sectional view of the method of manufacturing the file of FIG. 21 including a method of connecting the group of pocket sheets and a curved retaining portion.
Figure 29:
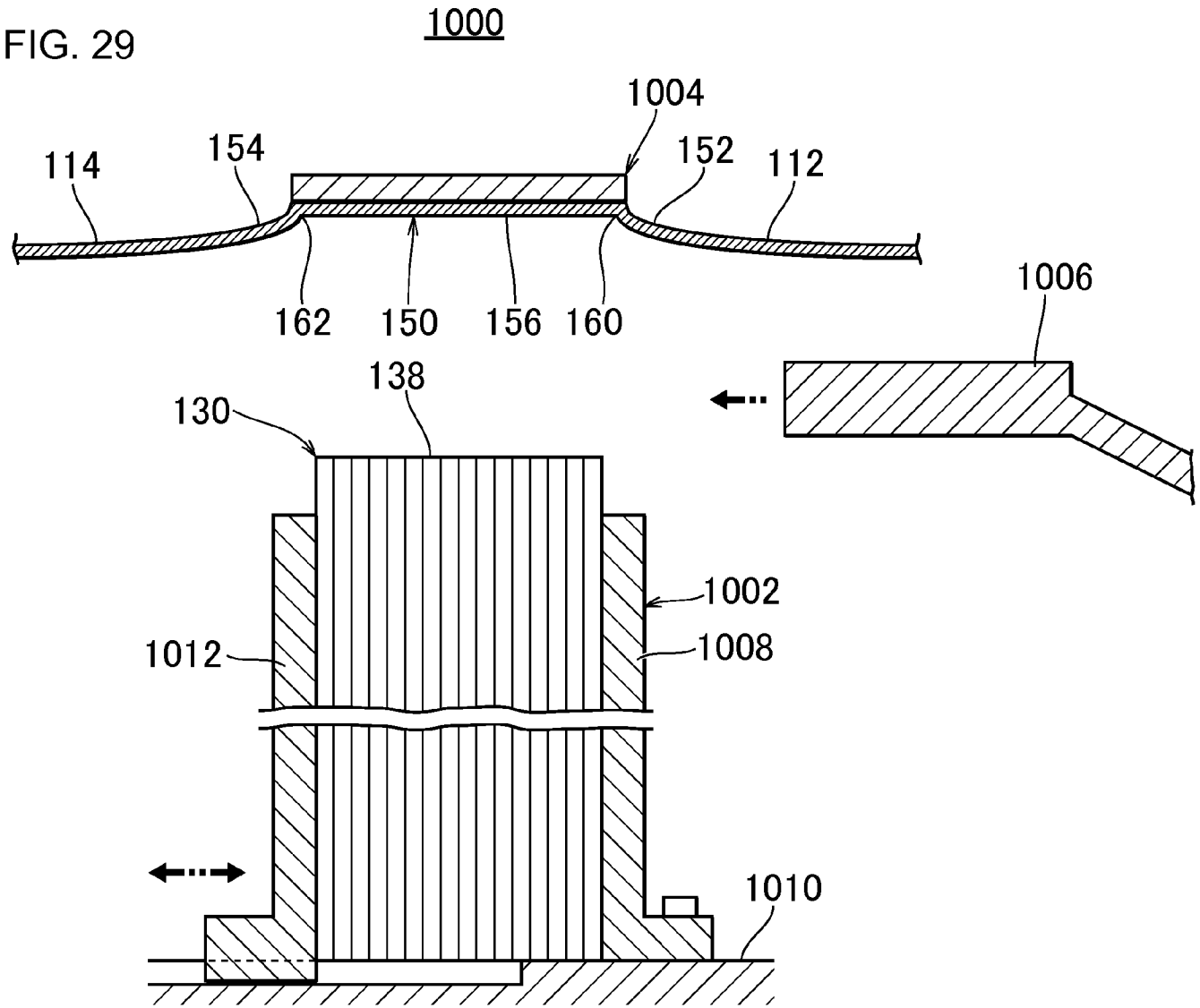
FIG. 29 is a schematic cross-sectional view of the method of manufacturing the file of FIG. 21 including the method of connecting the group of pocket sheets and the curved retaining portion.
Figure 30:
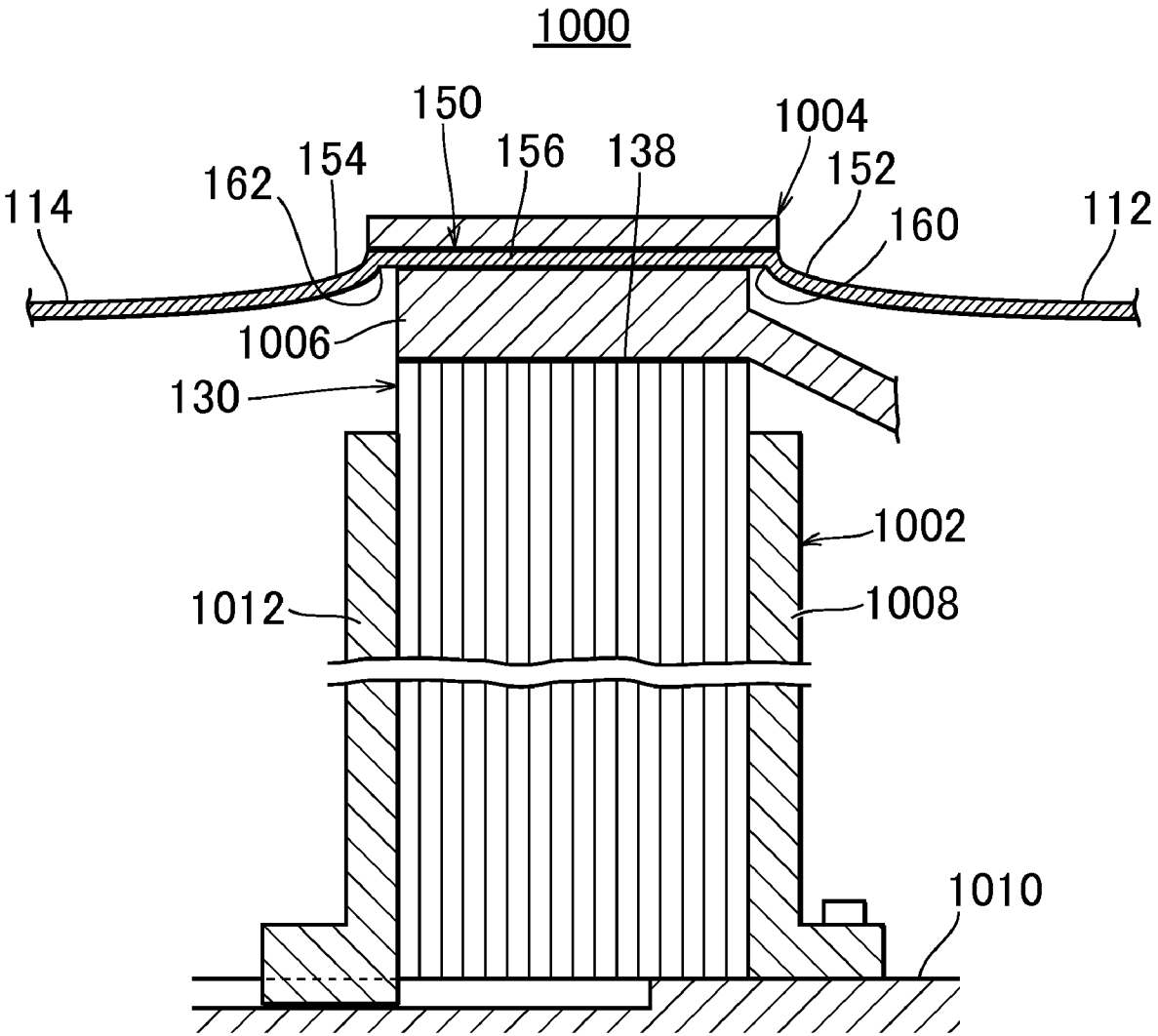
FIG. 30 is a schematic cross-sectional view of the method of manufacturing the file of FIG. 21 including the method of connecting the group of pocket sheets and the curved retaining portion.
Figure 31:
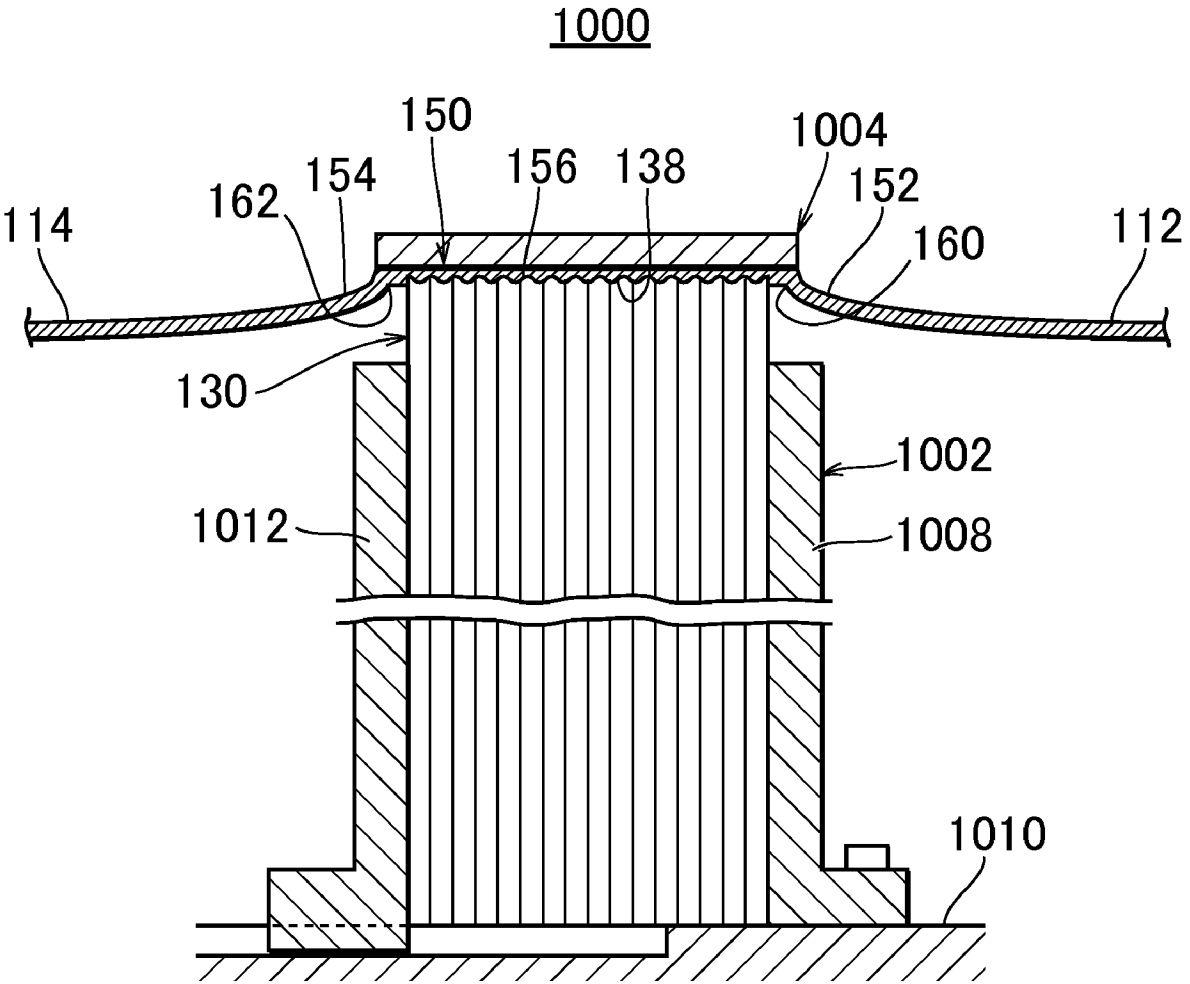
FIG. 31 is a schematic cross-sectional view of the method of manufacturing the file of FIG. 21 including the method of connecting the group of pocket sheets and the curved retaining portion.
Figure 32:
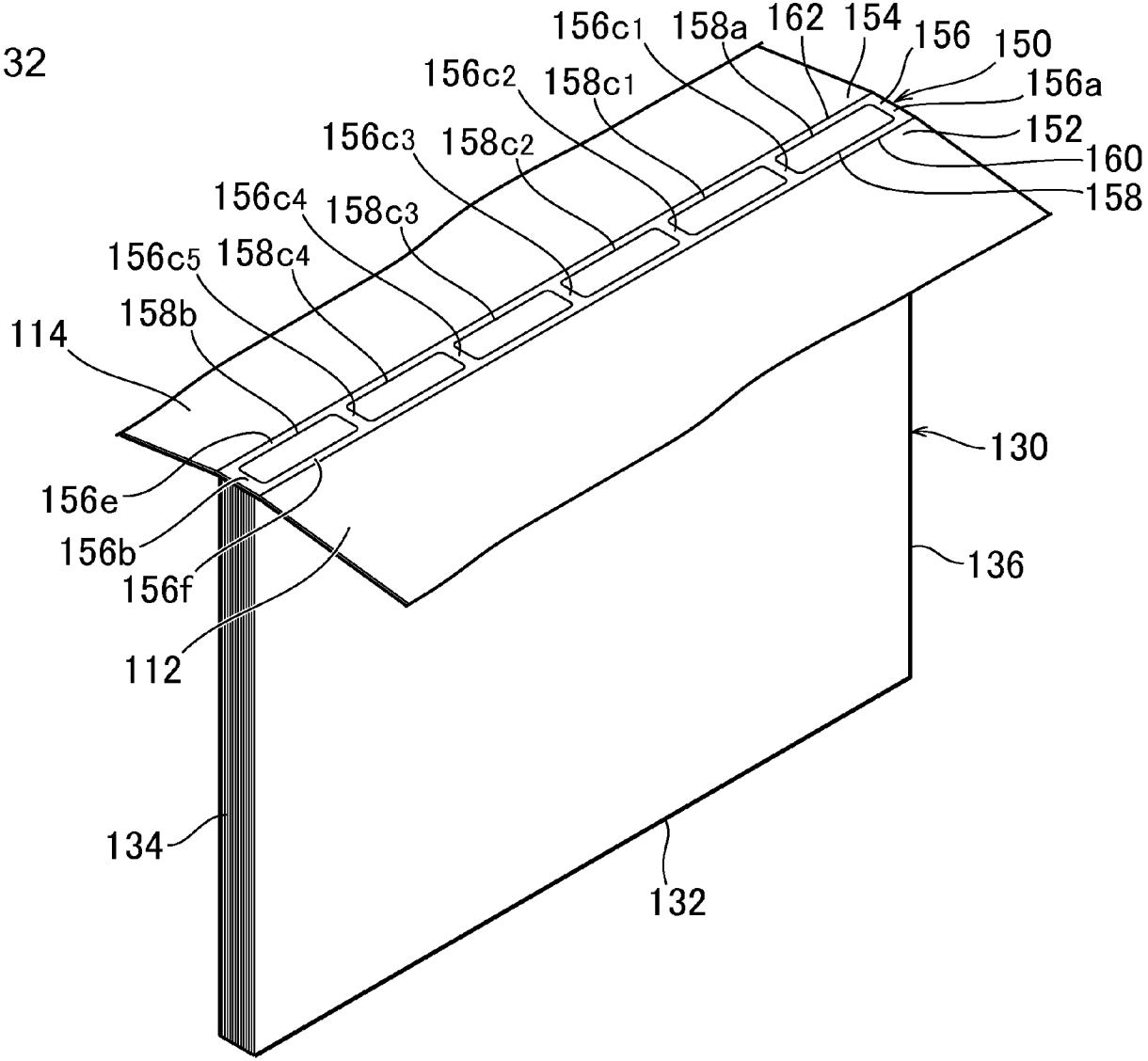
FIG. 32 is a schematic cross-sectional view of the method of manufacturing the file of FIG. 21 including the method of connecting the group of pocket sheets and the curved retaining portion.
Figure 33:
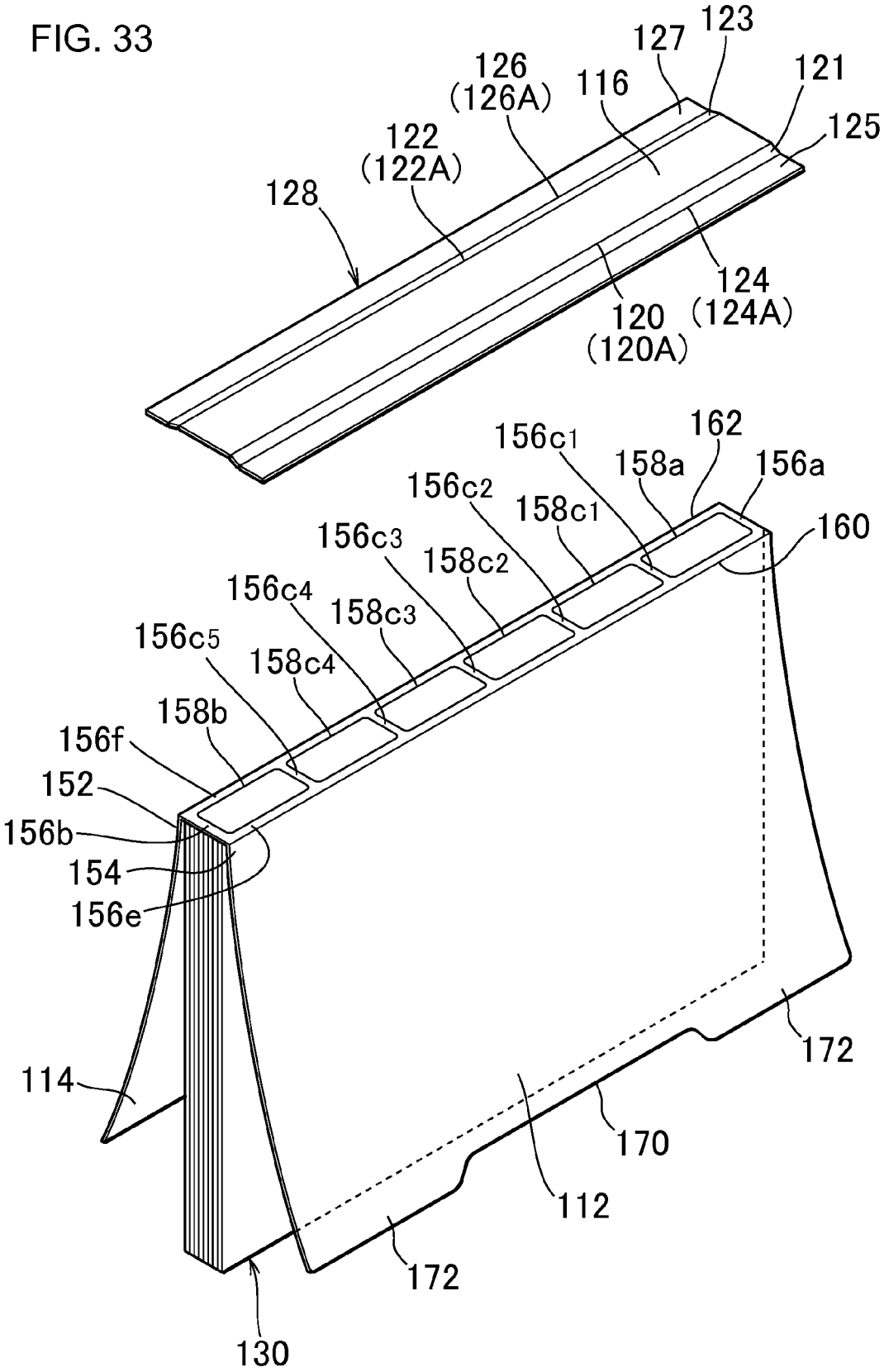
FIG. 33 is a schematic transverse sectional view of a fastening method of the cover and a curved subsidiary portion according to a preferred embodiment of the present invention.
Figure 34:
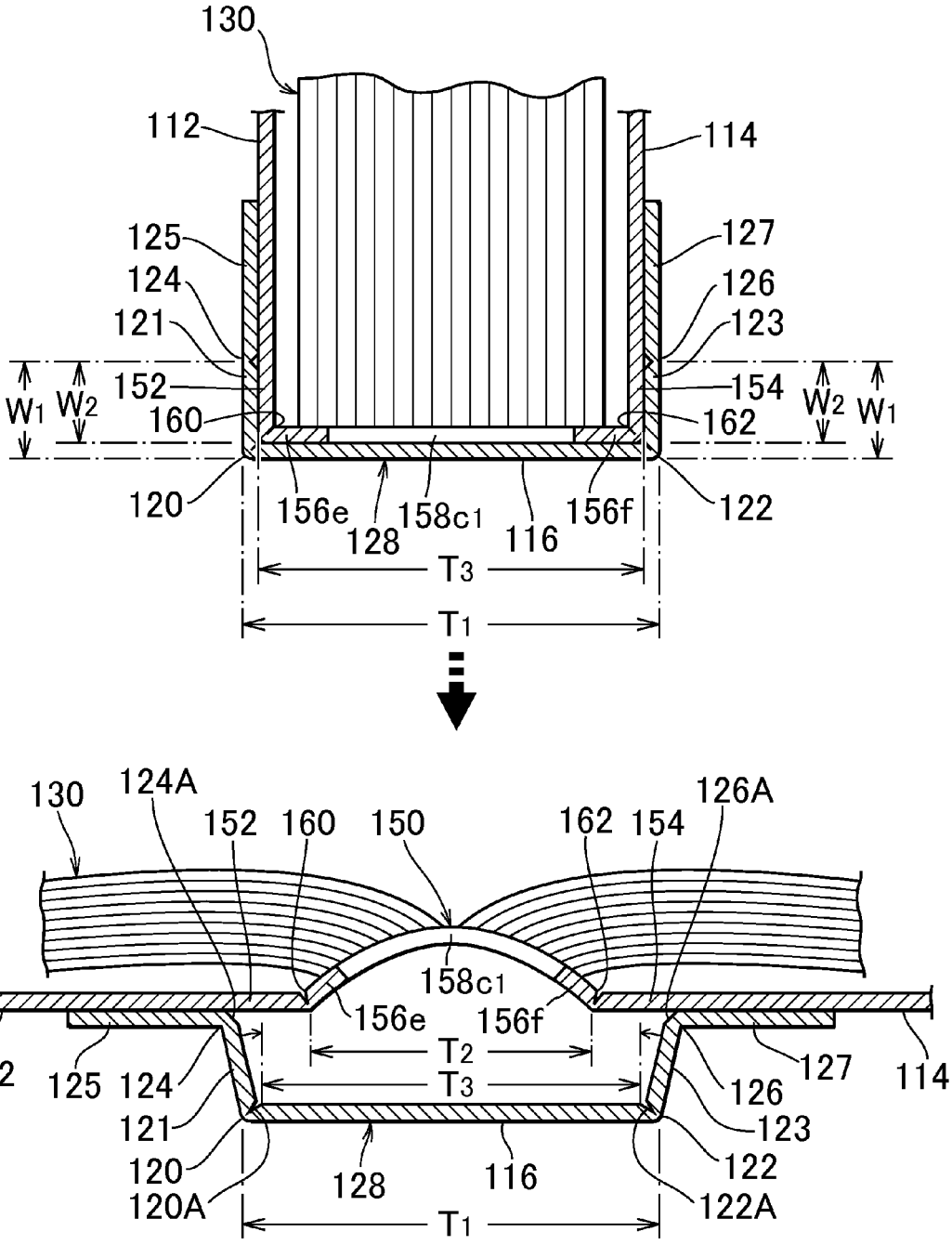
FIG. 34 is a schematic transverse sectional view of an operation of the file of FIG. 21.

For example, as shown in FIGS. 26 and 27, when a thermoplastic resin sheet is used for the curved retaining portion 128, the heat-press molding is applied with the V-shape heater (not shown) to form V-shape slots 120A, 122A, 124A and 126A which have a substantially V-shaped section and which are parallel or substantially parallel to one another to define the front adjacently providing portion 120, the back adjacently providing portion 122, the front folding portion 124, and the back folding portion 126. Then, the cover material 180 is formed in order to enable the cover material 180 to fold (V-shape slot molding step).

Then, the cover body including the curved subsidiary portion 128 is formed by fastening the outer end edge of the front adjacently providing portion 120 to the outer surface of the front cover portion 112 and a portion outward from the hinge portion on the front cover side 160 and also fastening the back adjacently providing portion 122 to the outer surface of the back cover portion 114 and a portion outward from the hinge portion on the back cover side 162.

The distance (W1) between the spine portion 116 and the front folding portion 124 of the front cover portion 112 and the back folding portion 126 of the back cover portion 114 respectively is substantially equal to the distance (W2) between the hinge portion on the front cover side 160 of the curved retaining portion 150 and the inner surface of the front cover portion 112 or the hinge portion on the back cover side 162 and the inner surface of the back cover portion 114 and (W2) is less that (W1) by the thickness of the spine portion 116.

The hinge portion in the front cover side 160 and the hinge portion on the back cover side 162 are positioned adjacent to the end edge of the spine portion 116 when the cover body is closed. The hinge portion on the front cover side 160 and the hinge portion on the back cover side 162 are configured to curve away from the spine portion 116 when the cover body is opened and the width between the hinge portion on the front cover side 160 and the hinge portion on the back cover side 162 is less than the width of the spine portion 116. Accordingly, when the cover body is opened and the group of pocket sheets 130 are spread, the pocket sheet 118 is substantially flat.

Figure 35:
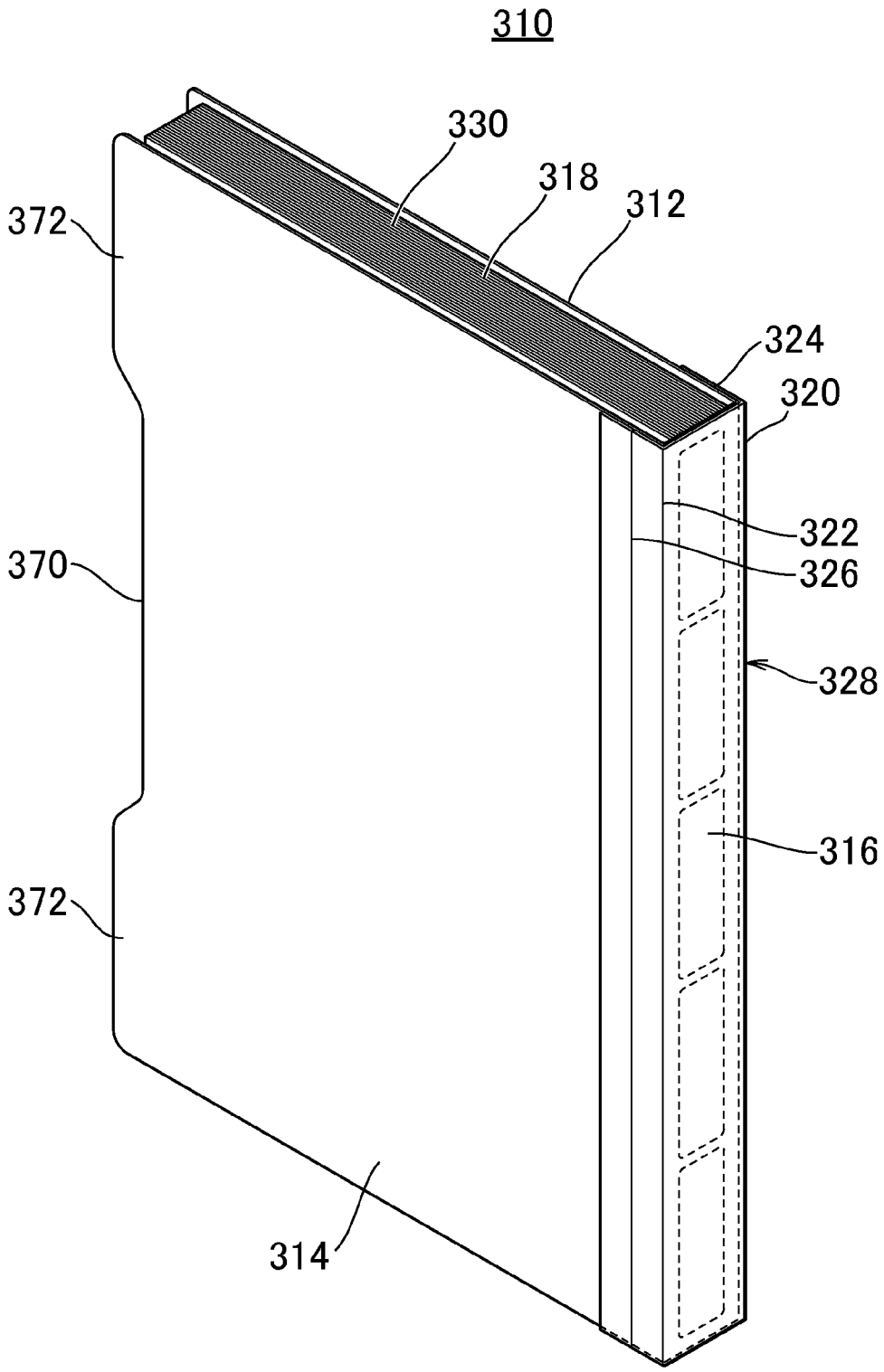
FIG. 35 is a schematic perspective view of the pocket file according to another preferred embodiment of the present invention.
Figure 36:
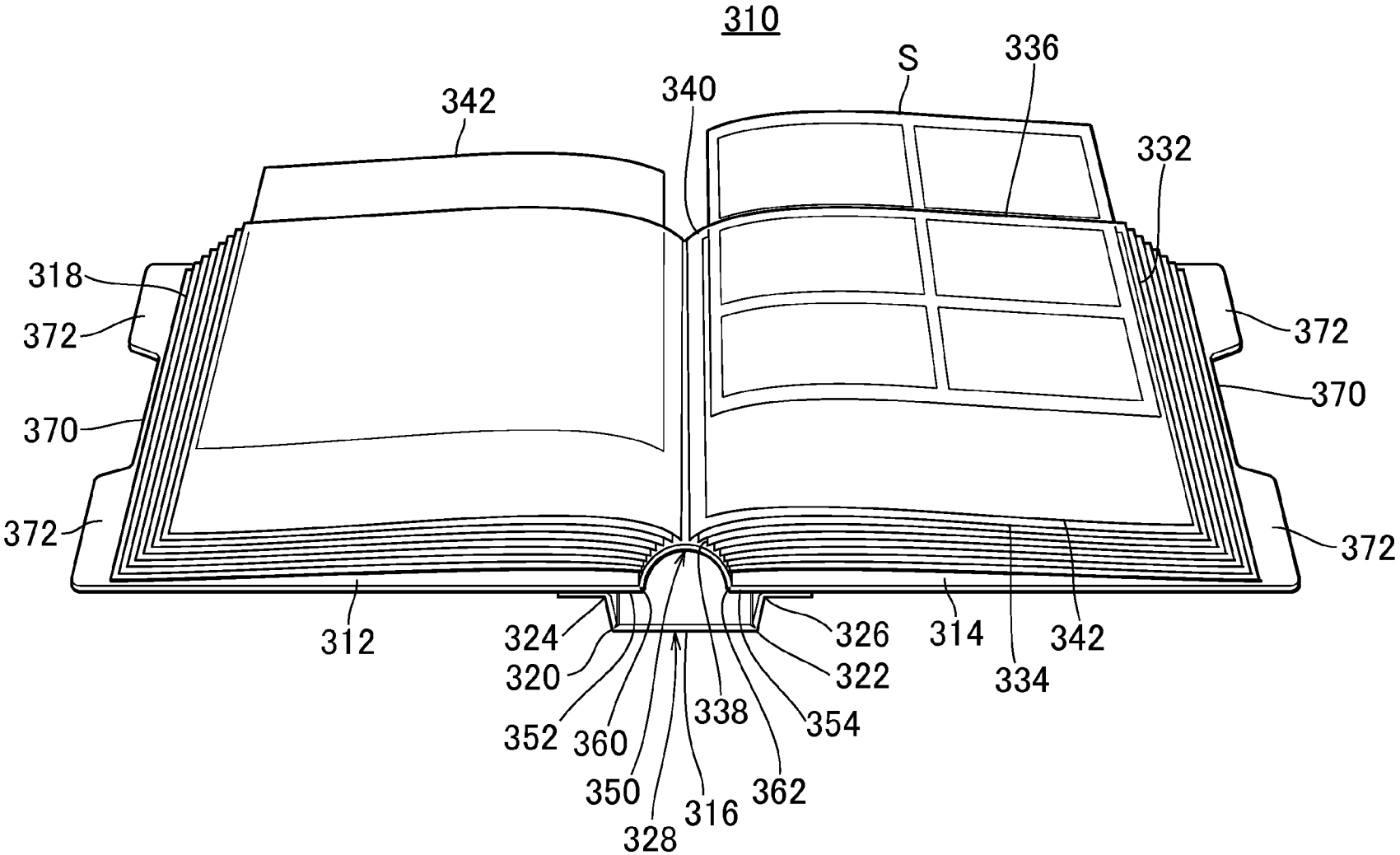
FIG. 36 is a schematic perspective view of the pocket file of FIG. 35 in an opened state.
Figure 37:
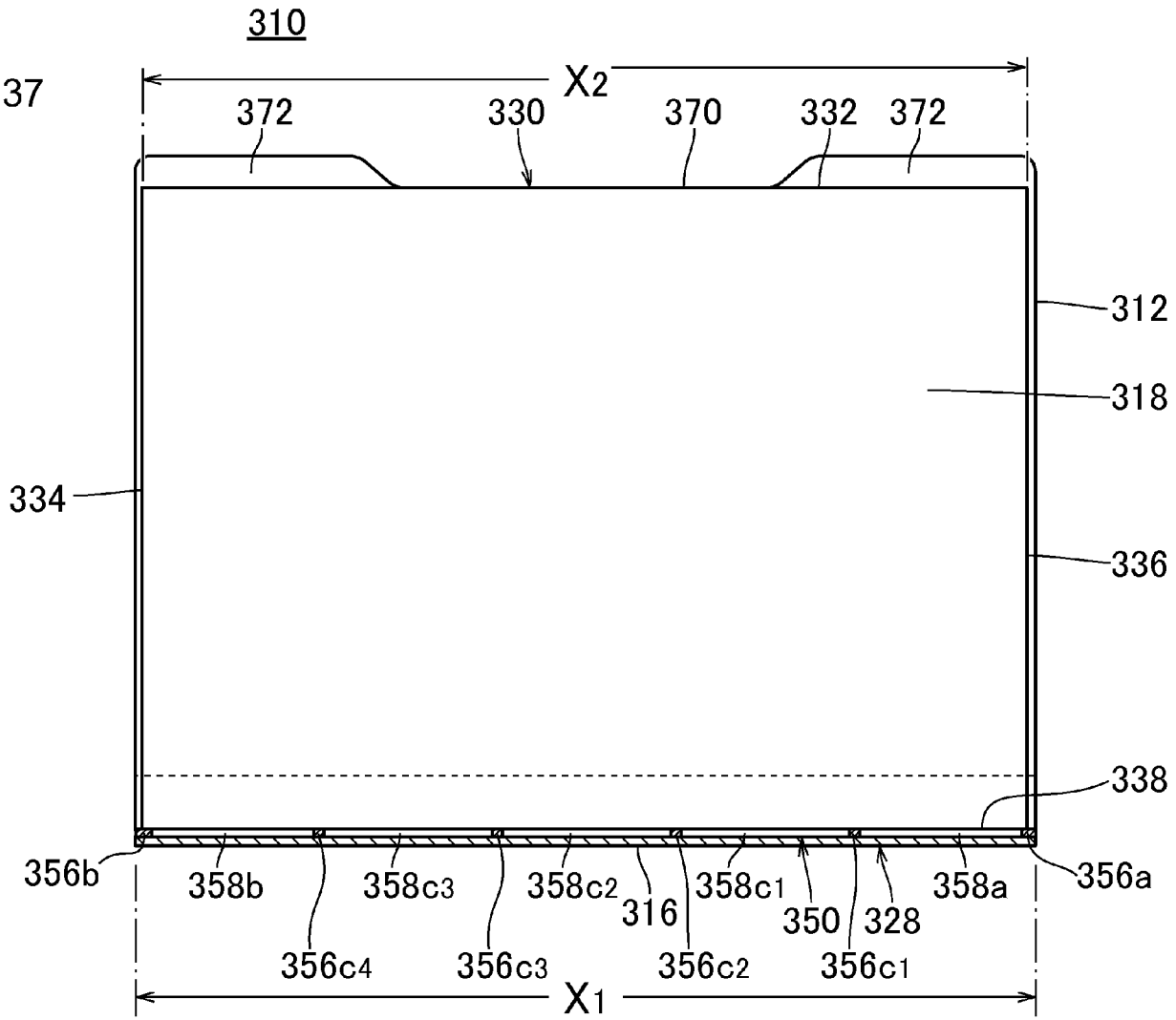
FIG. 37 is a schematic transverse sectional view of the pocket file of FIG. 35 in a closed state.

FIG. 35 is a perspective view of a pocket file in accordance with another preferred embodiment of the present invention and FIG. 36 is a schematic perspective view of the pocket file in an open state as shown in FIG. 35. FIG. 37 is a schematic longitudinal section view of the pocket file in a close state as shown in FIG. 35.

A file 310 includes a cover body including a front cover portion 312 preferably made of synthetic-resin, such as polypropylene, for example, a back cover portion 314, and a spine portion 316 provided between the front cover portion 312 and the back cover portion 314. A group of pocket sheets 330 are superimposed with a pocket sheet 318 and is welded and connected to the a connecting end edge of the group of pocket sheets 330 by being fastened the group of pocket sheets 330 connected at a end edge which is connected to the spine portion 316.

The file 310 includes a curved subsidiary portion 328 which fixes the back of the cover body in a particular configuration in regions on a front cover side and on a back cover side of the spine portion 316 between the front cover portion 312 and the back cover portion 314 and the curved retaining portion 352 configured to curve the end edge of the group of pocket sheets 330 towards the pocket sheet 318 extending at the inner side of the spine portion 316 adjacently provided between the front cover portion 312 and the back cover portion 314 when the cover is opened.

The front cover portion 312 and the back cover portion 314 are arranged adjacent to the spine portion 316 so as to cross at a substantial right angle via a linear front folding portion 324 and a linear back folding portion 326 and a linear front adjacently providing portion 320 and a linear back adjacently providing portion 322 extending from the top edge to the bottom edge in the direction of the height of the front cover portion 312 and the back cover portion 314.

The pocket sheets 318 are flexibly provided between a portion at which the pocket sheets 318 are fastened to the inner side of the spine portion 316 between the front cover portion 312 and the back cover portion 314 and a portion at least above the front folding portion 324 and the back folding portion 326 (when the cover body is closed).

The pocket sheet 318 includes a linear outer end edge 332, a linear bottom edge 334, and an opening edge 336 provided at a top end edge which is opposite to the bottom edge 334 and is connected to the inner surface of the spine portion 316 at the inner end edge 338 opposite to the linear outer end edge 332.

The pocket sheet 318 includes a pocket portion 340 arranged to accommodate an object to be bound S, such as documents, and is configured for a mount 342 extending in a direction away from a portion at which the spine portion 316 is fastened to be inserted from a portion above the front folding portion 324 and the back folding portion 326 (when the cover body is closed) in the inner side of the pocket portion 340.

The group of pocket sheets 330 is connected by the curved retaining portion 350 provided adjacent to the front cover portion 312 and the back cover portion 314 at the connecting end edge connected to the group of pocket sheets 330.

A curved retaining portion 350 is preferably a substantially square rigid plate body when viewed in a planar view and made of thermoplastic synthetic resin and includes the curved retaining portion 350 which curves the group of pocket sheets 330, which are welded and connected at the connecting end edge of the group of pocket sheets 330, toward the direction in which the pocket sheet 318 extend, i.e. the direction away from the spine portion 316, when the cover body is opened.

The curved retaining portion 350 is connected adjacent to the inner side of a hinge portion on the front cover side 360 and the inner side of a hinge portion on the back cover side 362 and spaced from the group of the pocket sheets 330 such that the curved retaining portion 350 enables the end edge of the group of pocket sheet 330 connected to the cover to curve with a width that is less than the width of the spine portion 316 of the cover body.

The curved retaining portion 350 preferably includes a connecting portion on the front cover side 352 provided adjacent to the side of the front cover portion 312, a connecting portion on the back cover side 354 provided adjacent to the side of the back cover portion 314 and an interjacent connecting portion 356 interposed between the connecting portion on the front cover side 352 and the connecting portion on the back cover portion 354. The interjacent connecting portion 356 is connected to the end edge of the group of pocket sheets 330 connected to the cover and is configured to curve away from the spine portion 316 along with the end edge of the group of the pocket sheets 330 connected to the cover by the tension of the connecting portion on the front cover side 352 and the connecting portion on the back cover side 354 when the cover is opened.

The curved retaining portion 350 is relatively flexible and is configured to arch away from the spine portion 316 by the weight of the pocket sheet 318 being in a spread state.

The front cover portion 312 and the connecting portion on the front cover side 352 are preferably defined by a unified flat plate, and the back cover portion 314 and the connecting portion on the back cover side 354 are also defined by a unified flat plate.

The curved retaining portion 350 is preferably made of a thermoplastic synthetic resin sheet body, such as polypropylene or other suitable material, for example, in a square planar shape and includes a through hole 358 in the region connected to the binding body and is configured so as to curve.

The curved retaining portion 350 includes a plurality of rectangular planar shaped through holes 358 which are spaced from one another so as to provide flexibility thereto. In this preferred embodiment, 6 through holes are preferably provided in the curved retaining portion 350, an upper through hole 358*a*, a lower through hole 358*b*, and middle through holes 358*c*1, 358*c*2, 358*c*3 and 358*c*4.

In this preferred embodiment, in the interjacent connecting portion 356, bridge portions 356*a* and 356*b* extend between the connecting portion on the front cover side 352 and the connecting portion on the back cover side 354 at the upper edge and the lower edge, respectively. Bridge portions 356*c*1, 356*c*2 and 356*c*3 extend between the middle through holes 358*c*1 and 358*c*3 and a bridge portion 356*c*4 extend between the middle through hole 358*c*3 and the lower through hole 358*b*. Therefore, the adhesion region of the group of pocket sheets 330 and the interjacent connecting portion 356 is provided.

Further, preferably a longitudinal bridge portion 356*e* is provided between a hinge portion on the front cover side 360 and the upper through hole 358*a*, the lower through hole 358*b* and the middle through holes 358*c*1, 358*c*2 and 358*c*3, and a longitudinal bridge portion 356*f* is provided between a hinge portion on the back cover side 362 and the upper through hole 358*a*, the lower through hole 358*b* and the middle through holes 358*c*1, 358*c*2 and 358*c*3.

The longitudinal bridge portion 356*e* and the longitudinal bridge portion 356*f* are arranged to cross from the top edge to the bottom edge of the cover body.

On the curved retaining portion 350, the hinge portion on the front cover side 360 provided between the connecting portion on the front cover side 352 and the interjacent connecting portion 356 and the hinge portion on the back cover side 362 provided between the connecting portion on the back cover side 354 and the interjacent connecting portion 356 are parallel or substantially parallel to each other.

The distance between the spine portion 316 and the front folding portion 324 of the front cover portion 312 and the back folding portion 326 of the back cover portion 314, respectively, is set to be substantially equal to or less than the distance between the hinge portion on the front cover side 360 of the curved retaining portion 350 and the inner surface of the front cover portion 312 and the hinge portion on the back cover side 362 and the inner surface of the back cover portion 314. The hinge portion in the front cover side 360 and the hinge portion on the back cover side 362 are arranged to be positioned adjacent to the end edge of the spine portion 316 when the cover body is closed.

The interjacent connecting portion 356 between the hinge portion on the front cover side 360 and the hinge portion on the back cover side 362 is configured to curve away from the spine portion 316 when the front cover portion 312 is opened and the width between the hinge portion on the front cover side 360 and the hinge portion on the back cover side 362 is preferably less than the width of the spine portion 316.

Figure 47A:
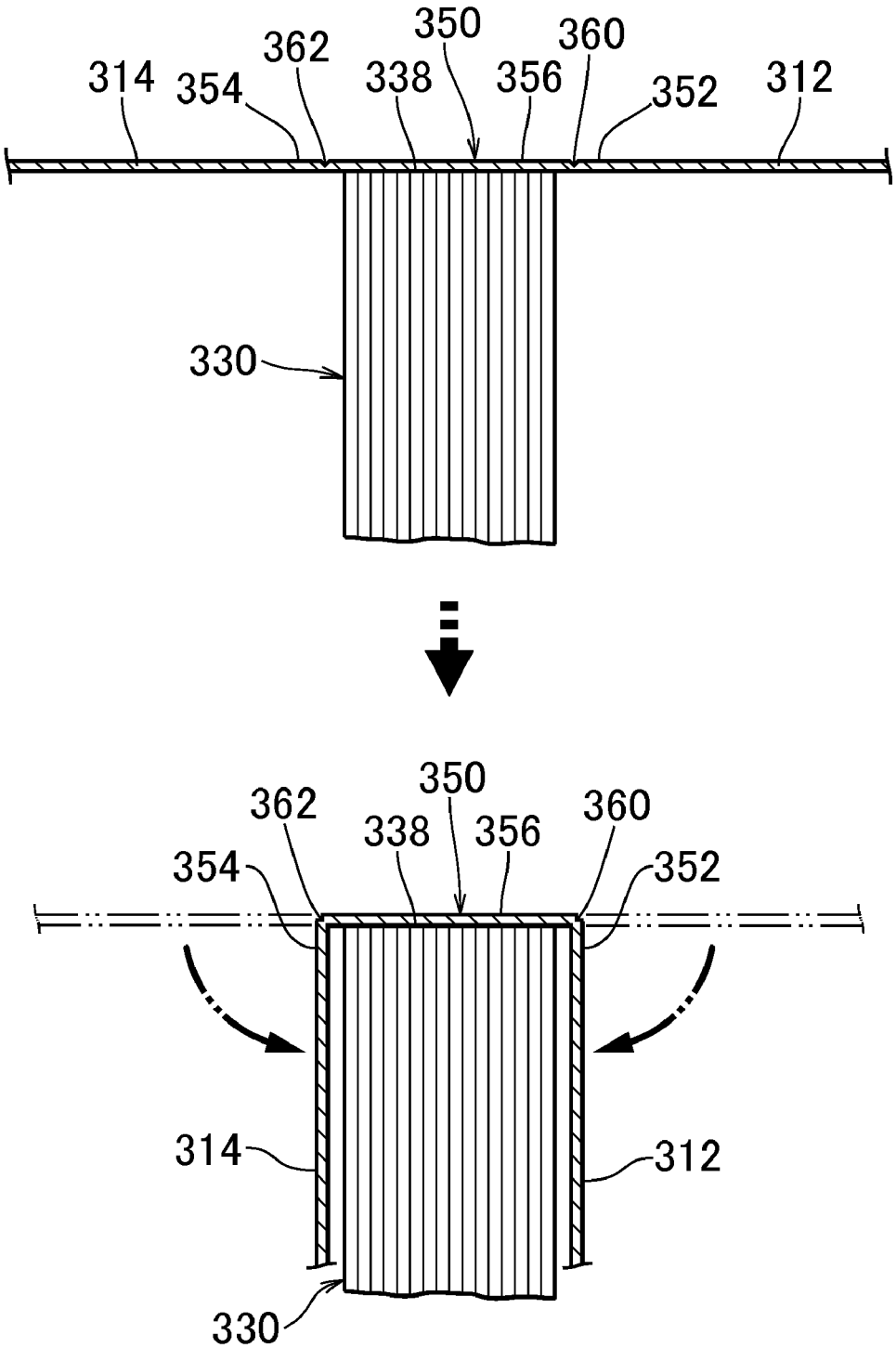
FIG. 47A is a schematic transverse sectional view of a formation of the curved retaining portion.
Figure 47B:
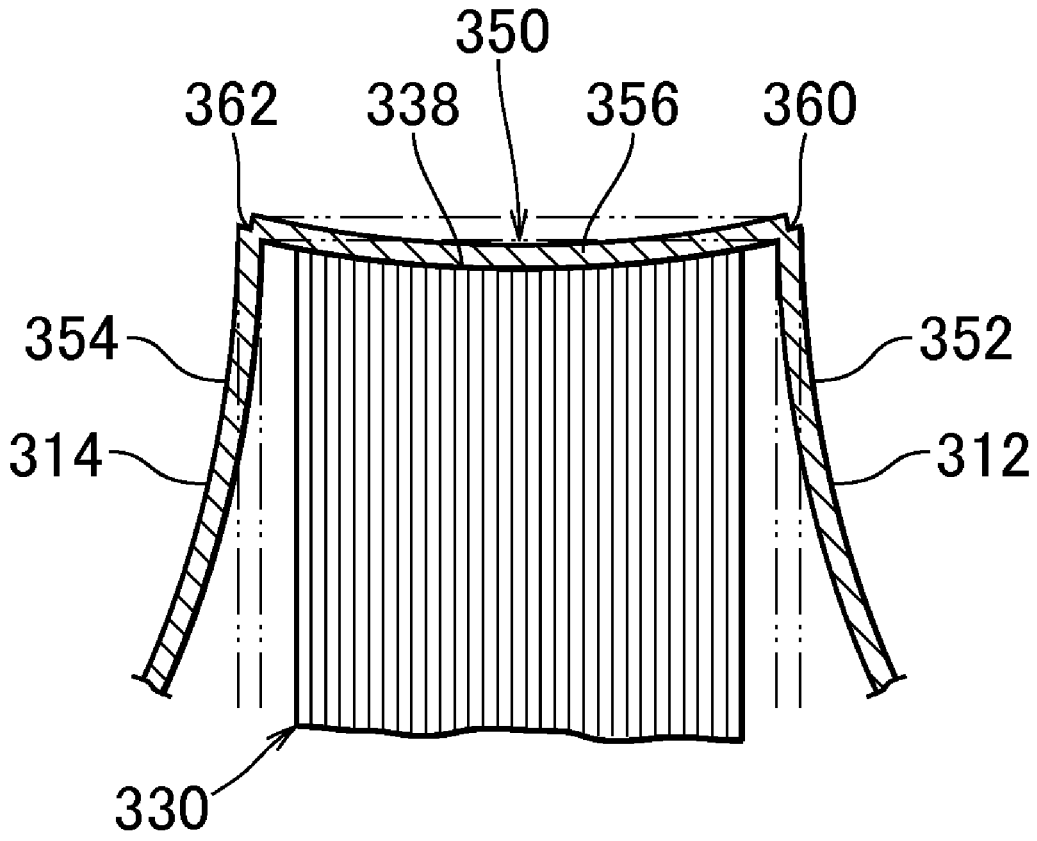
FIG. 47B is a schematic transverse sectional view of an operation of the curved retaining portion.

The longitudinal bridge portion 356*e* and the connecting portion on the front cover side 352 providing the hinge portion on the front cover side 360 therebetween intersect at substantial right angles in order to retain the shape when a load is not applied and the longitudinal bridge portion 356*f* and the connecting portion on the back cover side 354 providing the hinge portion on the back cover side 362 therebetween intersect at substantially right angles in order to retain the shape when a load is not applied. When the connecting portion on the front cover side 352 side or the connecting portion on the back cover side 354 side opens corresponding to when the front cover portion 312 or the back cover portion 314 is opened, a degree of the angle between the longitudinal bridge portion 356*e* and the connecting portion on the front cover side 352 expands, and the angle between the longitudinal bridge portion 356*f* and the connecting portion on the back cover side 354 expands. When the expansion of those angles is about 120 to 130 degrees, and the curved retaining portion 350 is lifted in the direction away from the spine portion 316 due to the elasticity of the material of the curved retaining portion 350 and the elasticity adjacent to the both ends of the hinge portion on the front cover side 360 and the hinge portion on the back cover side 362 of the both sides (see FIG. 47B).

The front cover portion 312 and the back cover portion 314, as shown in FIGS. 36 through 40, define a curved subsidiary portion which fixes the back of the binding body in a desired configuration in a region on a front cover side and a region on a back cover side of the spine portion 316 between the front cover portion 312 and the back cover portion 314. In this preferred embodiment, the curved subsidiary portion is preferably an independent curved subsidiary member 328.

The curved subsidiary member 328 is preferably made of a thermoplastic synthetic resin sheet body, such as polypropylene or other suitable material, for example, in a square planar shape. The front folding portion 324 and the back folding portion 326 extending from the upper edge to the lower edge are successively provided and the curved subsidiary portion 328 is provided in the region from the front folding portion 324 on the front cover portion 312 to the spine portion 316, the region from the back folding portion 326 on the back cover portion 314 to the spine portion 316, and the spine portion 316.

In the curved subsidiary member 328, the connecting portion on the front cover side 352 including the front folding portion 324 as an axis moves upwardly in the region on the spine portion 316 on the front cover side extending between the front cover portion 312 and the back cover portion 314, and the connecting portion on the back cover side 354 including the back folding portion 326 as an axis moves upwardly, and the curved subsidiary portion 328 defines the curved subsidiary portion which enables the curved retaining portion 350 to arch upwardly, i.e. in the direction away from the spine portion 316, when the front cover portion 312 and the back cover portion 314 are substantially horizontal and parallel to the curved subsidiary member 328 of the horizontal spine portion 316.

On the front cover portion 312 and the back cover portion 314, the front folding portion 324 and the back folding portion 326 are parallel or substantially parallel to the front adjacently providing portion 320 and the back adjacently providing portion 322 in the direction of their heights crossing from the top edge to the bottom edge thereof adjacent to the front adjacently providing portion 320 and the back adjacently providing portion 322.

Figure 38:
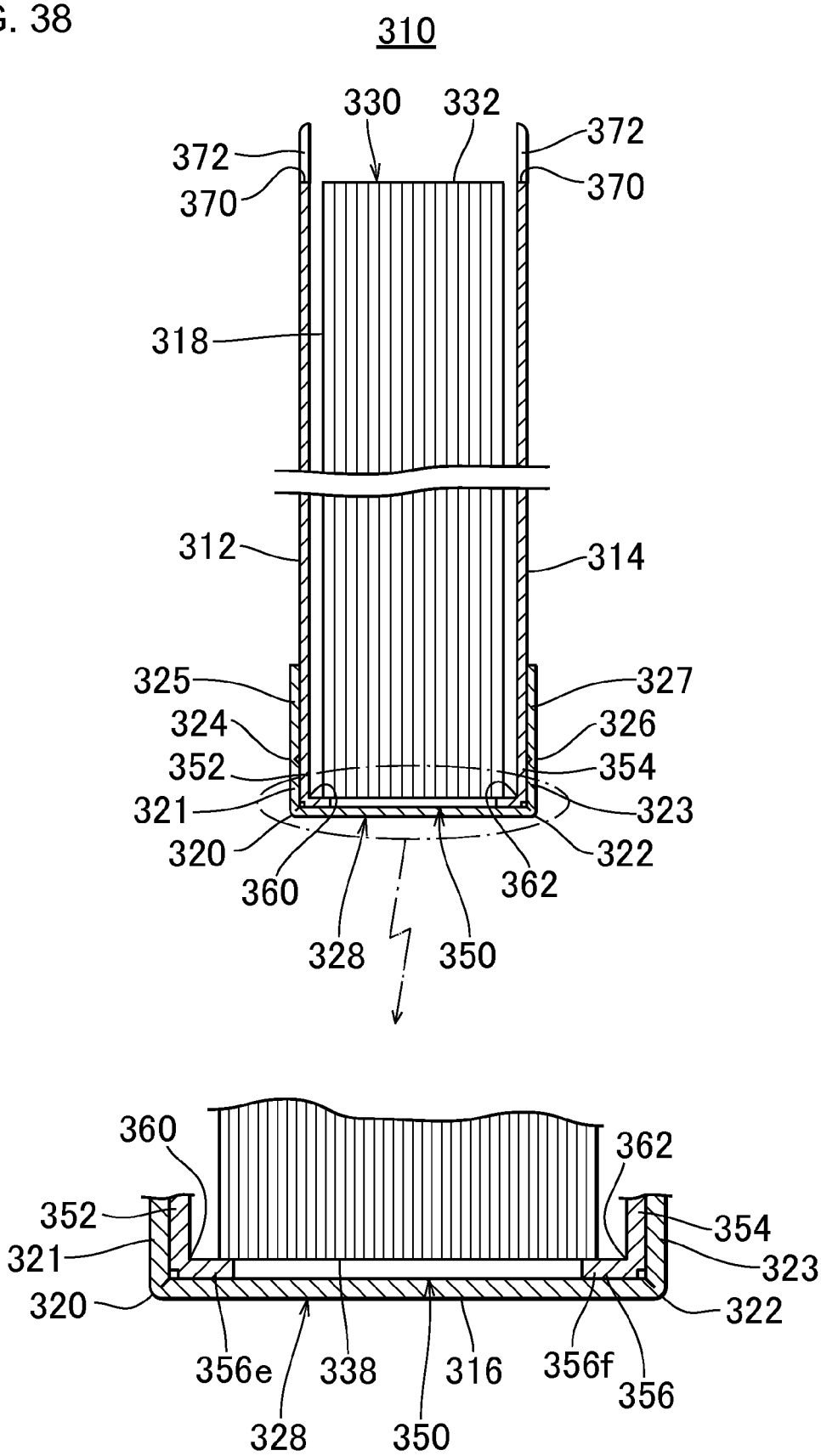
FIG. 38 is a schematic transverse sectional view of the pocket file of FIG. 35 in the closed state.
Figure 39:
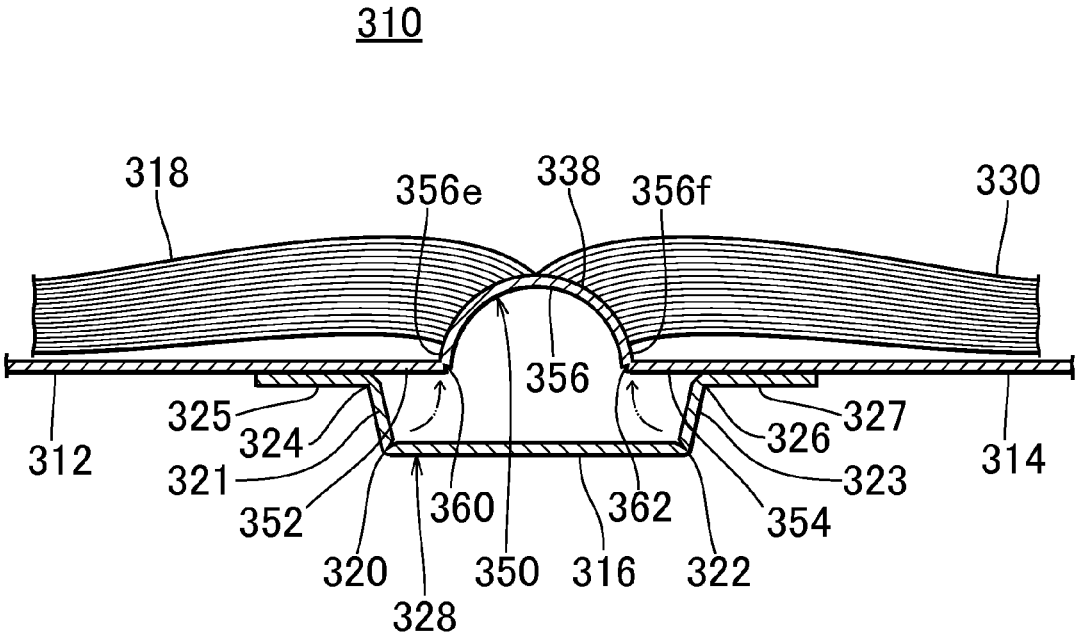
FIG. 39 is a schematic transverse sectional view of the pocket file of FIG. 35 in an opened state.
Figure 40:
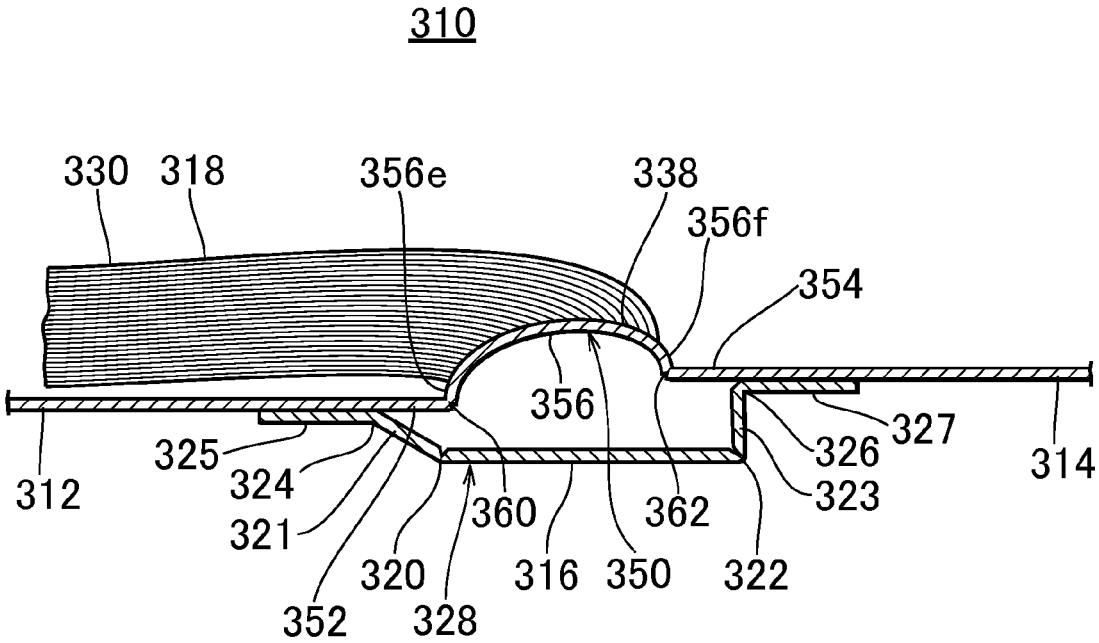
FIG. 40 is a schematic transverse sectional view of the pocket file of FIG. 35 in the opened state.
Figure 41:
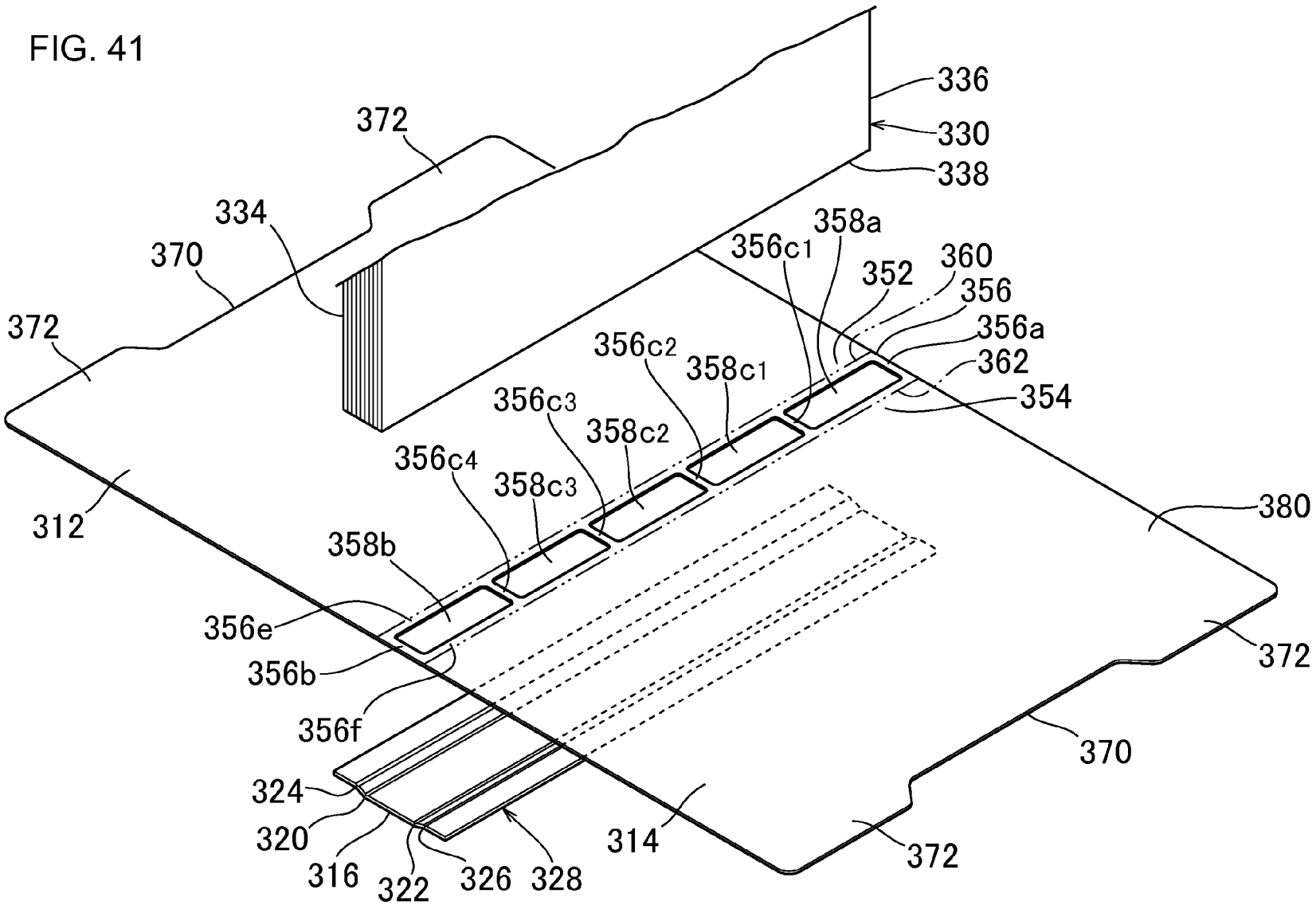
FIG. 41 is a schematic perspective view of a method of manufacturing the file of FIG. 35.
Figure 42:
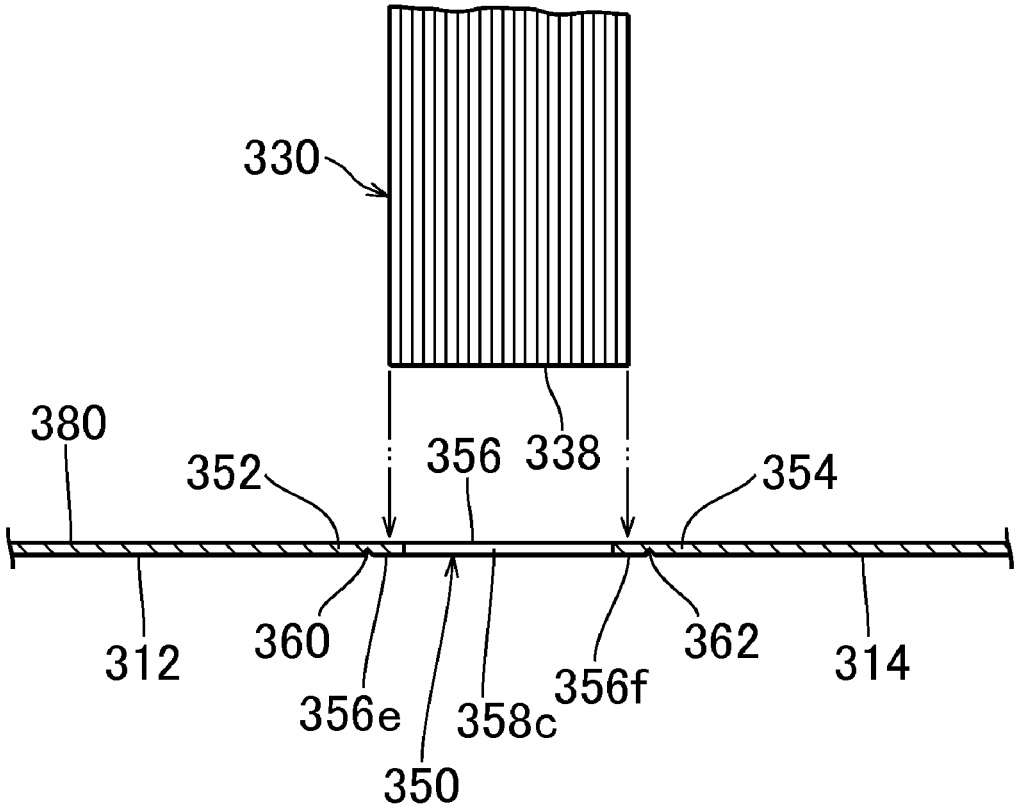
FIG. 42 is a schematic cross-sectional view of a method of manufacturing the file of FIG. 35 including a method of connecting the group of pocket sheets and the curved retaining portion.
Figure 43:
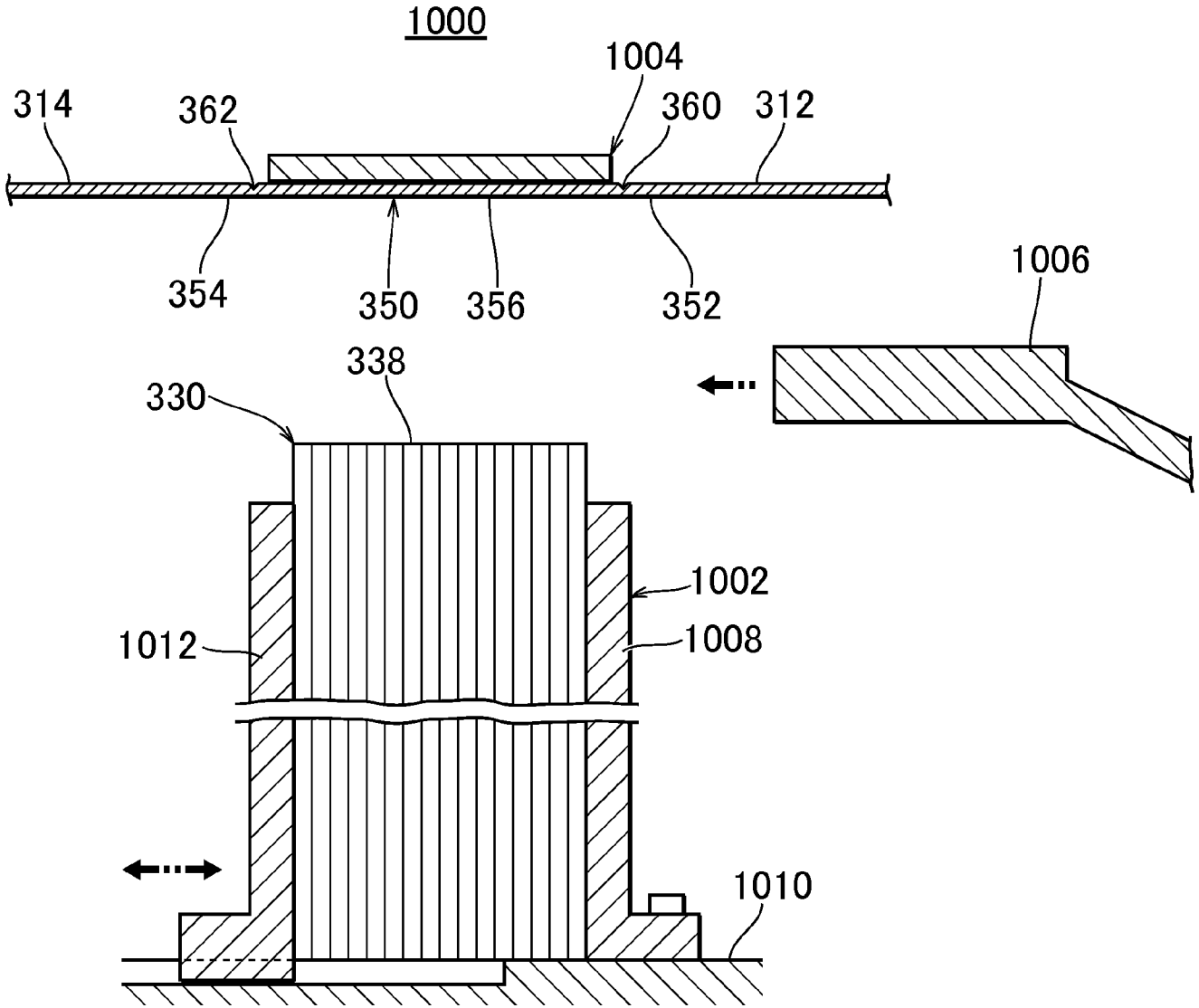
FIG. 43 is a schematic cross-sectional view of the method of manufacturing the file of FIG. 35 including the method of connecting the group of pocket sheets and the curved retaining portion.
Figure 44:
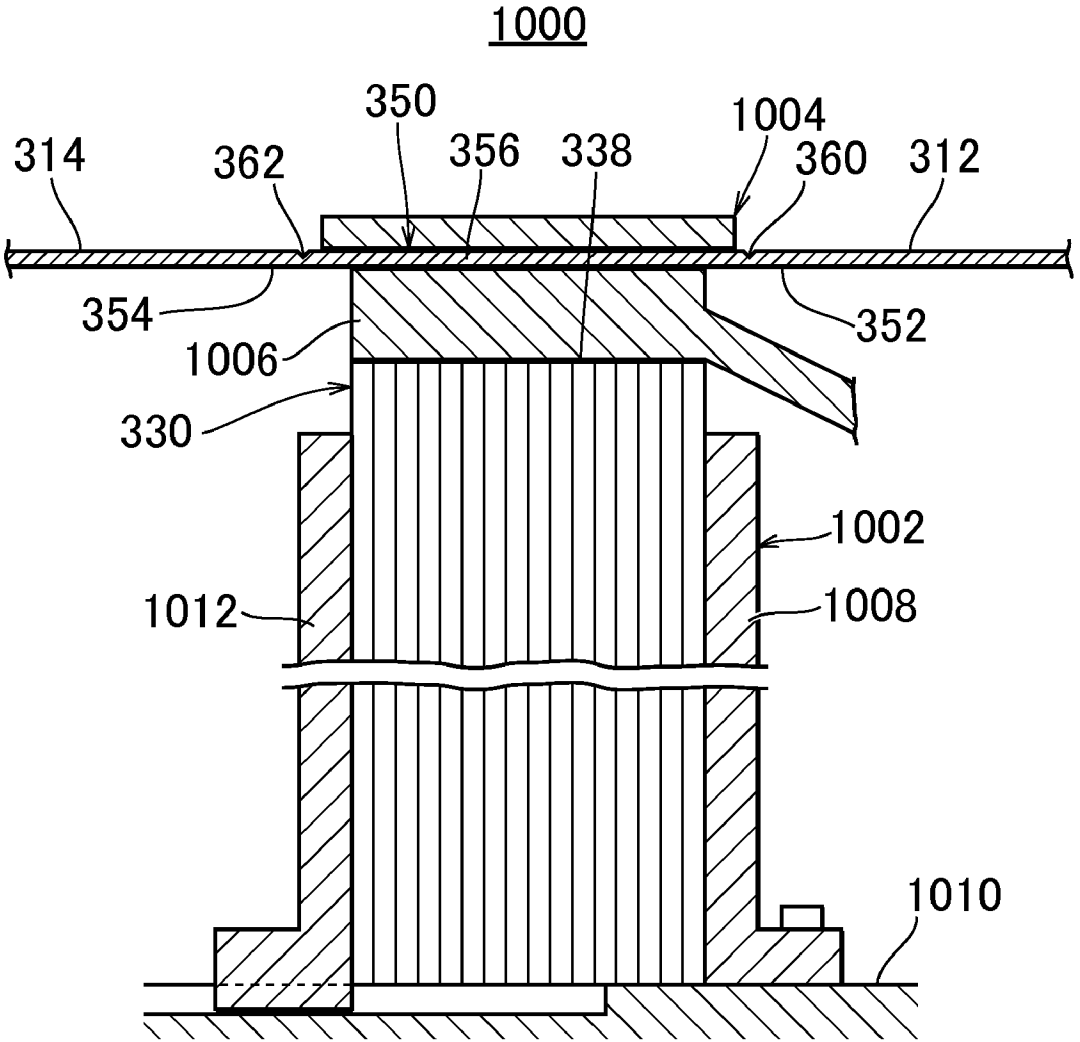
FIG. 44 is a schematic cross-sectional view of the method of manufacturing the file of FIG. 35 including the method of connecting the group of pocket sheets and the curved retaining portion.
Figure 45:
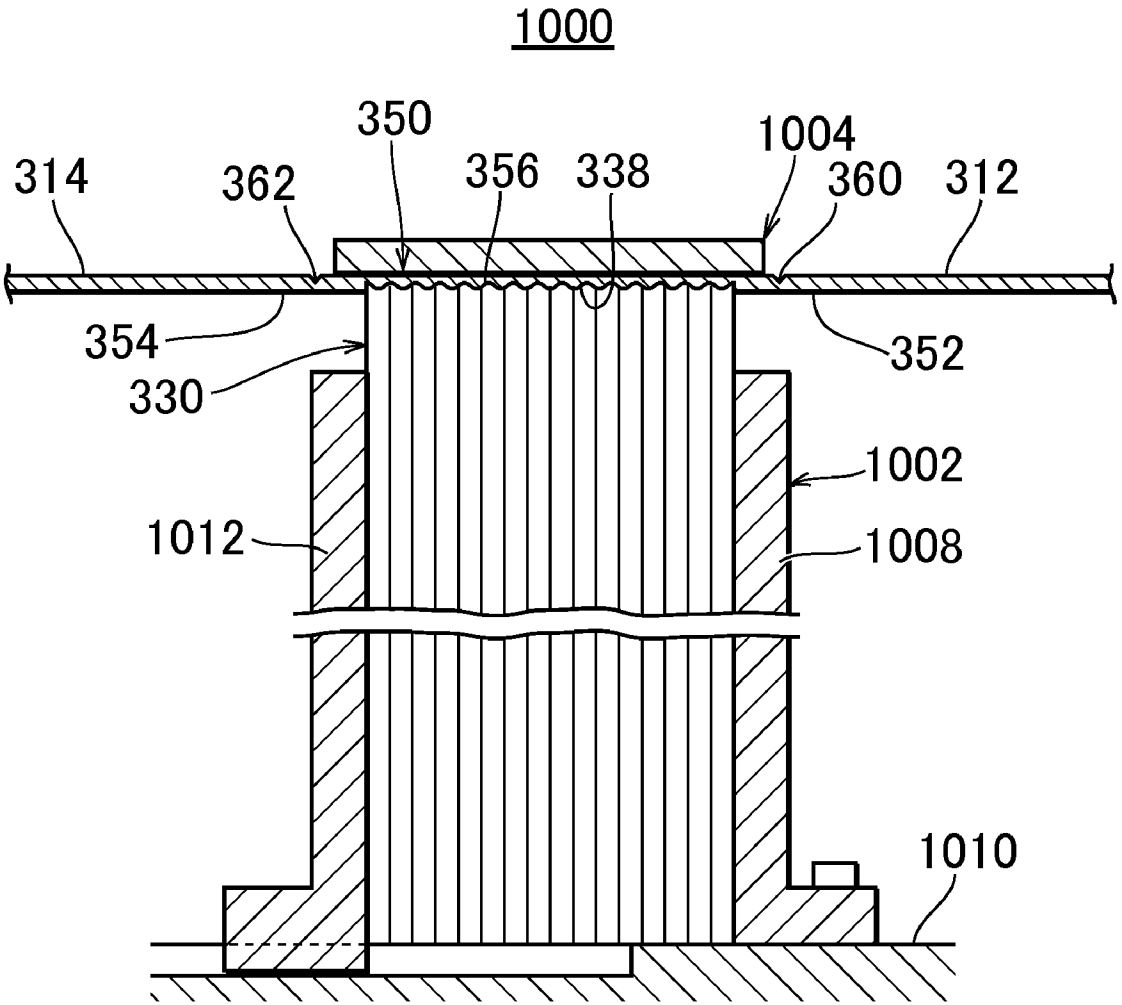
FIG. 45 is a schematic cross-sectional view of the method of manufacturing the file of FIG. 35 including the method of connecting the group of pocket sheets and the curved retaining portion.
Figure 46:
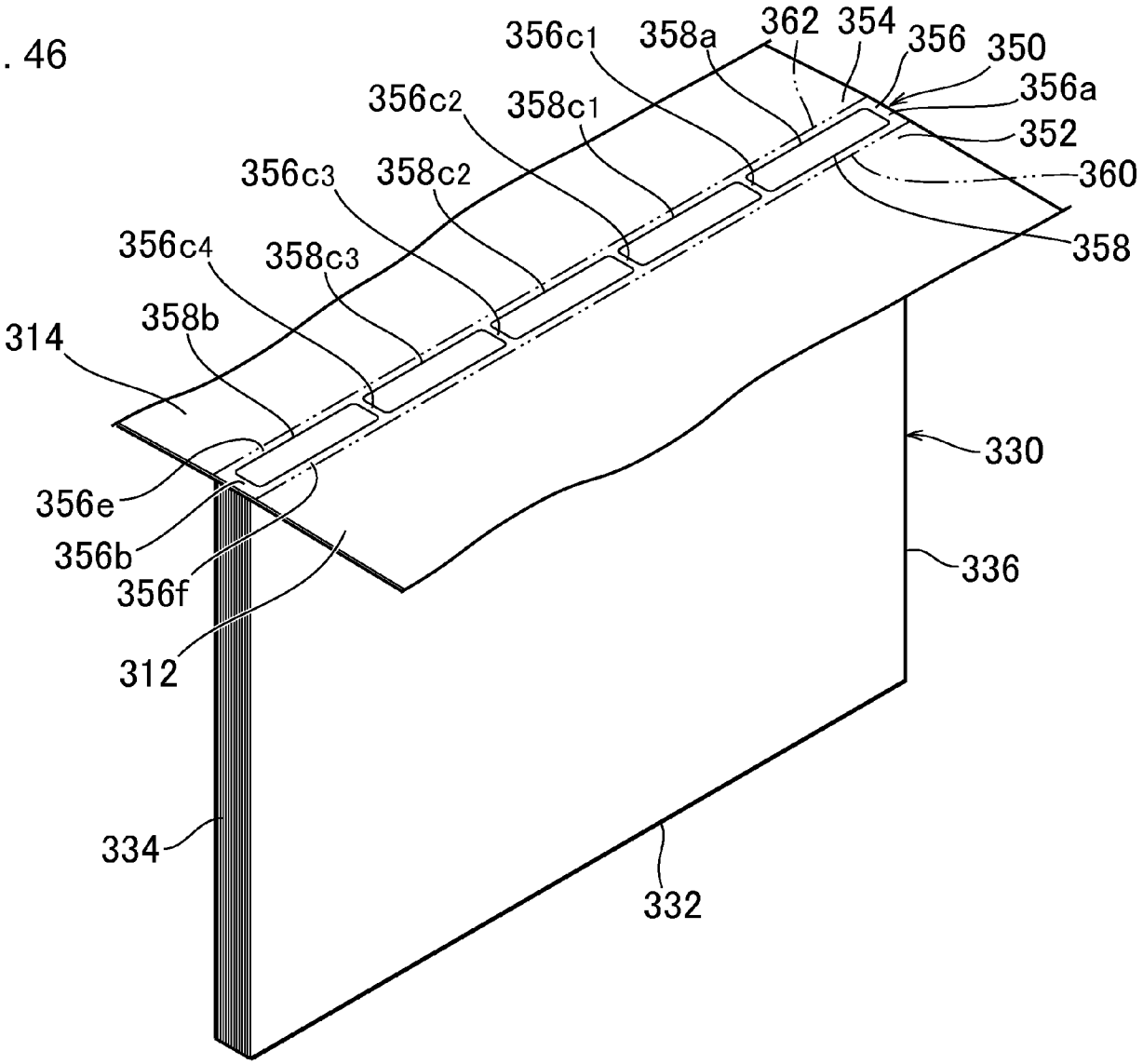
FIG. 46 is a schematic cross-sectional view of the method of manufacturing the file of FIG. 35 including the connecting method of the group of pocket sheets and the curved retaining portion.

The length of the inner face of the spine portion 316 and the front folding portion 324 and the length of the inner face of the spine portion 316 and the back folding portion 326 are substantially equal (shown in FIG. 38).

A square shape retaining portion 323 is provided between the front adjacently providing portion 320 on the side of the front adjacently providing portion 320 of the spine portion 316 and a square shape retaining portion 323 is provided between the back adjacently providing portion 322 on the side of the back adjacently providing portion 322.

A square shape fastening portion on the front cover side 325 is provided between the front folding portion 324 on the side of the front folding portion 324 of the shape retaining portion 321 and a square shape fastening portion on the back cover side 327 is provided between the back folding portion 326 on the side of the back folding portion 326.

The curved subsidiary member 328 preferably has an angular structure and defines a grip portion such that the user can set the spine portion 316 on his palm, grip the curved subsidiary portion 328 with his fingers and open the pocket sheet 318.

On the front cover portion 312 and the back cover portion 314, a recess for searching 370 is provided on the free end edge side opposite to the spine portion 316, i.e. the left side end edge of the front cover portion 312 and the right side end edge of the back cover portion 314, in the approximate middle of the direction of the height thereof.

The outer end edge of the recess for searching 370 and the outer end edge 332 of the pocket sheet 318 are preferably substantially aligned. Accordingly, with one hand, folding the file 310 with the cover closed, especially gripping the curved subsidiary portion 328 and placing the other hand on the recess for search 370 enables flipping of the front cover portion 312 or the back cover portion 314 and the pocket sheet 318.

The file 310 can be flipped from the pocket sheet 318 positioned on the upper side to the pocket sheet positioned on the lower side with the user's fingers placed on the outermost portion of the outer end edge 332 of the pocket sheet 318 and slightly bending the front cover portion 312 or the back cover portion 314 in the recess for searching 370 as shown in FIG. 20.

On the front cover portion 312 and the back cover portion 314, a pair of projection portions 372 on the upper side and the lower side is preferably provided to cover the index i on the pocket sheet 318 such that the projection portion 372 projects toward the outer side of the outer end edge 332, of the pocket sheet 318 on the outside of the region that the recess portion for searching 370 is provided.

The end edge of the group of pocket sheet 330 connected to the spine portion 316 when the cover body is opened is configured to curve away from the spine portion 316.

The pocket sheet 318 includes pockets combined with thermoplastic resin sheets, each pocket sheet 318 is hot-adhered to another on the end edge connected to the cover thereof, and the end edge connected to the spine portion 316 is configured to curve inwardly when the pocket sheet 318 is opened.

The hinge portion on the front cover side 360 is positioned inwardly of the front folding portion 324 and the hinge portion on the back cover side 362 is positioned inwardly of back adjacently providing portion 322 such that the width (T2) between the hinge portion on the front cover side 360 and the hinge portion on the back cover side 362 is than the width (T1) between the front adjacently providing portion 320 and the back adjacently providing portion 322 when the cover body is opened, i.e. when the connecting portion on the front cover side 352 and the connecting portion on the back cover side 354 are adjacent to one another in the horizontal plane in a flat state and the front cover portion 312 and the back cover portion 314 are adjacent to one another the horizontal plane in the flat state.

Additionally, although the width (T1) between the front adjacently providing portion 320 and the back adjacently providing portion 322 and the width (T3) between the hinge portion on the front cover side 360 and the hinge portion on the back cover side 362 are substantially equal, (T3) is less than (1) by the thickness of the front adjacently providing portion 320 and the back adjacently providing portion 322, since the hinge portion on the front cover side 360 and the hinge portion on the back cover side 362 is fastened to the inner surface of the front adjacently providing portion 320 and the back adjacently providing portion 322 when the cover body is closed, i.e. when the front cover portion 312 and the back cover portion 314 are substantially parallel and the connecting portion on the front cover side 352 and the connecting portion on the back cover portion 354 are substantially parallel.

Next, a method of manufacturing the file 310 shown in FIG. 35 of the present invention will be described below with referring to FIGS. 41 through 46.

First, a plurality of pocket sheets 318 are superimposed, and the edge faces of the inner end edge 338 that face one another are heated. Consequently, the region which is slightly inward from the inner end edge 338 is melted. To apply hot welding to the inner end edge 338 of the pocket sheet 318, a hot plate is pressed to the inner end edge 338, the vicinity of the inner end edge 338 is welded and the edge faces of the inner end edge 338 facing one another are adhered to form the group of pocket sheets 330. Adhesion and welding may be performed with a hot-melt adhesive agent or by ultrasonic horn respectively.

The group of pocket sheets 330 preferably includes pockets combined with thermoplastic resin sheets, each binding sheet is hot adhered to another on the end edge connected to the cover thereof, and the end edge connected to the cover is formed to curve inwardly when the pocket sheet 318 is opened.

Next, a method for fixing the group of pocket sheets 33 to the curved retaining portion 350 of the cover body will be described with referring to FIGS. 43 through 49.

First, a synthetic resin sheet body, such as polypropylene or other suitable material is prepared, Thompson processing is applied thereto, and the cover material 380 is removed, which will define the cover of the file to form a cover material 380 having a combined size of the front cover portion 312, the back cover portion 314, and the curved retaining portion 350 (Cover material molding step).

For forming the curved retaining portion 350 with the cover material 380 made of a thermoplastic synthetic resin sheet body, such as polypropylene or other suitable material, for example, in a square planar shape, the curved retaining portion 350 is formed by demarcating the interjacent connecting portion 356 interposed between the connecting portion on the front cover side 352 connected to the front cover portion 312 and the connecting portion on the back cover side 354 connected to the back cover portion 314 from the cover material 380.

The interjacent connecting portion 356 is connected to the end edge connected to the cover of the binding body and is formed to curve away from the spine portion 316 along with the end edge connected to the cover of the group of the pocket sheets 330 by the tension of the connecting portion on the front cover portion 352 and the connecting portion on the back cover portion 354 when the cover is opened.

The curved retaining portion 350 is preferably made of a thermoplastic synthetic resin sheet body, such as polypropylene or other suitable material, for example, in a square planar shape and includes the through hole 358 provided in the region connected to the group of pocket sheets 330 and is formed so as to curve. The group of pocket sheets 330 is adhered to the inner surface of the bridge portions 356*a*, 356*b*, 356*c*1, 356*c*2, 356*c*3 and 356*c*4 of the curved retaining portion 350 and also to the inner surface of the longitudinal bridge portion 356*e* and 356*f* with a small space between the hinge portion on the front cover side 360 and the hinge portion on the back cover side 362.

The group of pocket sheets 330 is attached by hot welding to the upper surface of the interjacent connecting portion 356.

The curved retaining portion 350 is formed by the hinge portion on the front cover side 360 and the hinge portion on the back cover side 362 between the connecting portion on the front cover side 352 and the interjacent connecting portion 356 and between the connecting portion on the back cover side 354 and the interjacent connecting portion 356.

The distance between the spine portion 316 and the front folding portion 324 of the front cover portion 312 and the back folding portion 326 of the back cover portion 314 respectively is preferably substantially equal to or less than the distance between the hinge portion on the front cover side 360 of the curved retaining portion 350 and the inner surface of the front cover portion 312 or the hinge portion on the back cover side 362 and the inner surface of the back cover portion 314. The hinge portion on the front cover side 360 and the hinge portion on the back cover side 362 are positioned adjacent to the end edge of the spine portion 316 in cross direction when the cover is closed.

In this preferred embodiment, a cover material 180 which is originally a flat plate is applied in a folding process. The longitudinal bridge portion 356*e* and the connecting portion on the front cover side 352 providing the hinge portion on the front cover side 360 therebetween intersect at substantially right angles to retain the shape when a load is not applied and the longitudinal bridge portion 356*f* and the connecting portion on the back cover side 354 providing the hinge portion on the back cover side 362 therebetween intersect at substantially right angles to retain the shape when a load is not applied.

A molding process is performed by folding the connecting portion on the front cover side 352 including the hinge portion on the front cover side 360 therebetween until it is substantially at a right angle to the interjacent connecting portion 356 and by folding the connecting portion on the back cover side 354 including the hinge portion on the back cover side 362 therebetween until it is substantially at a right angle to the interjacent connecting portion 356.

When the connecting portion on the front cover side 352 side or the connecting portion on the back cover side 354 side opens corresponding to when the front cover portion 312 or the back cover portion 314 is opened, the degree of the angle between the longitudinal bridge portion 356*e* and the connecting portion on the front cover side 352 expands, and the angle between the longitudinal bridge portion 356*f* and the connecting portion on the back cover side 354 expands. When the expansion of those angles become about 120 to 130 degrees, and the curved retaining portion 150 is lifted toward the direction away from the spine portion 316 with the elasticity of the material comprising the curved retaining portion 350 and the elasticity adjacent to the both ends of the hinge portion on the front cover side 360 and the hinge portion on the back cover side 362 of the both sides.

The interjacent connecting portion 356 between the hinge portion on the front cover side 360 and the hinge portion on the back cover side 362 is formed to curve away from the spine portion 316 when the cover portion 312 is opened and the width of the interjacent connecting portion 356 is less than the width of the spine portion 316.

Next, a method for adhering the group of pocket sheets 330 to a cover material 380 will be described.

The curved retaining portion 350 is connected adjacent to the hinge portion on the front cover side 360 of the front cover portion 312 and the hinge portion on the back cover side 362 of the back cover portion 314 so as to be spaced from the group of the pocket sheets 330 such that the curved retaining portion 350 enables the end edge connected to the cover of the group of pocket sheet 330 to curve with a width that is less than the width of the spine portion 316 of the cover body.

The curved retaining portion 350 is welded to the connecting portion on the front cover side 352 connected to the side of the front cover portion 312 and the outer surface of the front cover portion 312 and to the connecting portion on the back cover side 354 on the side of the back cover portion 314 and the outer surface of the back cover portion 314 and extends between the front cover portion 312 and the back cover portion 314.

The curved retaining portion 350 includes the connecting portion on the front cover side 352 connected to the side of the front cover portion 312, the connecting portion on the back cover side 354 connected to the side of the back cover portion 314 and the interjacent connecting portion 356 interposed between the connecting portion on the front cover side 352 and the connecting portion on the back cover portion 354. The interjacent connecting portion 356 is connected to the end edge of the binding body connected to the cover and is configured to curve away from the spine portion 316 along with the end edge connected to the cover of the binding body by the tension of the connecting portion on the front cover portion 352 as the rigid body and the connecting portion on the back cover portion 354 as the rigid body when the cover body is opened.

The hinge portion on the front cover side 360 and the hinge portion on the back cover side 362 are provided between the connecting portion on the front cover side 352 and the interjacent connecting portion 356 and between the connection portion on the back cover side 354 and the interjacent connecting portion 356.

Next, for forming the curved subsidiary portion 328, a thermoplastic synthetic resin sheet is prepared, Thompson processing is applied thereto, and the curved subsidiary portion 328 is punched out in a square planar shape.

Further, a spine index paper Z is pasted to the surface of the spine area using an adhesive agent, which will later become the spine portion 316 (Spine index paper pasting step).

Figure 48:
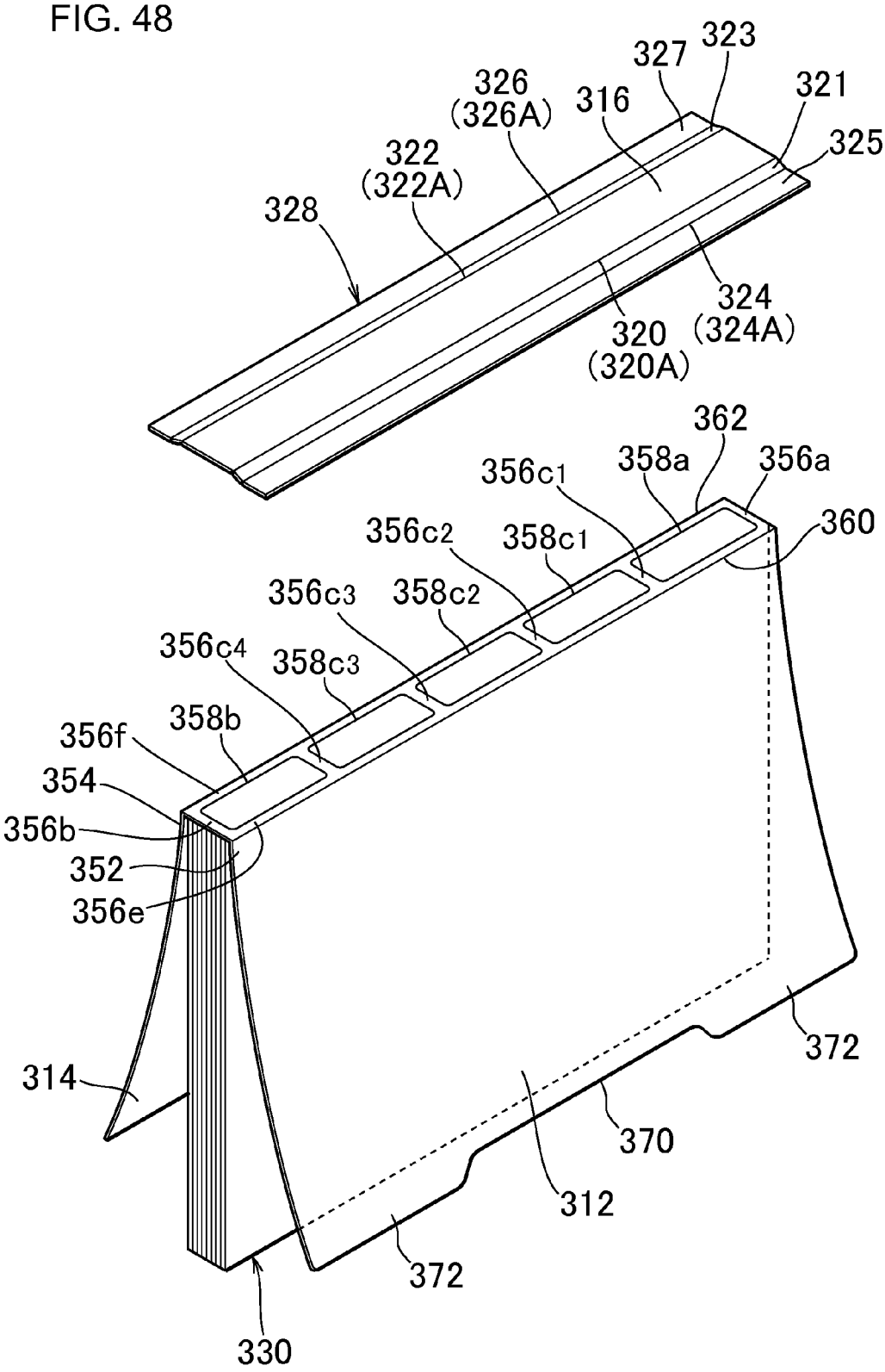
FIG. 48 is a schematic transverse sectional view of a method of connecting the cover and the curved subsidiary portion.
Figure 49:
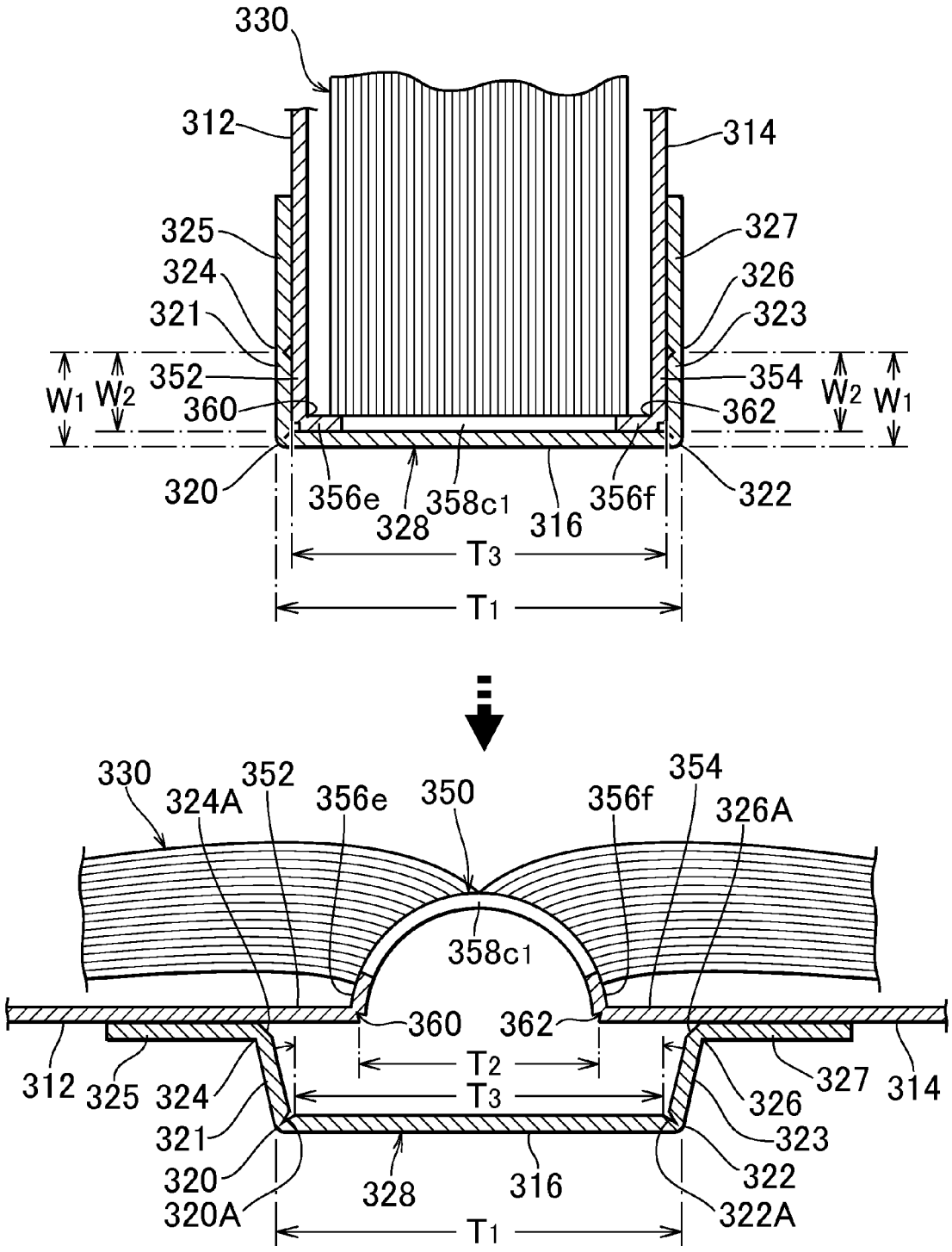
FIG. 49 is a schematic transverse sectional view of an operation of the file of FIG. 35.

For example, as shown in FIGS. 48 and 49, when a thermoplastic resin sheet is used as the curved subsidiary member 328, the heat-press molding is applied with the V-shape heater (not shown) to the V-shape slots 320A, 322A, 324A and 326A which have a substantially V-shape section and are parallel or substantially parallel to one another in order to form the front adjacently providing portion 320, the back adjacently providing portion 322, the front folding portion 324, and the back folding portion 326. Then, the cover material 380 is formed so as to be foldable (V-shape slot molding step).

Next, the longitudinal bridge portion 356*e* and the connecting portion on the front cover side 352 provided with the hinge portion on the front cover side 360 therebetween are formed to intersect at substantially right angles to retain the shape and the retaining portion 321 and the retaining portion 323 of the curved subsidiary portion 328 formed to retain the shape by intersecting with the spine portion 316 in a state in which the longitudinal bridge portion 356*f* and the connecting portion on the back cover side 354 provided with the hinge portion on the back cover side 362 therebetween intersect at substantially right angles to retain the shape. Then, a fastening portion on the front cover side 325, the connecting portion on the front cover side 352, a fastening portion on a back cover side 327, and the connecting portion on the back cover side 354 are adhered.

Then, the cover body including the curved subsidiary portion 328 is formed by fastening the outer end edge of the front cover portion 320 at the outer surface of the front cover portion 312 and portions outward from the hinge portion on the front cover side 360 and fastening the back adjacently providing portion 322 at the outer surface of the back cover portion 314 and portions outward from the hinge portion on the back cover side 362.

The distance (W1) between the spine portion 316 and the front folding portion 324 of the front cover portion 312 and the back folding portion 326 of the back cover portion 314 respectively is substantially equal to the distance (W2) between the hinge portion on the front cover side 360 of the curved retaining portion 350 and the inner surface of the front cover portion 312 or the hinge portion on the back cover side 362 and the inner surface of the back cover portion 314 and (W2) is less than (W1) by the thickness of the spine portion 316.

The hinge portion on the front cover side 360 and the hinge portion on the back cover side 362 are positioned adjacent to the end edge of the spine portion 316 when the cover body is closed. The hinge portion on the front cover side 360 and the hinge portion on the back cover side 362 are formed to curve away from the spine portion 316 when the cover body is opened and the width between the hinge portion on the front cover side 360 and the hinge portion on the back cover side 362 is less than the width of the spine portion 316. Accordingly, when the cover body is opened and the group of pocket sheets 330 is spread, the pocket sheet 318 is flat.

The present invention is not limited to the preferred embodiments described above, and the invention can be variously modified.

Figure 50:
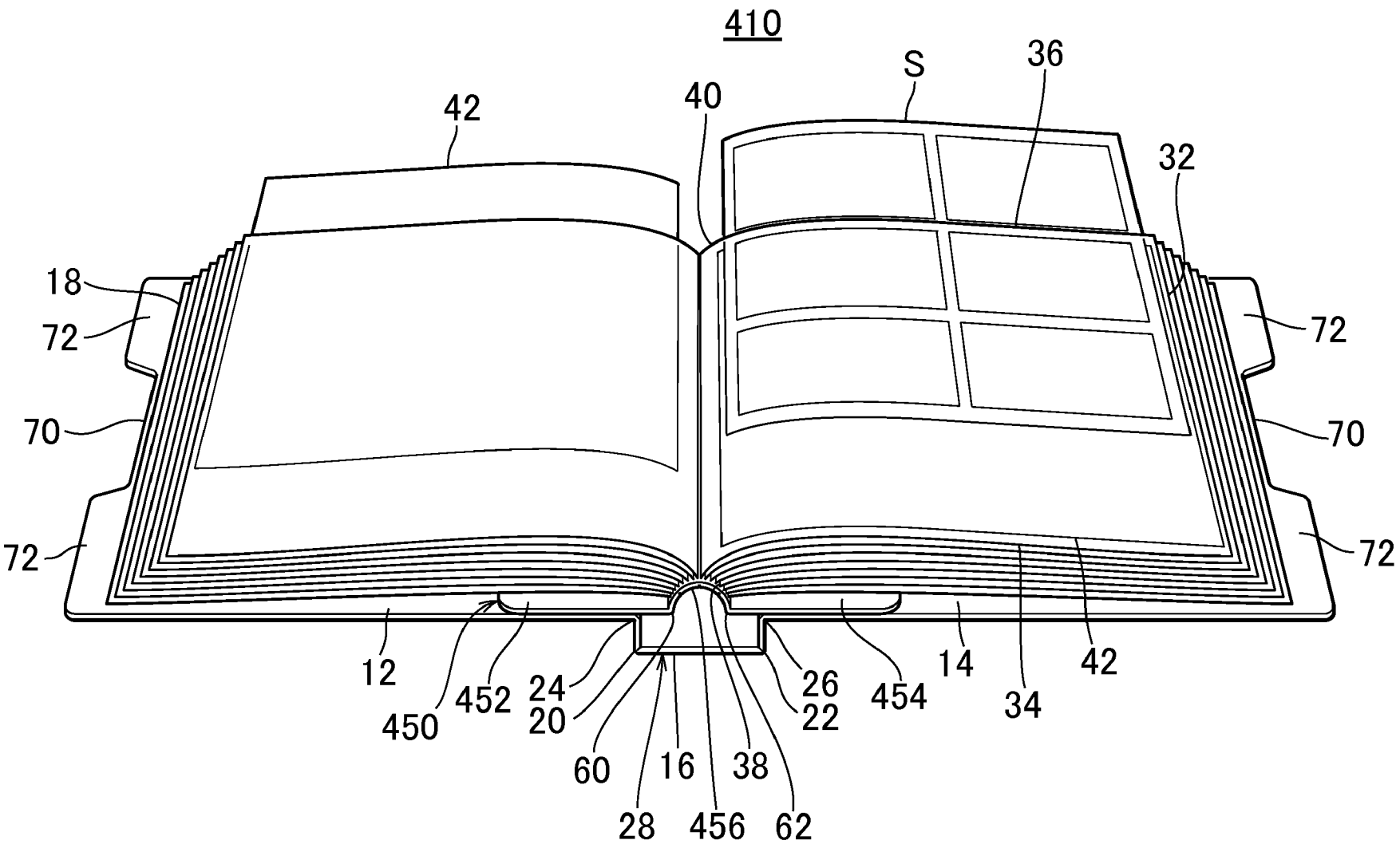
FIG. 50 is a schematic perspective view of the pocket file as a modified example of the file according to the preferred embodiment of the present invention shown in FIG. 1.
Figure 51A:
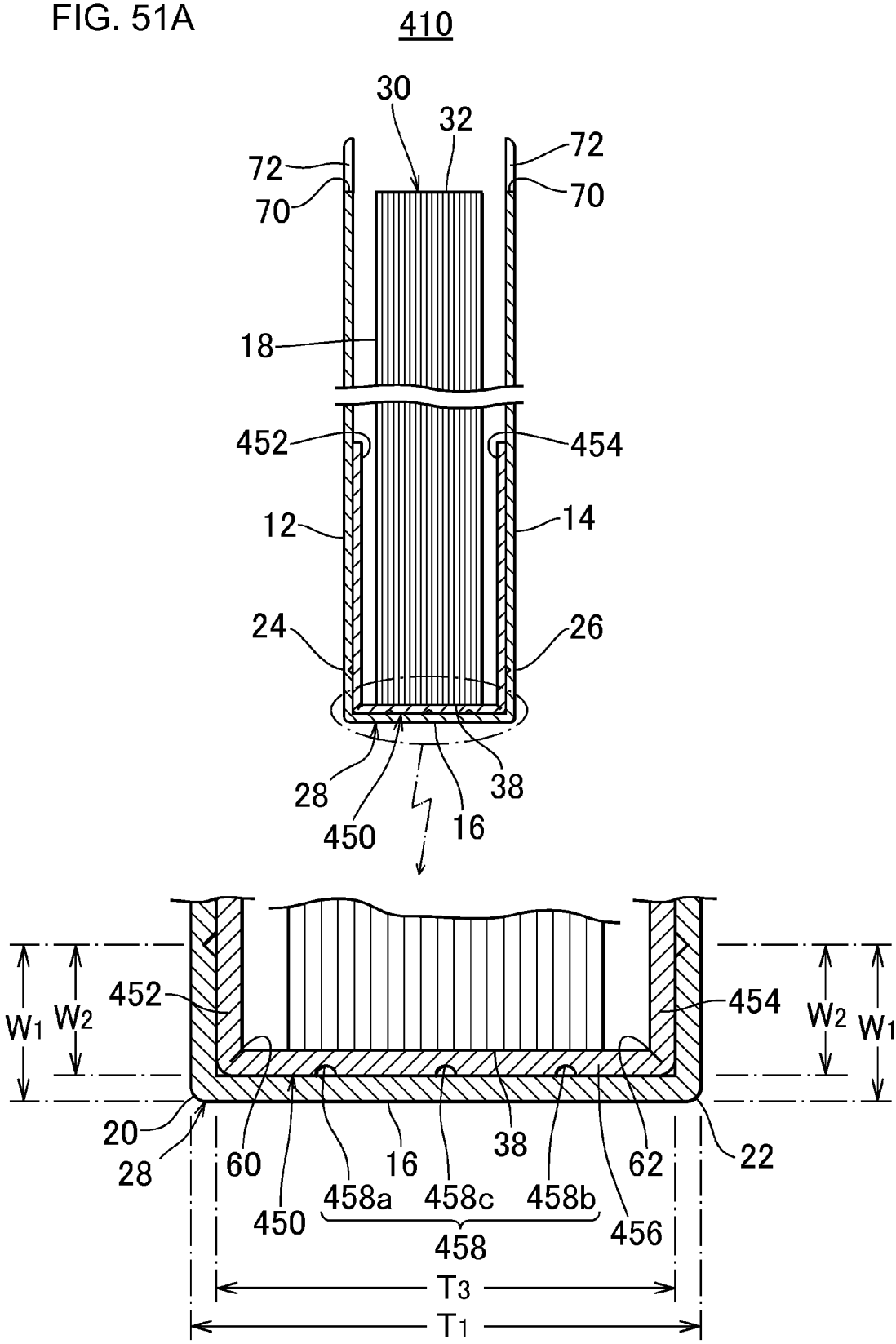
FIG. 51A is a schematic transverse sectional view of the pocket file of FIG. 50 in a closed state.
Figure 51B:
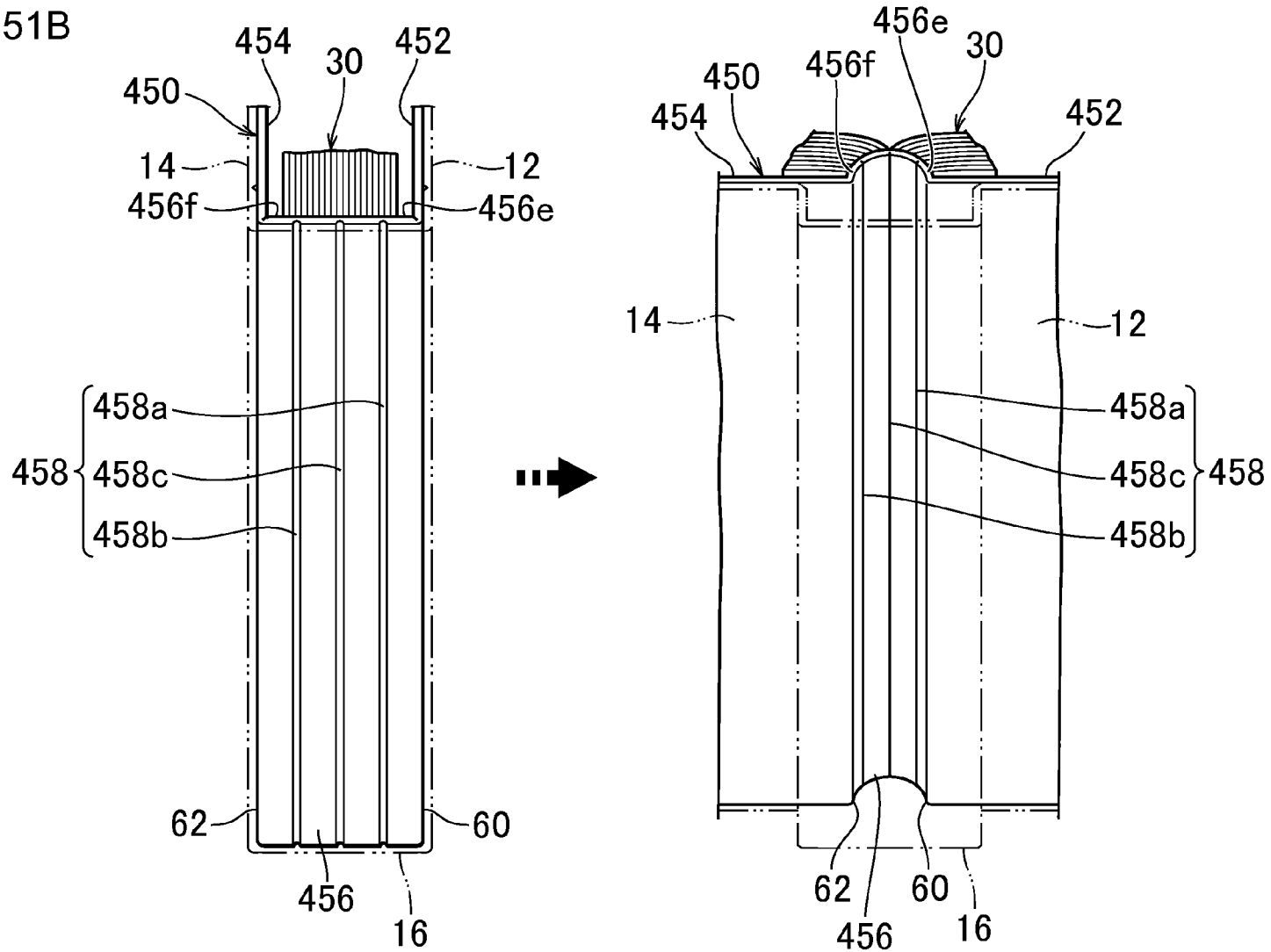
FIG. 51B is a schematic bottom view of the vicinity of the curved retaining portion showing the operating state of the curved retaining portion.
Figure 52:
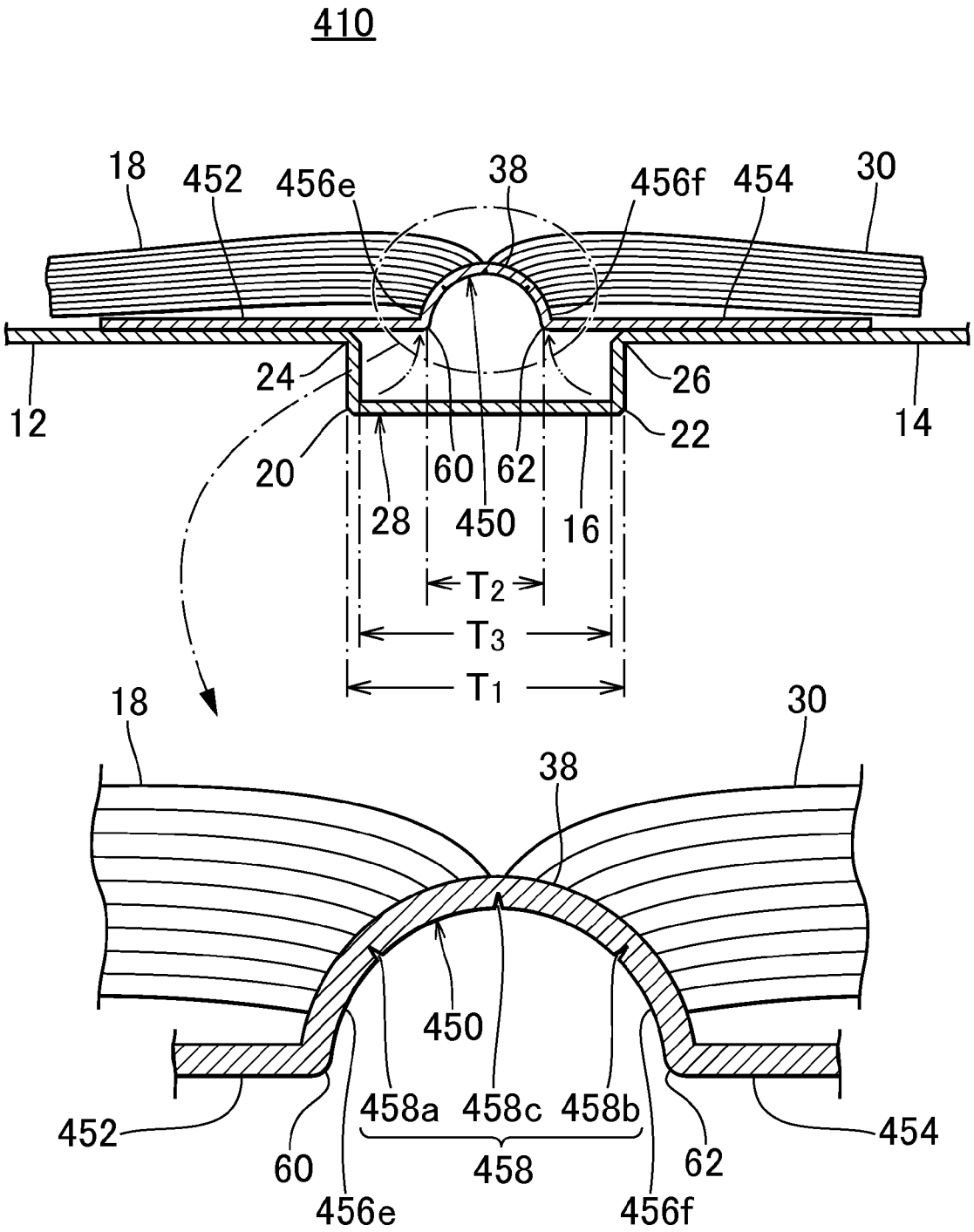
FIG. 52 is a schematic transverse sectional view of the pocket file of FIG. 50 in an opened state.

The pocket file shown in FIG. 1 can be modified as shown in FIGS. 50 through 52.

A file 410 preferably includes the curved retaining portion configured to curve the end edge of the group of pocket sheets 30 in the direction of the pocket sheet 18 extending at the inner side of the spine portion 16 provided between the front cover portion 12 and the back cover portion 14 when the cover is opened and includes a curved subsidiary portion which fixes the back of the cover body into a desired configuration in a region on a front cover side and a region on a back cover side of the spine portion 16 between the front cover portion 12 and the back cover portion 14.

As shown in FIGS. 50 through 52, the front folding portion 24 and the back folding portion 26 extending from the top edge to the bottom edge are provided adjacent to the front connecting portion 20 and the back connecting portion 22 of the front cover portion 12, the back cover portion 14 and the spine portion 16, and the grip portion 28 is preferably provided in the region from the front folding portion 24 on the front cover portion 12 to the spine portion 16, the region from the back folding portion 26 on the back cover portion 14 to the spine portion 16 and the spine portion 16.

In grip portion 28, the connecting portion on a front cover side 452 including the front folding portion 24 as an axis moves upwardly in the region on the spine portion 16 on the front cover side between the front cover portion 12 and the back cover portion 14, and the connecting portion on a back cover side 454 including the back folding portion 26 as an axis moves upwardly and the grip portion 28 defines the curved subsidiary portion which enables a connecting portion 450 as a curved subsidiary portion to arch upwardly, i.e. in the direction away from the spine portion 16, when the front cover portion 12 and the back cover portion 14 are substantially horizontal, and the grip portion 28 is parallel or substantially parallel to the horizontal spine portion 16.

On the front cover portion 12 and the back cover portion 14, the front folding portion 24 and the back folding portion 26 are parallel or substantially parallel to the front adjacently providing portion 20 and the back adjacently providing portion 22 in the direction of their heights extending from the top edge to the bottom edge thereof adjacent to the front adjacently providing portion 20 and the back adjacently providing portion 22.

The length of the inner face of the spine portion 16 and the front folding portion 24 and the length of the inner face of the spine portion 16 and the back folding portion 26 are preferably substantially equal (shown in FIG. 52).

The mount 42 is arranged such that the front folding portion 24 and the back folding portion 26 are not adjacent to the mount 42.

The group of pocket sheets 30 is connected by the end edge connected thereto and the connecting portion 450 connecting the front cover portion 12 and the back cover portion 14.

The connecting body 450 is preferably a substantially square rigid plate body when viewed in a planar view made of thermoplastic synthetic resin and includes the curved retaining portion which curves the group of pocket sheets 30, that is welded and connected at the connecting end edge of the group of pocket sheets 30 as the binding body, toward the direction in which the pocket sheet 18 extends.

The connecting body 450 is connected adjacent to the front folding portion 24 of the front cover portion 12 and the back folding portion 26 of the back cover portion 14 and is spaced from the group of the pocket sheets 30 such that the connecting body 450 enables the end edge connected to the cover of the group of pocket sheet 30 to curve with the width less than the width of the spine portion 16 of the cover body.

The connecting body 450 includes a connecting portion on the front cover side 452 connected to the side of the front cover portion 12, a connecting portion on the back cover side 454 connected to the side of the back cover portion 14, and an interjacent connecting portion 456 interposed between the connecting portion on the front cover side 452 and the connecting portion on the back cover side 454. The interjacent connecting portion 456 is connected to the end edge connected to the cover of the group of pocket sheets 30 and is configured to curve away from the spine portion 16 along with the end edge connected to the cover of the group of the pocket sheets 30 by the tension of the connecting portion on the front cover side 452 and the connecting portion on the back cover side 454 when the cover is opened.

The interjacent connecting portion 456 is relatively flexible and is configured to curve toward the side the pocket sheet 18 as the binding sheet extends, i.e. away from the spine portion 16, by the weight of the pocket sheet 18 being in a spread state.

The interjacent connecting portion 456 of the connecting body 450 includes a hinge slot 458 in the region connected to the binding body and is configured so as to curve.

The interjacent connecting portion 456 of the connecting body 450 includes a plurality of the hinge slots 458 on the side of the spine portion 16 which are spaced from one another so as to provide flexibility thereto. In this preferred embodiment, 3 narrow slots are provided, a front hinge slot 458*a*, a back hinge slot 458*b*, and a middle hinge slot 458*c*.

The connecting body 450 includes the spaced apart substantially parallel hinge slots 458 which extend from the top edge to the bottom edge to provide flexibility and is configured to curve away from the back cover portion 16 when the pocket sheet 18 is opened. It differs from the preferred embodiment shown in FIG. 1 in this respect.

On the connecting body 450, the hinge portion on the front cover side 60 provided between the connecting portion on the front cover side 452 and the interjacent connecting portion 456 and the hinge portion on the back cover side 62 provided between the connecting portion on the back cover side 454 and the interjacent connecting portion 456 are preferably parallel or substantially parallel to each other.

On the interjacent connecting portion 456, a longitudinal bridge portion 456*e* is successively provided adjacent to the hinge portion on the front cover side 60 so as to extend from the top edge to the bottom edge of the interjacent connecting portion 456 and a longitudinal bridge portion 456*f* is successively provided adjacent to the hinge portion on the back cover side 62 so as to extend from the top edge to the bottom edge of the interjacent portion 456.

The distance between the spine portion 16 and the front folding portion 24 of the front cover portion 12 and the back folding portion 26 of the back cover portion 14 respectively is preferably substantially equal or less than the distance between the hinge portion on the front cover side 60 of the connecting body 450 and the inner surface of the front cover portion 12 and between the hinge portion on the back cover side 62 or the inner surface of the back cover portion 14. The hinge portion in the front cover side 60 and the hinge portion on the back cover side 62 are positioned adjacent to the end edge of the spine portion 16 when the cover is closed.

The interjacent connecting portion 456 interposed between the hinge portion on the front cover side 60 and the hinge portion on the back cover side 62 is configured to curve away from the spine portion 16 and the width between the hinge portion on the front cover side 60 and the hinge portion on the back cover side 62 is preferably less than the width of the spine portion 16 when the front cover portion 12 is opened.

Figure 53:
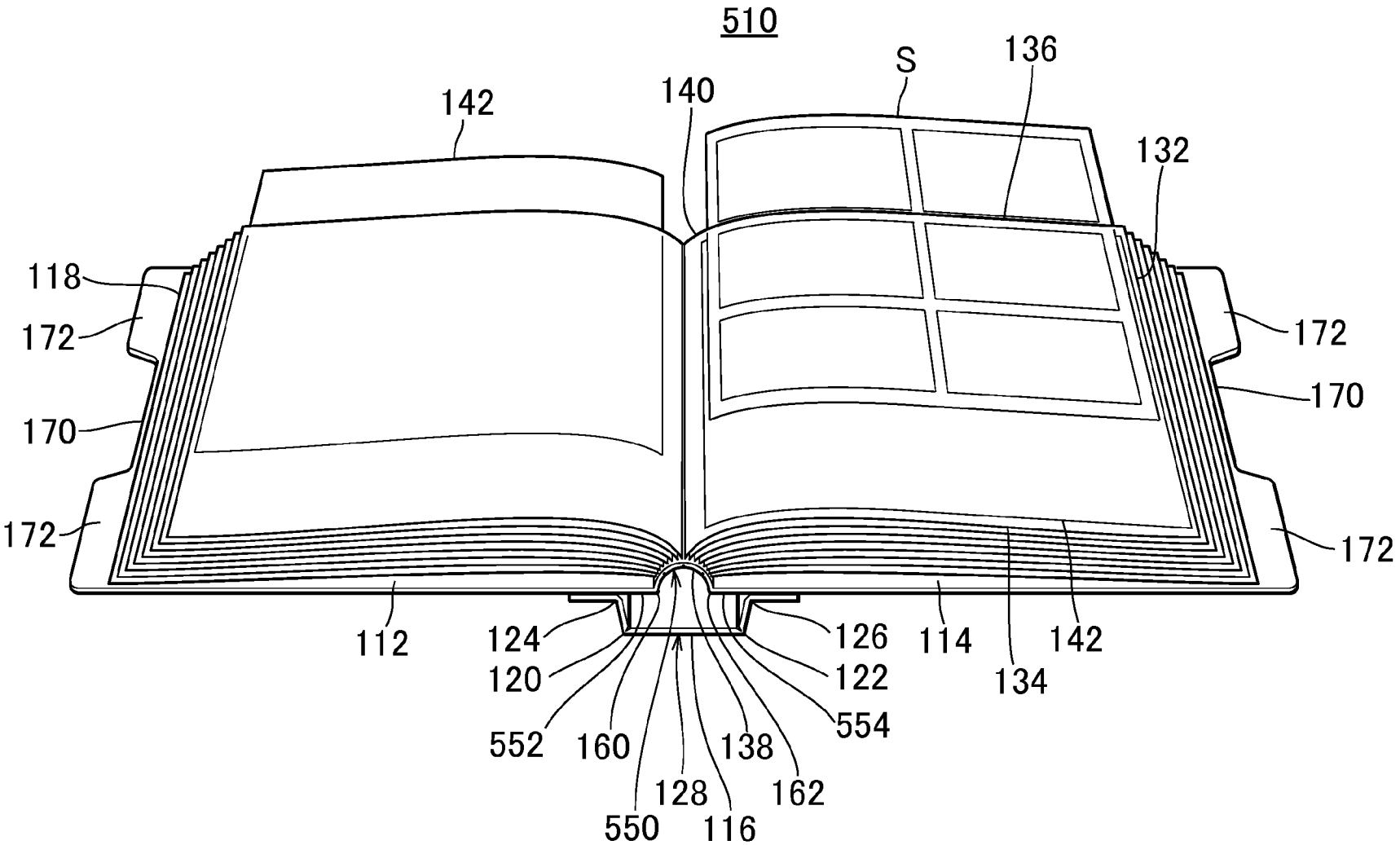
FIG. 53 is a schematic perspective view of the pocket file as a modified example of the pocket file according to the preferred embodiment of the present invention shown in FIG. 21.
Figure 54A:
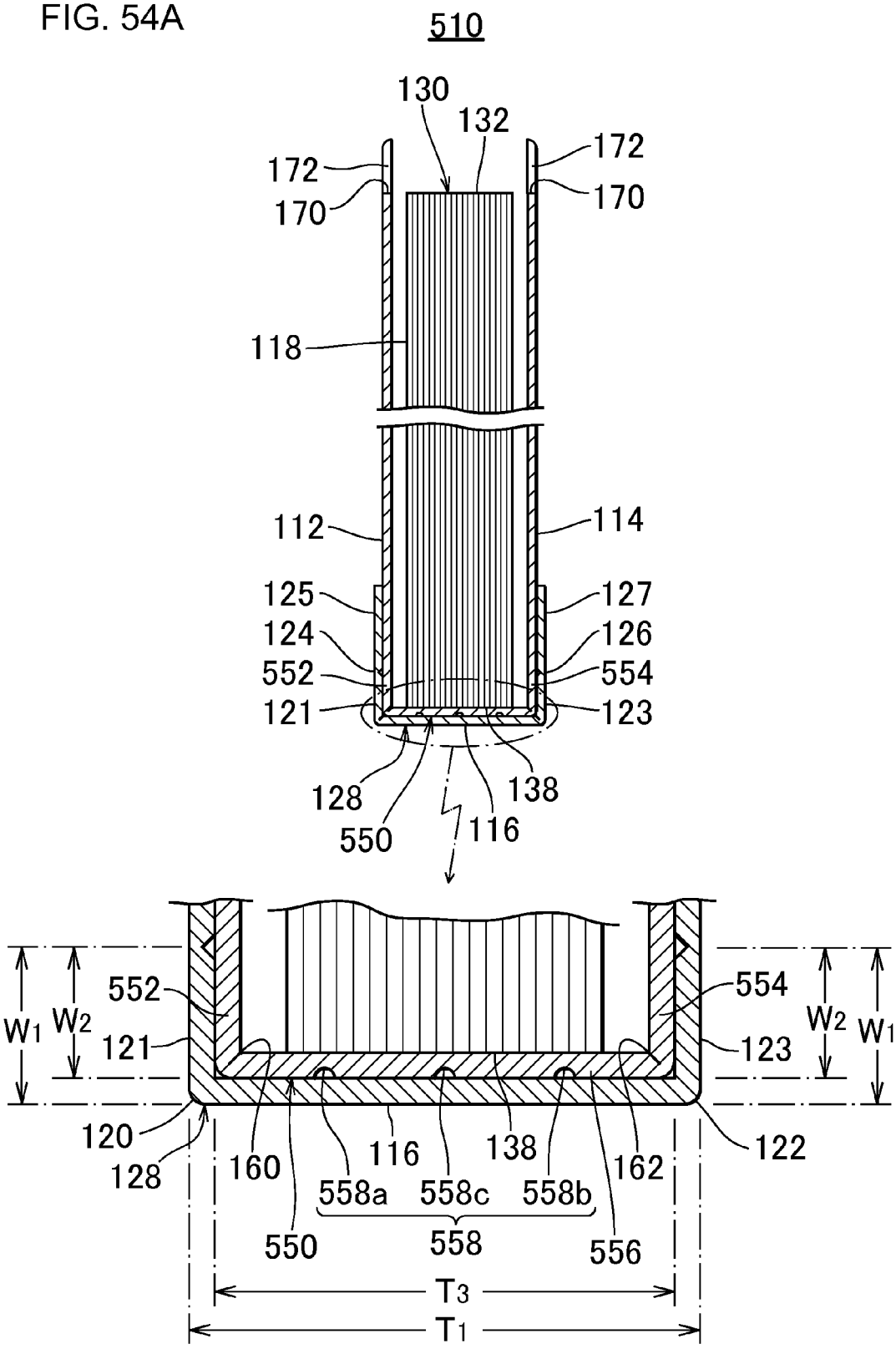
FIG. 54A is a schematic transverse sectional view of the pocket file of FIG. 53 in a closed state.
Figure 54B:
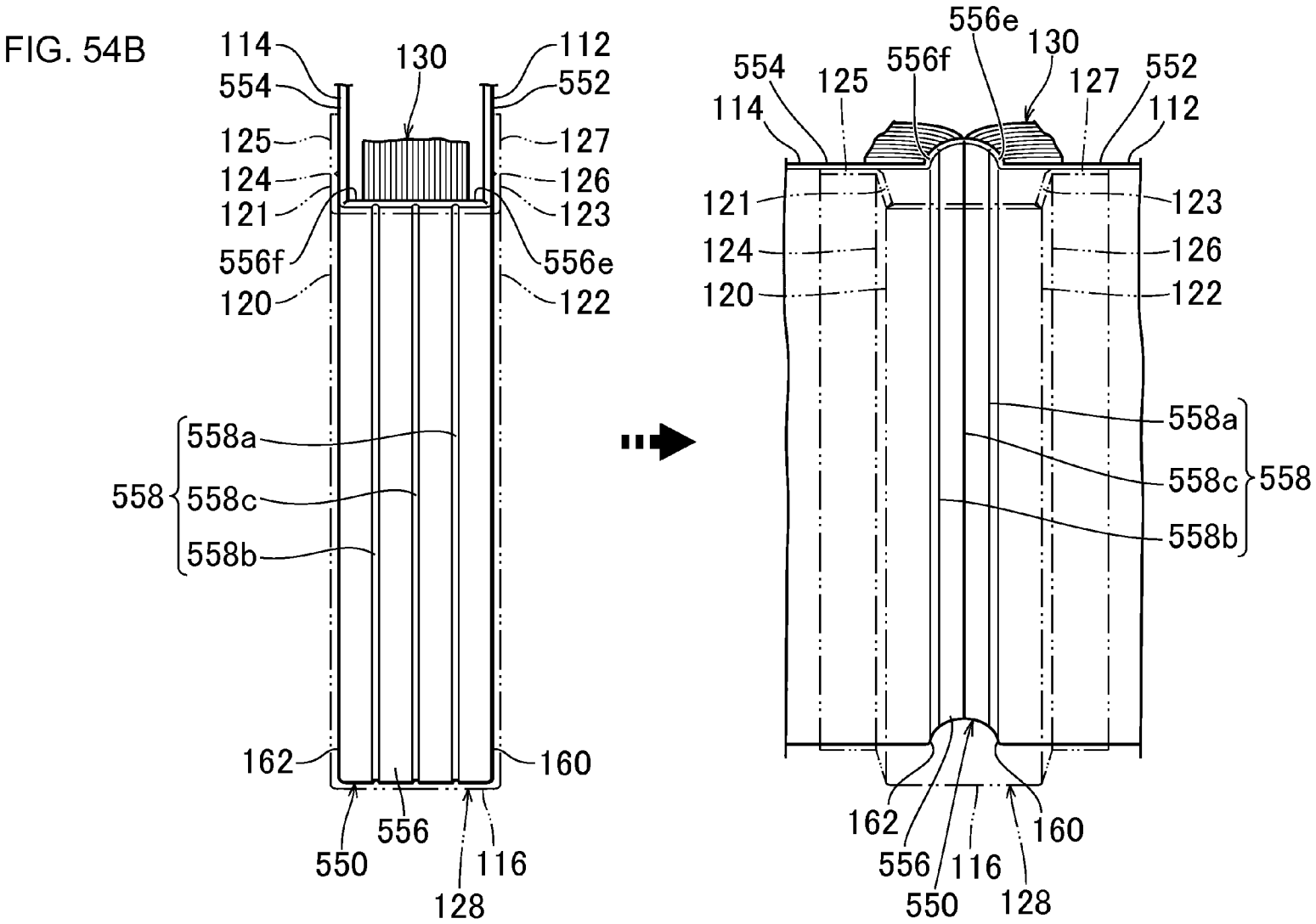
FIG. 54B is a schematic bottom view of the vicinity of the curved retaining portion showing an operating state of the curved retaining portion.
Figure 55:
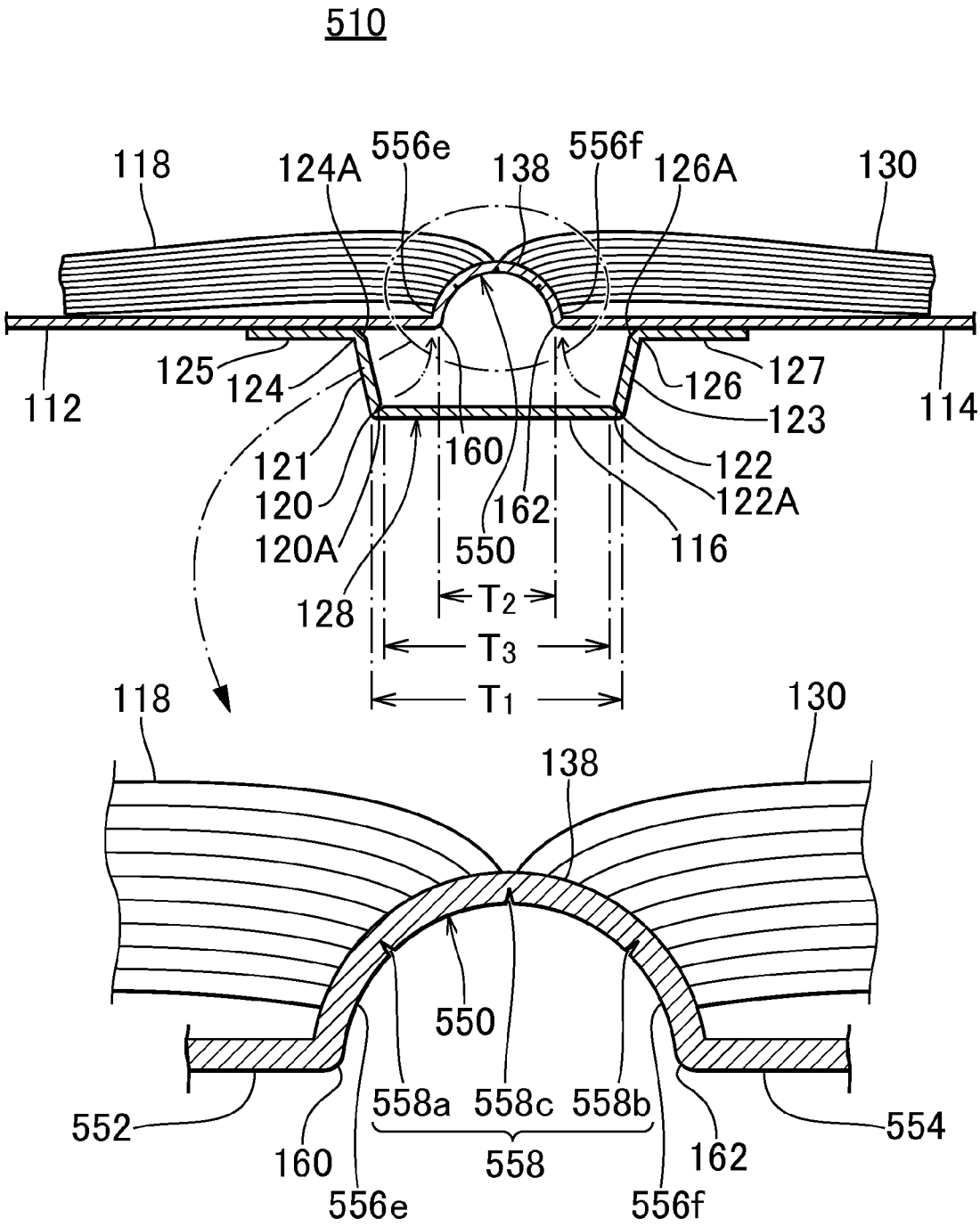
FIG. 55 is a schematic transverse sectional view of the pocket file of FIG. 53 in an opened state.

The pocket file shown in FIG. 21 can be modified as shown in FIGS. 53 through 55.

A file 510 preferably includes a curved subsidiary portion which fixes the back of the cover body in a desired shape in regions on a front cover side and on a back cover side of the spine portion 116 between the front cover portion 112 and the back cover portion 114 and the curved retaining portion configured to curve the end edge of the group of pocket sheets 130 toward the direction of the pocket sheet 118 as the binding sheet extend at the inner side of the spine portion 116 provided between the front cover portion 112 and the back cover portion 114 when the cover is opened.

In this modified example, the curved subsidiary portion is preferably an independent curved subsidiary member 128 that is substantially equivalent to the pocket file shown in FIG. 21.

A curved retaining portion 550 is connected adjacent to the outer side of the hinge portion on the front cover side 160 and the outer side of the hinge portion on the back cover side 162 and is spaced from the group of the pocket sheets 130 in such that the curved retaining portion 550 enables the end edge connected to the cover of the group of pocket sheet 130 to curve with the width less than the width of the spine portion 116 of the cover body.

The curved retaining portion 550 preferably includes the connecting portion on a front cover side 552 provided on the side of the front cover portion 112, the connecting portion on a back cover side 554 provided on the side of the back cover portion 114, and an interjacent connecting portion 556 interposed between the connecting portion on the front cover side 552 and the connecting portion on the back cover portion 554. The interjacent connecting portion 556 is connected to the end edge of the group of pocket sheets 130 connected to the cover and is configured to curve away from the spine portion 116 along with the end edge connected to the cover of the group of the pocket sheets 130 by the tension of the connecting portion on the front cover side 552 and the connecting portion on the back cover side 554 when the cover is opened.

The curved retaining portion 550 is relatively flexible and is configured to arch toward the side of the pocket sheet 118 as the binding sheet extends, i.e. away from the spine portion 116, by the weight of the pocket sheet 118 being in a spread state.

The interjacent connecting portion 556 of the curved retaining portion 550 is preferably made of a thermoplastic synthetic resin sheet body, such as polypropylene or other suitable material, for example, in a substantially square planar shape and includes a hinge slot 558 in the region connected to the group of pocket sheets 130 and is configured so as to curve.

The interjacent connecting portion 556 of the curved retaining portion 550 preferably includes a plurality of the hinge slots 558 on the side of the spine portion 116 which are spaced from one another so as to provide flexibility thereto. In this preferred embodiment, 3 narrow slots are provided, a front hinge slot 558*a*, a back hinge slot 558*b*, and a middle hinge slot 558*c*.

The connecting body 550 includes the substantially parallel spaced hinge slots 558 extending from the top edge to the bottom edge to provide flexibility and which are arranged to curve toward the opposite side of the back cover portion 116 when the pocket sheet 118 is opened. It differs from the preferred embodiment shown in FIG. 2 in this respect.

On the curved retaining portion 550, the hinge portion on the front cover side 160 provided between the connecting portion on the front cover side 552 and the interjacent connecting portion 556 and the hinge portion on the back cover side 162 provided between the connecting portion on the back cover side 554 and the interjacent connecting portion 556 are preferably parallel or substantially parallel to each other.

On the interjacent connecting portion 556, a longitudinal bridge portion 556*e* is provided adjacent to the hinge portion on the front cover side 160 so as to extend from the top edge to the bottom edge of the interjacent connecting portion 556 and a longitudinal bridge portion 556*f* is provided adjacent to the hinge portion on the back cover side 162 so as to extend from the top edge to the bottom edge of the interjacent portion 556.

The distance between the spine portion 116 and the front folding portion 124 of the front cover portion 112 and the back folding portion 126 of the back cover portion 114, respectively, is preferably substantially equal to or less than the distance between the hinge portion on the front cover side 160 of the curved retaining portion 550 and the inner surface of the front cover portion 112 and the hinge portion on the back cover side 162 and the inner surface of the back cover portion 114. The hinge portion in the front cover side 160 and the hinge portion on the back cover side 162 are arranged to be positioned adjacent to the end edge of the spine portion 116 when the cover body is closed.

The interjacent connecting portion 556 between the hinge portion on the front cover side 160 and the hinge portion on the back cover side 162 is configured to curve away from the spine portion 116 when the front cover portion 112 is opened and the width between the hinge portion on the front cover side 160 and the hinge portion on the back cover side 162 is preferably less than the width of the spine portion 116.

Figure 56:
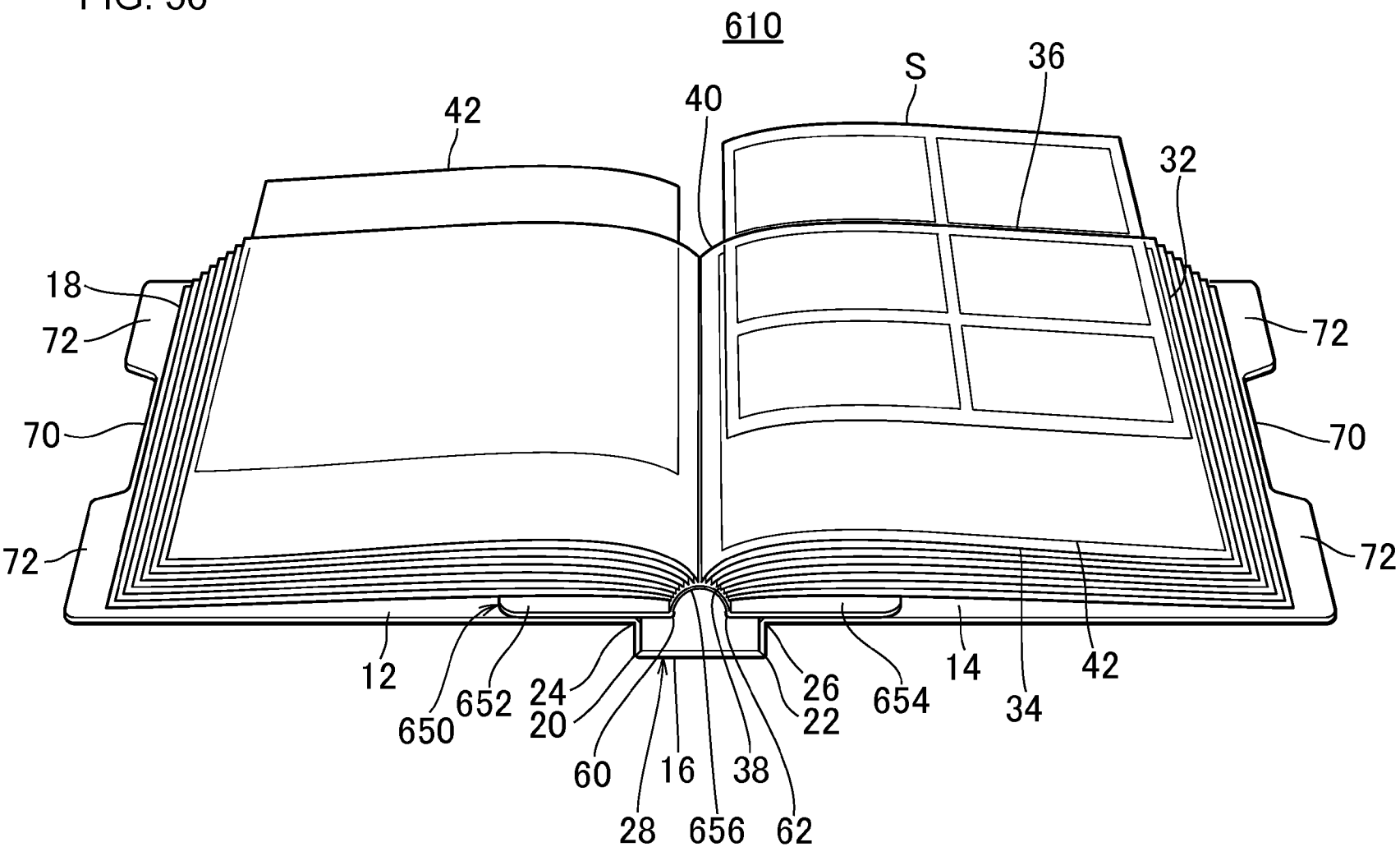
FIG. 56 is a schematic perspective view of the pocket file as a modified example of the pocket file according to the preferred embodiment of the present invention shown in FIG. 1.
Figure 57A:
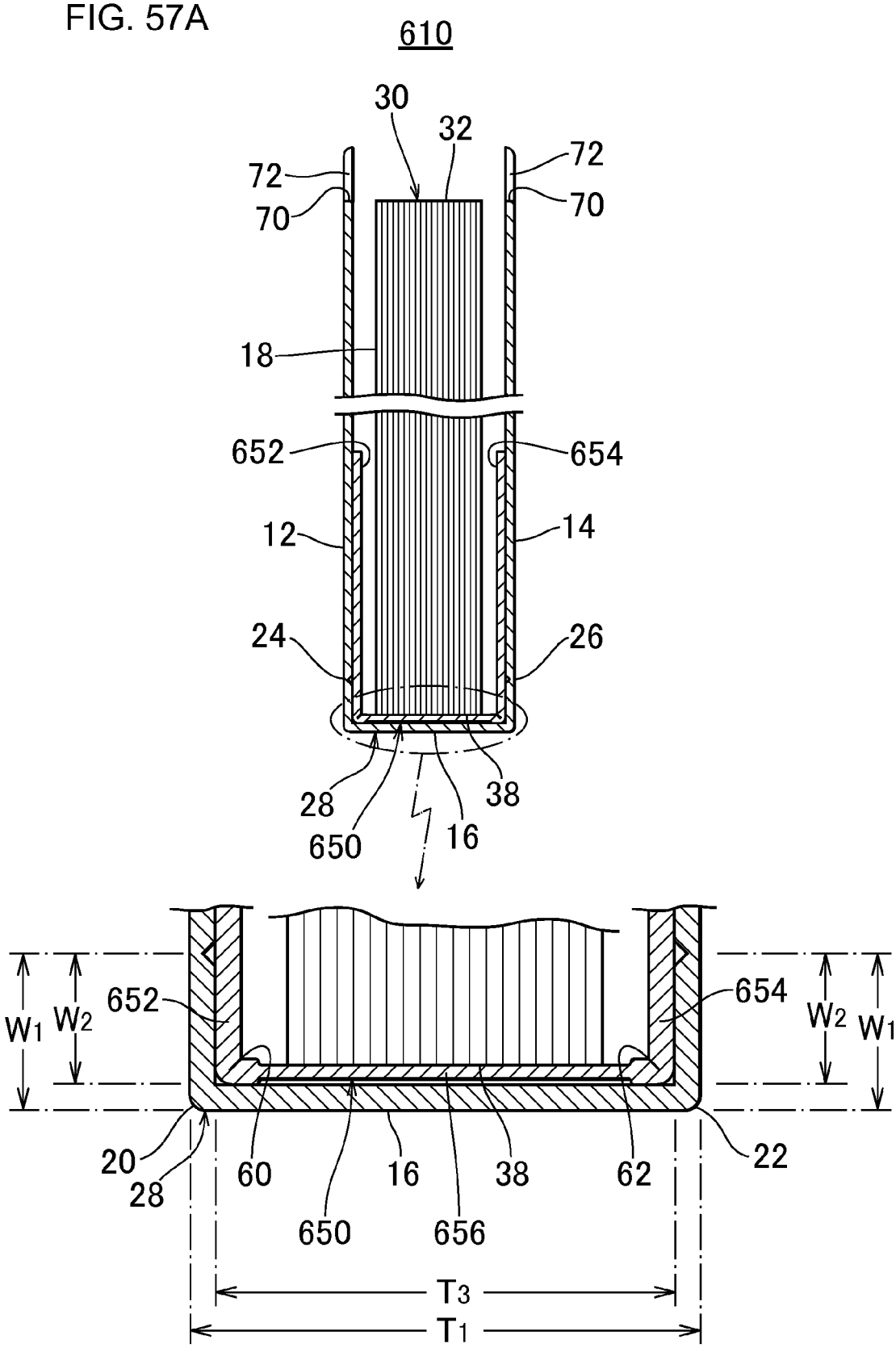
FIG. 57A is a schematic transverse sectional view of the pocket file of FIG. 56 in an opened state.
Figure 57B:
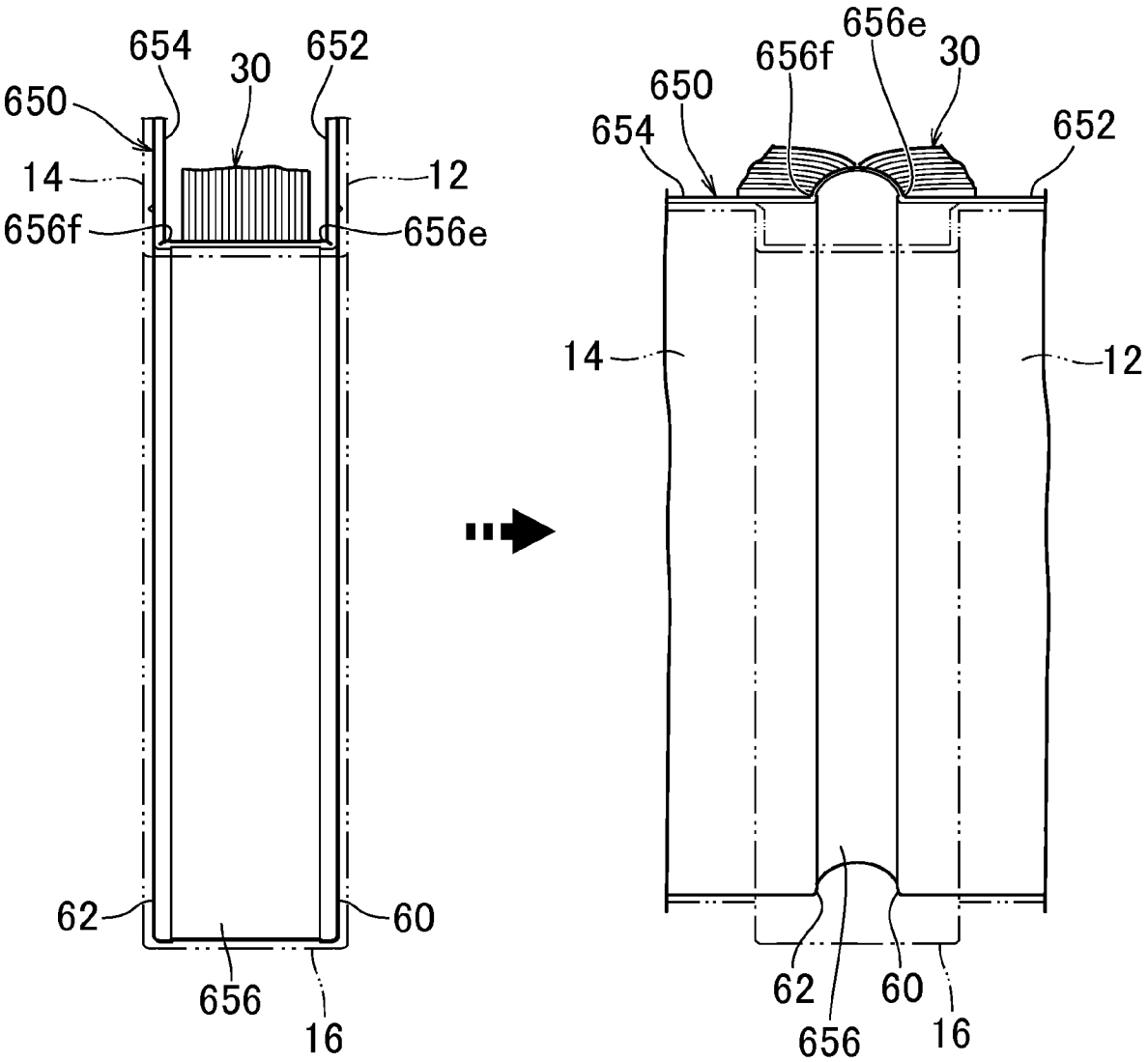
FIG. 57B is a schematic bottom view of the vicinity of the curved retaining portion showing an operating state of the curved retaining portion.
Figure 58:
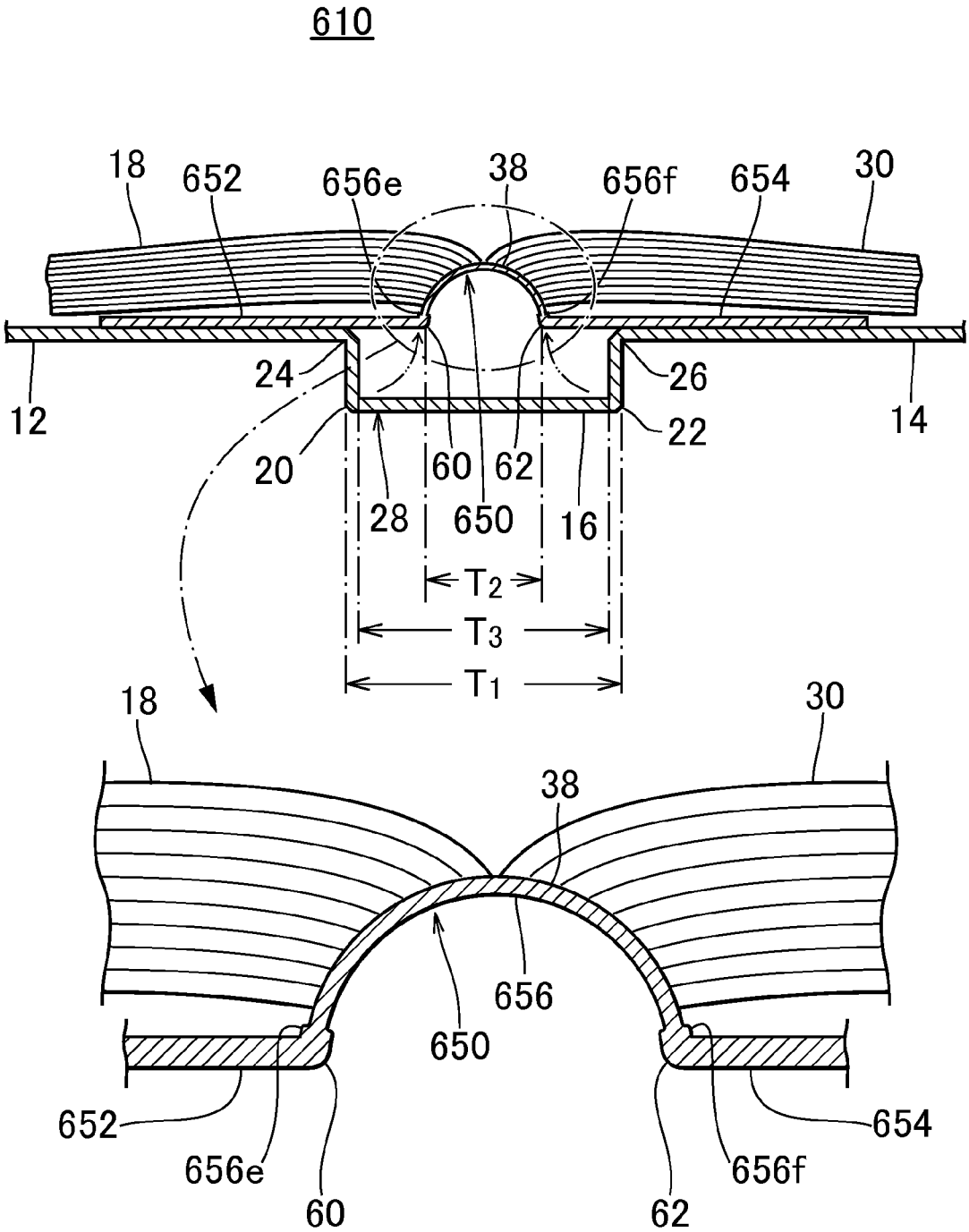
FIG. 58 is a schematic transverse sectional view of the pocket file of FIG. 56 in an opened state.

Further, the pocket file shown in FIG. 1 can be modified as shown in FIGS. 56 through 58.

A file 610 includes a curved retaining portion configured to curve the end edge of the group of pocket sheets 30 toward the side of the pocket sheet 18 extending at the inner side of the spine portion 16 provided between the front cover portion 12 and the back cover portion 14 when the cover is opened and also includes a curved subsidiary portion which fixes the back of the cover body in a desired configuration in a region on a front cover side and a region on a back cover side of the spine portion 16 between the front cover portion 12 and the back cover portion 14.

As shown in FIGS. 56 through 58, the front folding portion 24 and the back folding portion 26 extending from the top edge to the bottom edge are provided adjacent to the front connecting portion 20 and the back connecting portion 22 of the front cover portion 12, the back cover portion 14 and the spine portion 16, and the grip portion 28 is provided in the region from the front folding portion 24 on the front cover portion 12 to the spine portion 16, the region from the back folding portion 26 on the back cover portion 14 to the spine portion 16, and the spine portion 16.

In the grip portion 28, the connecting portion on a front cover side 652 including the front folding portion 24 as an axis moves upwardly in the region on the spine portion 16 on the front cover side between the front cover portion 12 and the back cover portion 14, and the connecting portion on a back cover side 654 including the back folding portion 26 as an axis moves upwardly and the grip portion 28 defines the curved subsidiary portion which enables a connecting portion 650 as a curved subsidiary portion to arch toward the direction of the pocket sheet 18 as the binding sheet extends, i.e. in the direction away from the spine portion 16, when the front cover portion 12 and the back cover portion 14 are substantially horizontal, and the grip portion 28 is substantially parallel to the horizontal spine portion 16.

On the front cover portion 12 and the back cover portion 14, the front folding portion 24 and the back folding portion 26 are parallel or substantially parallel to the front adjacently providing portion 20 and the back adjacently providing portion 22 in the direction of their heights from the top edge to the bottom edge thereof adjacent to the front adjacently providing portion 20 and the back adjacently providing portion 22.

The length of the inner face of the spine portion 16 and the front folding portion 24 and the length of the inner face of the spine portion 16 and the back folding portion 26 are preferably substantially equal (shown in FIG. 57A).

The mount 42 is arranged such that the front folding portion 24 and the back folding portion 26 are not adjacent to the mount 42.

The group of pocket sheets 30 is connected by the end edge connected thereto and the connecting portion 650 connecting the front cover portion 12 and the back cover portion 14.

The connecting body 650 is preferably defined by a substantially square rigid plate body when viewed in a planar view made of thermoplastic synthetic resin and includes the curved retaining portion which curves the group of pocket sheets 30, which are welded and connected at the connecting end edge of the group of pocket sheets 30, toward the direction of the pocket sheet 18 as the binding body extends.

The connecting body 650 is connected adjacent to the front folding portion 24 of the front cover portion 12 and the back folding portion 26 of the back cover portion 14 and is spaced from the group of the pocket sheets 30 such that the connecting body 650 enables the end edge connected to the cover of the group of pocket sheet 30 to curve with the width less than the width of the spine portion 16 of the cover body.

The connecting body 650 includes the connecting portion on the front cover side 652 connected to the side of the front cover portion 12, the connecting portion on the back cover side 654 connected to the side of the back cover portion 14, and an interjacent connecting portion 656 interposed between the connecting portion on the front cover side 652 and the connecting portion on the back cover side 654. The interjacent connecting portion 656 is connected to the end edge connected to the cover of the group of pocket sheets 30 and is configured to curve away from the spine portion 16 along with the end edge connected to the cover of the group of the pocket sheets 30 by the tension of the connecting portion on the front cover side 652 and the connecting portion on the back cover side 654 when the cover is opened.

The interjacent connecting portion 656 of the connecting body 650 preferably has a thickness less than the connecting portion on the front cover side 652 and the connecting portion on the back cover side 654 so that the interjacent connecting portion 656 has flexibility and is arranged to arch toward the side of the pocket sheet 18 as the binding sheet extends, i.e. away from the spine portion 16, by the weight of the pocket sheet 18 being in a spread state.

In this preferred embodiment, a plastically deformed region, which includes the connecting body 650, including the interjacent connecting portion 656 made of a synthetic resin sheet body having substantially uniform thickness is formed by hot press. By decreasing the thickness thereof, flexibility is provided.

On the connecting body 650, the hinge portion on the front cover side 60 provided between the connecting portion on the front cover side 652 and the interjacent connecting portion 656 and the hinge portion on the back cover side 62 provided between the connecting portion on the back cover side 654 and the interjacent connecting portion 656 are parallel or substantially parallel to each other.

On the interjacent connecting portion 656, a longitudinal bridge portion 656*e* is provided adjacent to the hinge portion on the front cover side 60 so as to extend from the top edge to the bottom edge of the interjacent connecting portion 656 and a longitudinal bridge portion 656*f* is provided adjacent to the hinge portion on the back cover side 62 so as to extend from the top edge to the bottom edge of the interjacent portion 656.

In this preferred embodiment, the longitudinal bridge portions 656*e* and 656*f* preferably have substantially the same thickness as the connecting portion on the front cover side 652 and the connecting portion on the back cover side 654 and the portion between the longitudinal bridge portions 656*e* and 656*f* preferably have a decreased thickness as described above.

The distance between the spine portion 16 and the front folding portion 24 of the front cover portion 12 and the back folding portion 26 of the back cover portion 14 respectively is preferably substantially equal to or less than the distance between the hinge portion on the front cover side 60 of the connecting body 650 and the inner surface of the front cover portion 12 and between the hinge portion on the back cover side 62 and the inner surface of the back cover portion 14. The hinge portion in the front cover side 60 and the hinge portion on the back cover side 62 are positioned adjacent to the end edge of the spine portion 16 when the cover is closed.

The interjacent connecting portion 656 between the hinge portion on the front cover side 60 and the hinge portion on the back cover side 62 is configured to curve away from the spine portion 16 and the width between the hinge portion on the front cover side 60 and the hinge portion on the back cover side 62 is less than the width of the spine portion 16 when the front cover portion 12 is opened.

Figure 59:
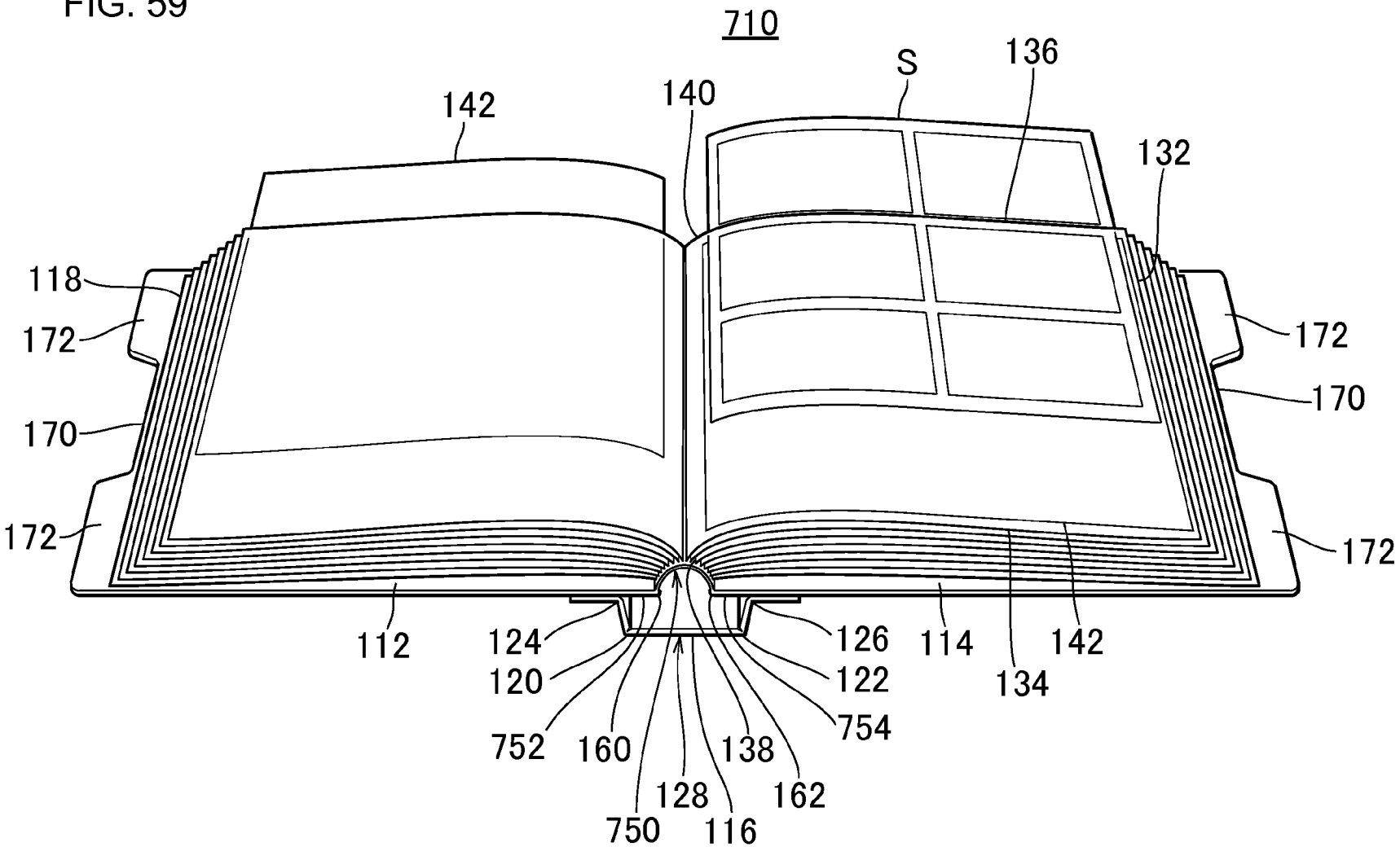
FIG. 59 is a schematic perspective view of the pocket file as a modified example of the pocket file according to the preferred embodiment of the present invention FIG. 21.
Figure 60A:
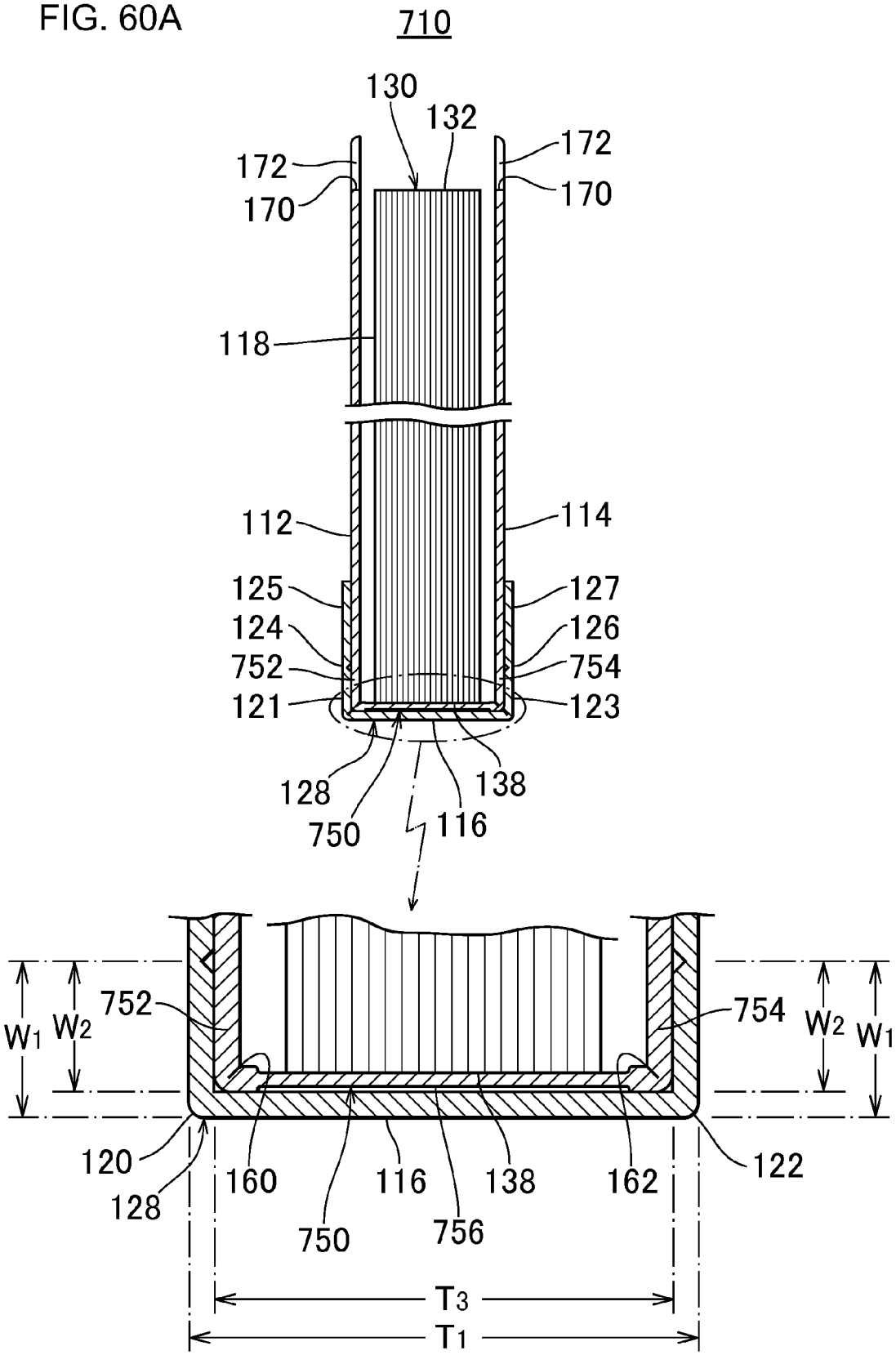
FIG. 60A is a schematic transverse sectional view of the pocket file of FIG. 59 in a close state.
Figure 60B:
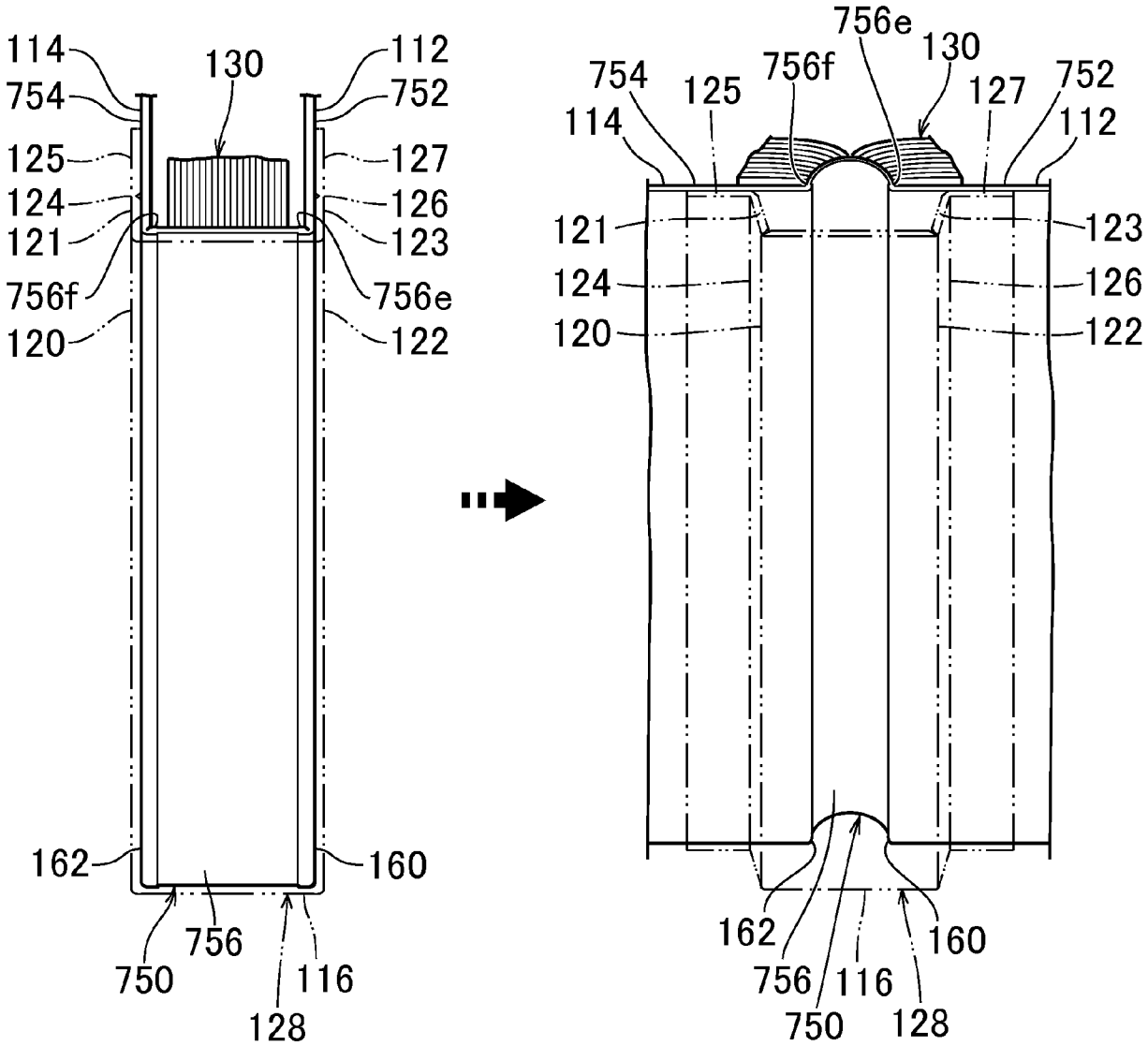
FIG. 60B is a schematic bottom view of the vicinity of the curved retaining portion showing an operating state of the curved retaining portion.
Figure 61:
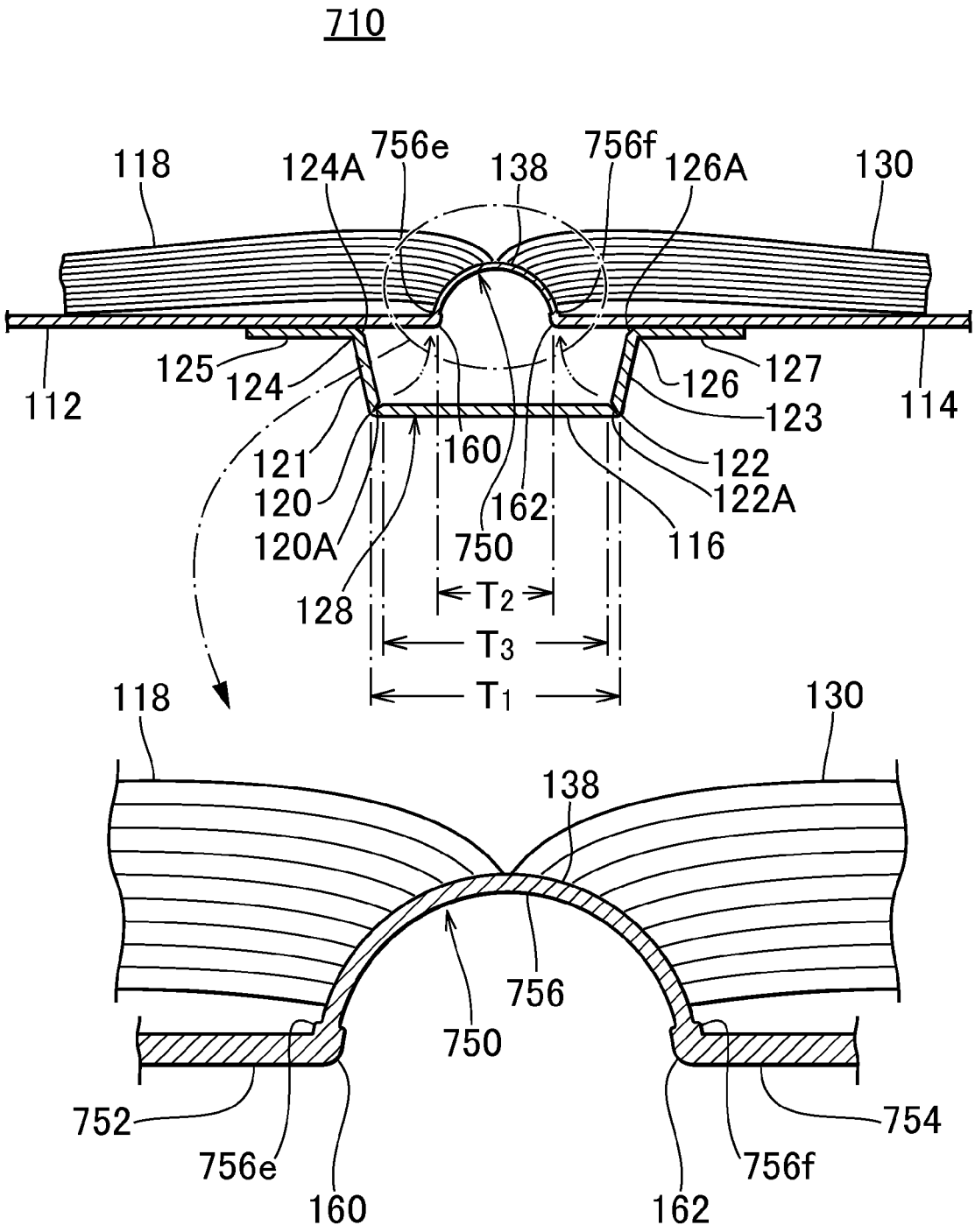
FIG. 61 is a schematic transverse sectional view of the pocket file of 59 in an opened state.

The pocket file shown in FIG. 21 can be modified as shown in FIGS. 59 through 61.

A file 710 includes a curved subsidiary portion which fixes the back of the cover body in a desired configuration in regions on a front cover side and on a back cover side of the spine portion 116 between the front cover portion 112 and the back cover portion 114 and the curved retaining portion arranged to curve the end edge of the group of pocket sheets 130 toward the direction of the pocket sheet 118 extending at the inner side of the spine portion 116 provided between the front cover portion 112 and the back cover portion 114 when the cover body is opened. In this modified example, the curved subsidiary portion is preferably an independent curved subsidiary member 128 that is equivalent to the pocket file shown in FIG. 21.

A curved retaining portion 750 is connected adjacent to the inner side of the hinge portion on the front cover side 160 and the inner side of the hinge portion on the back cover side 162 and is spaced from the group of the pocket sheets 130 such that the curved retaining portion 750 enables the end edge connected to the cover of the group of pocket sheet 130 to curve with the width less than the width of the spine portion 116 of the cover body.

The curved retaining portion 750 includes a connecting portion on a front cover side 752 provided in the side of the front cover portion 112, a connecting portion on a back cover side 754 provided in the side of the back cover portion 114, and an interjacent connecting portion 756 provided between the connecting portion on the front cover side 752 and the connecting portion on the back cover portion 754. The interjacent connecting portion 756 is connected to the end edge connected to the cover of the group of pocket sheets 130 and is configured to curve away from the spine portion 116 along with the end edge connected to the cover of the group of the pocket sheets 130 by the tension of the connecting portion on the front cover side 752 and the connecting portion on the back cover side 754 when the cover is opened.

The curved retaining portion 750 is relatively flexible and is arranged to arch in a direction away from the spine portion 116 by the weight of the pocket sheet 118 being in a spread state.

The curved retaining portion 750 is made of a thermoplastic synthetic resin sheet body having a substantially square planar shape having a uniform thickness and is configured to curve by decreasing the thickness of the region connected to the group of pocket sheets 130 so that flexibility is provided.

In this preferred embodiment, a plastically deformed region, which includes the connecting body 750, including the interjacent connecting portion 756 made of a synthetic resin sheet body having a uniform thickness is formed by hot press. By decreasing the thickness thereof, flexibility is improved.

The curved retaining portion 750 is arranged to arch toward the side of the pocket sheet 118 as the binding sheet extends, i.e. away from the spine portion 116, by the weight of the pocket sheet 118 being in a spread state.

On the curved retaining portion 750, the hinge portion on the front cover side 160 provided between the connecting portion on the front cover side 752 and the interjacent connecting portion 756 and the hinge portion on the back cover side 162 provided between the connecting portion on the back cover side 754 and the interjacent connecting portion 756 are parallel or substantially parallel to each other.

On the interjacent connecting portion 756, a longitudinal bridge portion 756*e* is provided adjacent to the hinge portion on the front cover side 160 so as to extend from the top edge to the bottom edge of the interjacent connecting portion 756 and a longitudinal bridge portion 756*f* is provided adjacent to the hinge portion on the back cover side 162 so as to extend from the top edge to the bottom edge of the interjacent portion 756.

In this preferred embodiment, the longitudinal bridge portions 756*e* and 756*f* have the substantially the same thickness as the connecting portion on the front cover side 752 and the connecting portion on the back cover side 754 and the portion between the longitudinal bridge portions 756*e* and 756*f* have a decreased thickness.

The distance between the spine portion 116 and the front folding portion 124 of the front cover portion 112 and the back folding portion 26 of the back cover portion 114, respectively, is preferably substantially equal to or less than the distance between the hinge portion on the front cover side 160 of the curved retaining portion 750 and the inner surface of the front cover portion 112 and between the hinge portion on the back cover side 162 and the inner surface of the back cover portion 114. The hinge portion in the front cover side 160 and the hinge portion on the back cover side 162 are positioned adjacent to the end edge of the spine portion 116 when the cover body is closed.

The interjacent connecting portion 756 between the hinge portion on the front cover side 160 and the hinge portion on the back cover side 162 is configured to curve away from the spine portion 116 and the width between the hinge portion on the front cover side 160 and the hinge portion on the back cover side 162 is less than the width of the spine portion 116 when the front cover portion 112 is opened.

Figure 62:
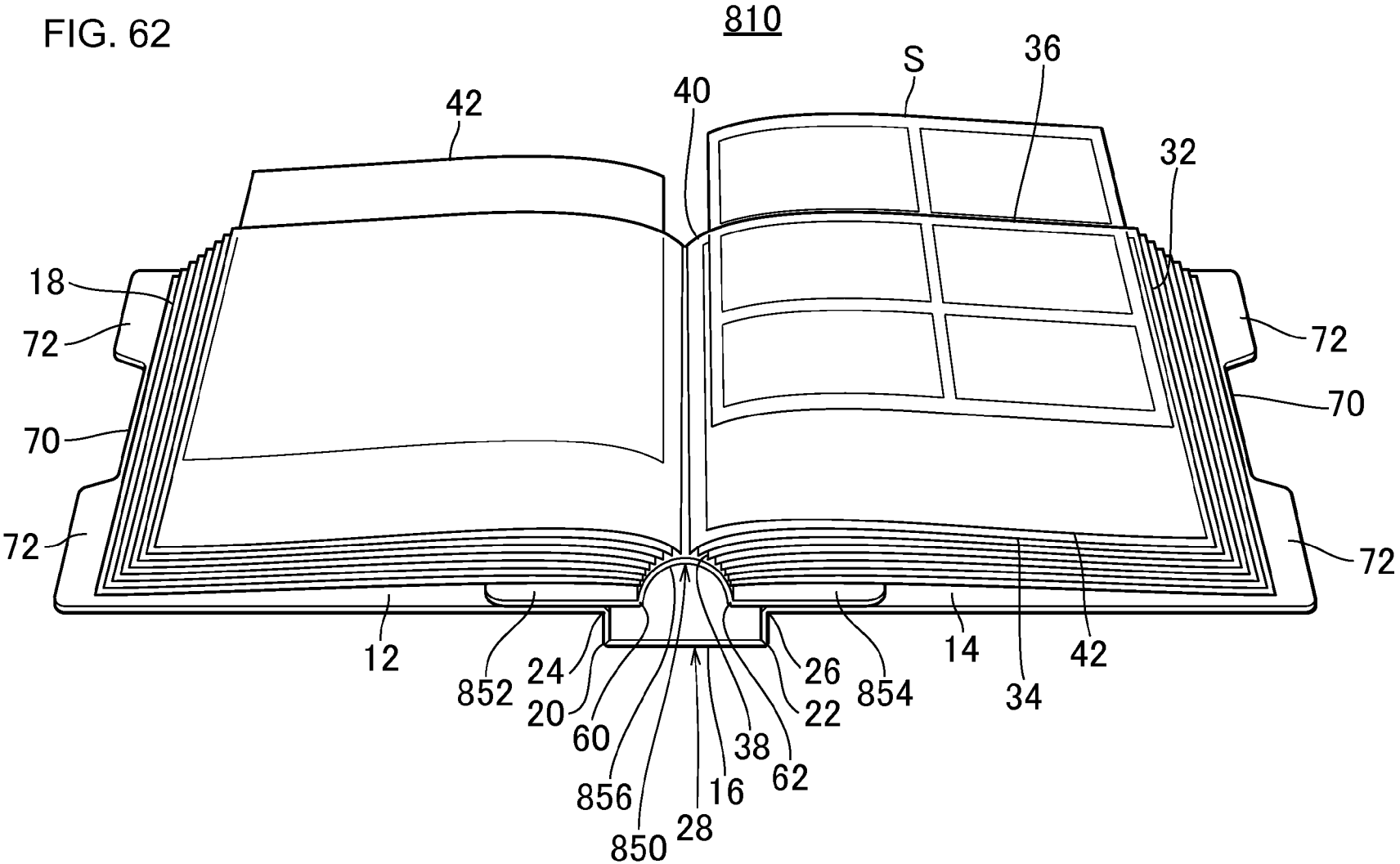
FIG. 62 is a schematic perspective view of the pocket file as a modified example of the pocket file according to the preferred embodiment of the present invention shown in FIG. 35.
Figure 63:
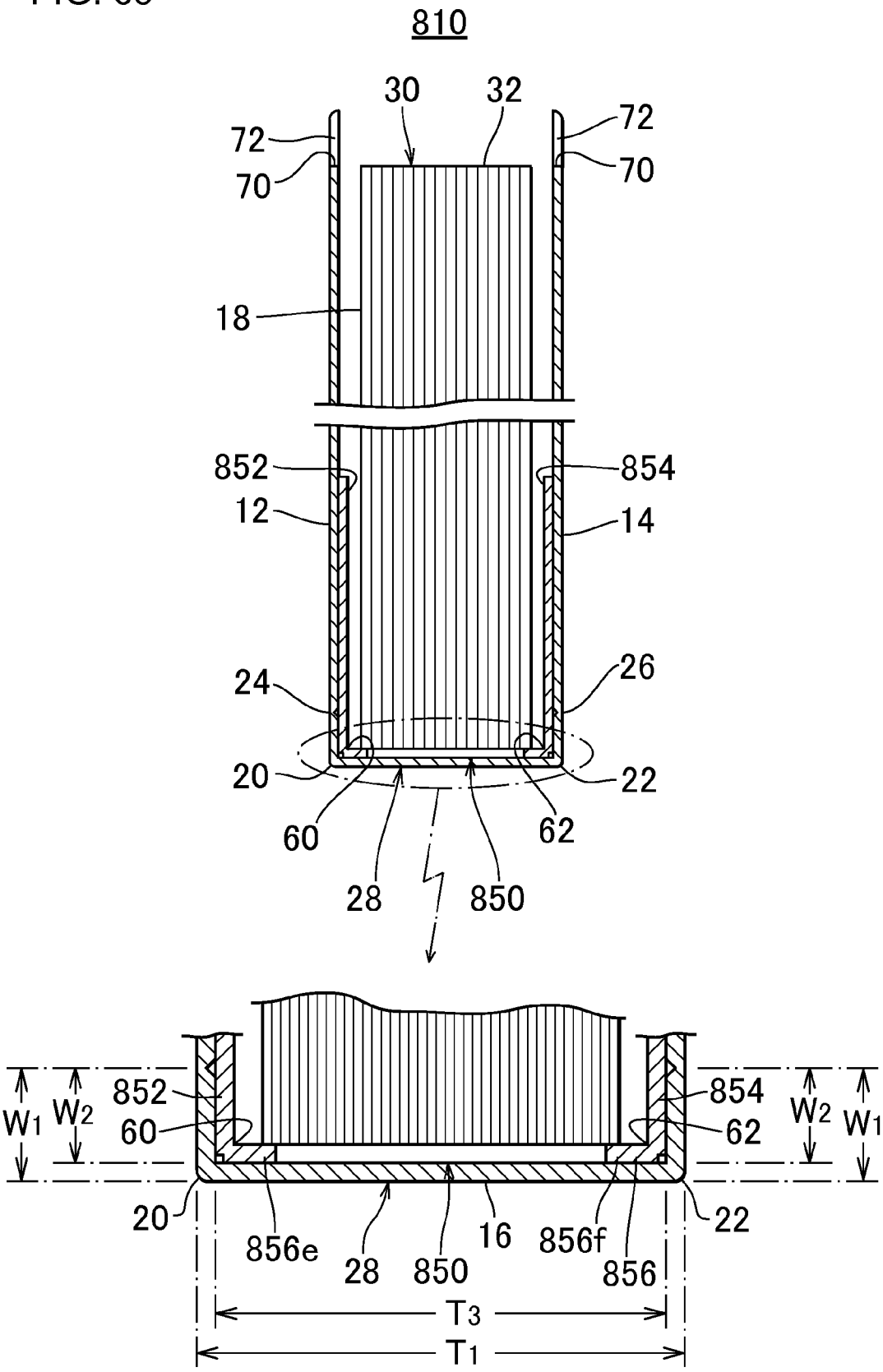
FIG. 63 is a schematic transverse sectional view of the pocket file of FIG. 62 in a closed state.
Figure 64:
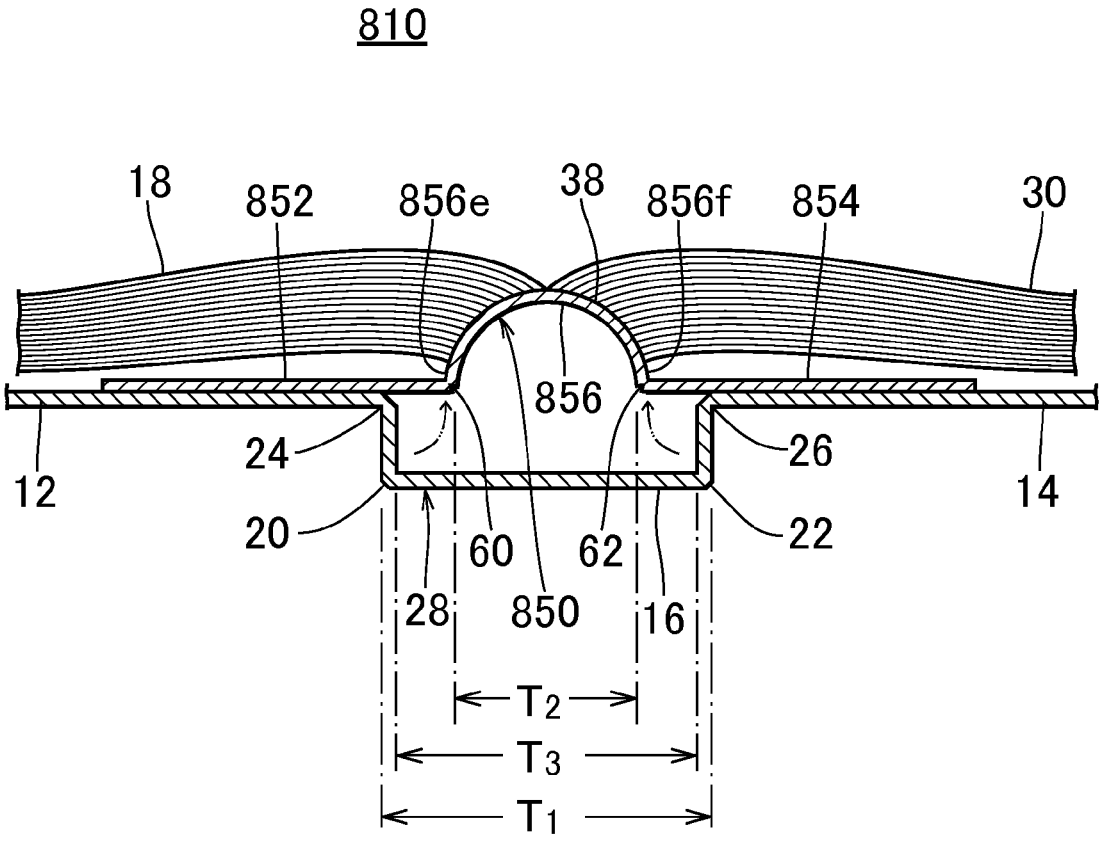
FIG. 64 is a schematic transverse sectional view of the pocket file of FIG. 62 in an opened state.
Figure 65:
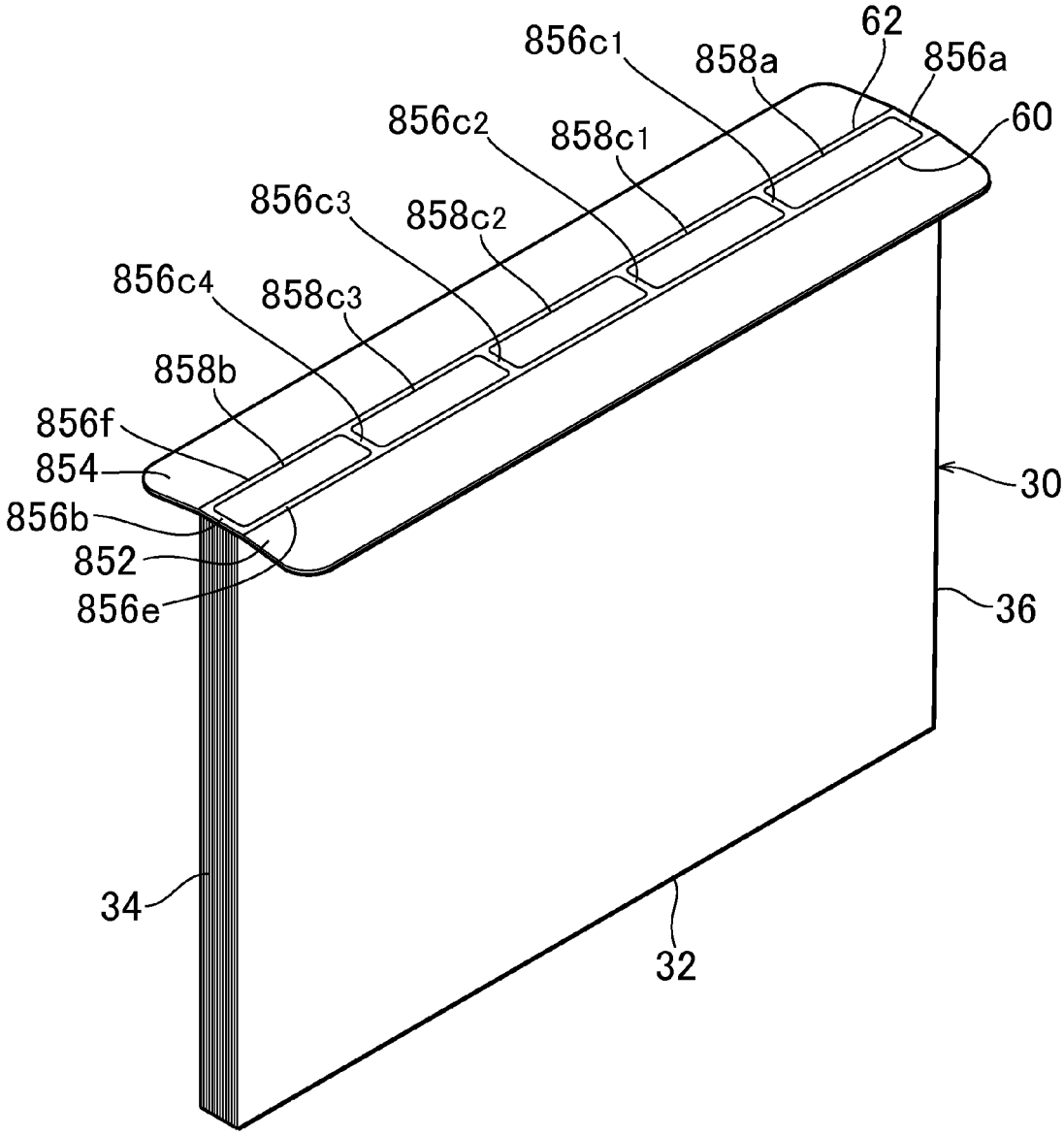
FIG. 65 is a schematic perspective view of the method of manufacturing the file according to the modified example shown in FIG. 62.
Figure 66:
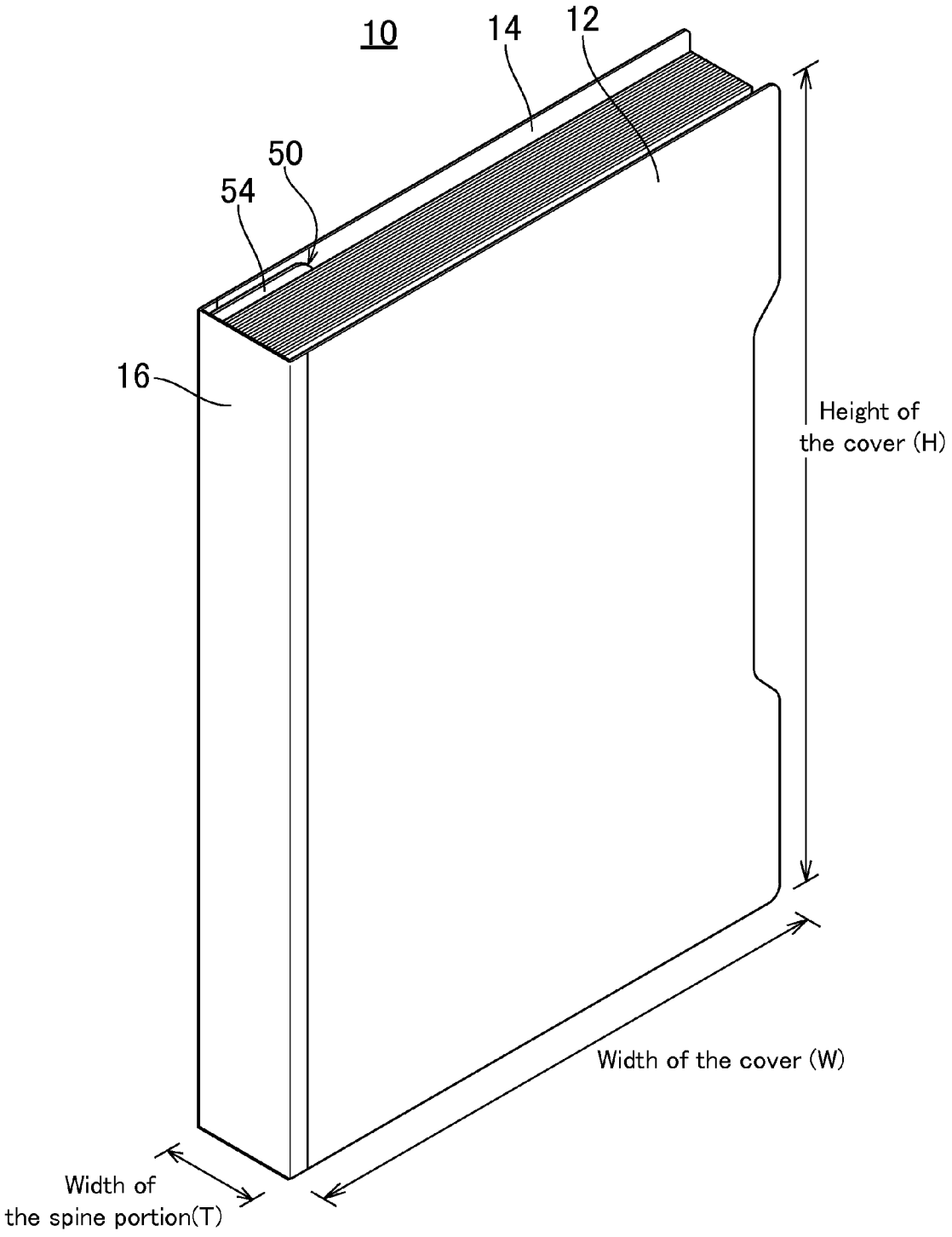
FIG. 66 is an illustration of the file according to a preferred embodiment of the present invention.

The pocket file shown in FIG. 1 can be modified as shown in FIGS. 62 through 64.

A file 810 includes a curved retaining portion configured to curve the end edge of the group of pocket sheets 30 toward the side of the pocket sheet 18 extending at the inner side of the spine portion 16 provided between the front cover portion 12 and the back cover portion 14 when the cover is opened and also includes a curved subsidiary portion which fixes the back of the cover body in a desired configuration in a region on a front cover side and a region on a back cover side of the spine portion 16 between the front cover portion 12 and the back cover portion 14.

As shown in FIGS. 62 through 64, the front folding portion 24 and the back folding portion 26 extending from the top edge to the bottom edge are arranged adjacent to the front connecting portion 20 and the back connecting portion 22 of the front cover portion 12, the back cover portion 14 and the spine portion 16, and the grip portion 28 is provided in the region from the front folding portion 24 on the front cover portion 12 to the spine portion 16, the region from the back folding portion 26 on the back cover portion 14 to the spine portion 16, and the spine portion 16.

In the grip portion 28, the connecting portion on a front cover side 852 including the front folding portion 24 as an axis moves upwardly in the region on the spine portion 16 on the front cover side between the front cover portion 12 and the back cover portion 14, and the connecting portion on a back cover side 854 including the back folding portion 26 as an axis moves upwardly and the grip portion 28 defines the curved subsidiary portion which enables a connecting portion 850 as a curved subsidiary portion to arch toward the direction of the pocket sheet 18 as the binding sheet extends, i.e. in the direction away from the spine portion 16, when the front cover portion 12 and the back cover portion 14 is substantially horizontal, and the grip portion 28 is substantially parallel to the horizontal spine portion 16.

On the front cover portion 12 and the back cover portion 14, the front folding portion 24 and the back folding portion 26 are parallel or substantially parallel to the front adjacently providing portion 20 and the back adjacently providing portion 22 in the direction of their heights from the top edge to the bottom edge thereof adjacent to the front adjacently providing portion 20 and the back adjacently providing portion 22.

The length of the inner surface of the spine portion 16 and the front folding portion 24 and the length of the inner surface of the spine portion 16 and the back folding portion 26 are preferably substantially equal (shown in FIG. 63).

The mount 42 is arranged such that the front folding portion 24 and the back folding portion 26 are not adjacent to the mount 42.

The group of pocket sheets 30 is connected by the end edge connected thereto and the connecting portion 850 connecting the front cover portion 12 and the back cover portion 14.

The connecting body 850 is defined by a substantially square rigid plate body when in a planar view made of thermoplastic synthetic resin and includes the curved retaining portion which curves the group of pocket sheets 30, which are welded and connected at the connecting end edge of the group of pocket sheets 30, toward the direction of the pocket sheet 18 as the binding body extends.

The connecting body 850 is connected adjacent to the front folding portion 24 of the front cover portion 12 and the back folding portion 26 of the back cover portion 14 and is spaced from the group of the pocket sheets 30 such that the connecting body 650 enables the end edge connected to the cover of the group of pocket sheet 30 to curve with the width less than the width of the spine portion 16 of the cover body.

The connecting body 850 includes the connecting portion on the front cover side 852 connected to the side of the front cover portion 12, the connecting portion on the back cover side 854 connected to the side of the back cover portion 14, and an interjacent connecting portion 856 interposed between the connecting portion on the front cover side 852 and the connecting portion on the back cover side 854. The interjacent connecting portion 856 is connected to the end edge connected to the cover of the group of pocket sheets 30 and is configured to curve away from the spine portion 16 along with the end edge connected to the cover of the group of the pocket sheets 30 by the tension of the connecting portion on the front cover side 852 and the connecting portion on the back cover side 854 when the cover is opened.

The interjacent connecting portion 856 is relatively flexible and is arranged to arch toward the side of the pocket sheet 18 as the binding sheet extends, i.e. away from the spine portion 16, by the weight of the pocket sheet 18 being in a spread state.

The connecting body 850 includes a through hole 858 in the region connected to the binding body and is configured so as to curve.

The connecting body 850 includes a plurality of the rectangular planar shaped through holes 858 which are spaced from one another so as to provide flexibility thereto. In this preferred embodiment, 5 through holes are provided, an upper through hole 858*a*, a lower through hole 858*b*, middle through holes 858*c*1, 858*c*2 and 858*c*3.

In this preferred embodiment, in the interjacent connecting portion 856, bridge portions 856*a* and 856*b* extend between the connecting portion on the front cover side 852 and the connecting portion on the back cover side 854 at the upper edge and the lower edge, respectively. A bridge portion 856*c*1 is provided between the upper through hole 858*a* and the middle through hole 858*c*1 and a bridge portion 856*c*4 is provided between the middle through hole 858*c*3 and the lower through hole 858*b* and the bridge portion 856*c*4 is crosslinked in between the middle through hole 858*c*3 and the lower through hole 858*b*. Therefore, the adhesion region of the interjacent connecting portion 856 and the group of pocket sheets 30 is provided.

Further, a longitudinal bridge portion 856*e* is provided between the hinge portion on the front cover side 60 and the upper through hole 858*a*, the lower through hole 858*b* and the middle through holes 858*c*1, 858*c*2 and 858*c*3, and a longitudinal bridge portion 856*f* is provided between the hinge portion on the back cover side 62 and the upper through hole 858*a*, the lower through hole 858*b* and the middle through holes 858*c*1, 858*c*2 and 858*c*3.

On the connecting body 850, the hinge portion on the front cover side 60 provided between the connecting portion on the front cover side 852 and the interjacent connecting portion 856 and the hinge portion on the back cover side 62 provided between the connecting portion on the back cover side 854 and the interjacent connecting portion 856 are preferably parallel or substantially parallel to each other.

The distance between the spine portion 16 and the front folding portion 24 of the front cover portion 12 and the back folding portion 26 of the back cover portion 14 respectively is preferably substantially equal to or less than the distance between the hinge portion on the front cover side 60 of the connecting body 850 and the inner surface of the front cover portion 12 and between the hinge portion on the back cover side 62 and the inner surface of the back cover portion 14. The hinge portion in the front cover side 60 and the hinge portion on the back cover side 62 are positioned adjacent to the end edge of the spine portion 16 when the cover is closed.

The interjacent connecting portion 856 between the hinge portion on the front cover side 60 and the hinge portion on the back cover side 62 is configured to curve away from the spine portion 16 when the front cover portion 12 is opened and the width between the hinge portion on the front cover side 60 and the hinge portion on the back cover side 62 is preferably less than the width of the spine portion 16.

The connecting portion on the front cover side 852 and the interjacent connecting portion 856 providing the hinge portion on the front cover side 60 therebetween intersect at substantially right angles to retain the shape when a load is not applied and the connecting portion on the back cover side 854 and the interjacent connecting portion 856 providing the hinge portion on the back cover side 62 therebetween intersect at substantially right angles to retain the shape when a load is not applied. When the connecting portion on the front cover side 852 side or the connecting portion on the back cover side 854 side opens corresponding to when the front cover portion 12 or the back cover portion 14 is opened, a degree of the angle between the interjacent connecting portion 856 and the connecting portion on the front cover side 852 expands, and the angle between the interjacent connecting portion 856 and the connecting portion on the back cover side 854 expands. When the expansion of those angles is about 120 to 130 degrees, and the connecting portion 850 is lifted in the direction away from the spine portion 16 with the elasticity of the material used for the connecting portion 850 and the elasticity adjacent to the both ends of the hinge portion on the front cover side 60 and the hinge portion on the back cover side 62 of the both sides.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A file comprising:

a cover body including a front cover portion, a back cover portion, and a spine portion provided between the front cover portion and the back cover portion;

a binding body which is superimposed with a plurality of binding sheets superimposed on the binding body;

a curved retaining portion adhered or bonded to an end edge of the binding body such that the binding body extends therefrom and which is curved in a direction away from an inner side of the spine portion when the cover body is opened; and a curved subsidiary portion arranged to fix a back portion thereof in a desired configuration in a region on the spine portion, a region on a side of the front cover portion between a folding portion of the front cover portion and the spine portion, and a region on a side of the back cover portion between a folding portion of the back cover portion and the spine portion; wherein the binding body is provided adjacent to the curved retaining portion and has an arch-shape in a direction away from an inner side of the front cover portion and an inner side of the back cover portion extending from the inner side of the spine portion;

the curved retaining portion includes a hinge portion on a front cover side connected to the front cover portion, a hinge portion on a back cover side connected to the back cover portion, and an interjacent connecting portion interposed between the hinge portion on the front cover side and the hinge portion on the back cover side;

a distance between the folding portion of the front cover portion and the folding portion of the back cover portion and the spine portion is substantially equal to or less than a distance between the hinge portion on the front cover side of the connecting body curved retaining portion and the inner surface of the front cover portion and between the hinge portion on the back cover side and the inner surface of the back cover portion;

the hinge portion on the front cover side and the hinge portion on the back cover side are positioned adjacent to an end edge of the spine portion when the cover body is closed; and a region on the front cover side extending to the hinge portion on the front cover side and a region on the back cover side extending to the hinge portion on the back cover side intersect at substantial right angles with the interjacent connecting portion when a load is not applied and move the interjacent connecting portion in the direction away from the inner side of the spine portion as the direction in which the plurality of binding sheets extend so as to be lifted as a result of expanded angles between the interjacent connecting portion and the regions of the front cover side and the back cover side, a resiliency of a material from which the curved retaining portion is made, and an elasticity adjacent to the hinge portion on the front cover side and the hinge portion on the back cover side, which move on an opposite side of the spine portion and become narrower than the spine portion and are located on an inner side of the folding portion of the front cover side and the folding portion of the back cover side when the cover body is opened.

2. The file according to claim 1, wherein the curved retaining portion includes a front cover portion connected to the binding body between the front cover portion and the back cover portion of the cover body;

the cover body includes a hinge portion between the front cover portion and the back cover portion;

the binding body includes a group of pocket sheets and is arranged such that end edges of the group of pocket sheets connected to the cover body curve towards a side in which the plurality of binding sheets extends when opened the cover body is opened; and the curved subsidiary portion is spaced from the binding body and connected with a width less than a width of the spine portion at an outer side of the hinge portion of the front cover portion and the hinge portion of the back cover portion to enable the end edge of the binding body which is connected to the cover body to curve.

3. The file according to claim 1, wherein the plurality of binding sheets include pockets combined with thermoplastic resin sheets;

each of the plurality of binding sheets is hot-adhered to another of the plurality of binding sheets on an end edge thereof connected to the cover body; and the end edge connected to the cover body is arranged to curve inwardly when the plurality of binding sheets are opened.

4. A file comprising:

a cover body including a front cover portion, a back cover portion, and a spine portion provided between the front cover portion and the back cover portion;

a binding body which is superimposed with a plurality of binding sheets superimposed on the binding body;

a curved retaining portion adhered or bonded to an end edge of the binding body such that the binding body extends therefrom and which is curved in a direction away from an inner side of the spine portion when the cover body is opened; and a curved subsidiary portion arranged to fix a back portion thereof in a desired configuration in a region on a side of the front cover portion between a folding portion of the front cover portion and the spine portion, and a region on a side of the back cover portion between the back cover portion and the spine portion; wherein the binding body is provided adjacent to the curved retaining portion and has an arch-shape in a direction away from an inner side of the front cover portion and an inner side of the back cover portion extending from the inner side of the spine portion;

the curved retaining portion includes an end edge connected to the binding body and a connecting body connected to the cover;

the connecting body includes a rigid plate body composed of a thermoplastic synthetic resin, a through hole drilled in a region connected to the binding body and is arranged to curve;

the connecting body includes a connecting portion on a front cover side connected to a side of the front cover portion, a connecting portion on a back cover side connected to a side of the back cover portion and an interjacent connecting portion interposed between the connecting portion on the front cover side and the connecting portion on the back cover side;

the curved retaining portion includes a hinge portion on the front cover side and a hinge portion on the back cover side that are positioned adjacent to an end edge of the spine portion when the cover body is closed;

the hinge portion on the front cover side and the hinge portion on the back cover side move on opposite sides of the spine portion, become narrower than the spine portion, are located on an inner side of the folding portion of the front cover side and an inner side of the folding portion of the back cover side when the cover body is opened, and move the interjacent connecting portion in the direction away from the inner side of the spine as a direction in which the plurality of binding sheets extend so as to be lifted as a result of expanded angles between the interjacent connecting portion and the region in the front cover portion and the region in the back cover portion, a resiliency of a material from which the curved retaining portion is made, and an elasticity adjacent to the hinge portion on the front cover side and the hinge portion on the back cover side.

5. The file according to claim 4, wherein the curved retaining portion includes a front cover portion connected to the binding body between the front cover portion and the back cover portion of the cover body;

the front cover portion includes a hinge portion between the front cover portion and the back cover portion;

the binding body includes a group of pocket sheets and is arranged such that end edges of the group of pocket sheets connected to the cover body curve towards a side in which the plurality of binding sheets extends when opened the cover body is opened; and the curved subsidiary portion is spaced from the binding body and connected with a width less than a width of the spine portion at an outer side of the hinge portion of the front cover portion and the hinge portion of the back cover portion to enable the end edge of the binding body which is connected to the cover body to curve.

6. The file according to claim 4, wherein the curved retaining portion includes an interjacent connecting portion interposed between the hinge portion on the front cover side and the hinge portion on the back cover side; and a region on the front cover side extending to the hinge portion on the front cover side and a region on the back cover side extending to the hinge portion on the back cover side intersect at substantial right angles with the interjacent connecting portion when a load is not applied and move the interjacent connecting portion in the direction away from the inner side of the spine portion as the direction in which the plurality of binding sheets extend so as to be lifted as a result of expanded angles between the interjacent connecting portion and the regions of the front cover side and the back cover side, a resiliency of a material from which the curved retaining portion is made, and an the elasticity adjacent to the hinge portion on the front cover side and the hinge portion on the back cover side, which move on the opposite side of the spine portion and becomes narrower than the spine portion and located on the inner side of the folding portion of the front cover side and the folding portion of the back cover side when opened the cover body is opened.

7. The file according to claim 4, wherein the plurality of binding sheets include pockets combined with thermoplastic resin sheets;

each of the plurality of binding sheets is hot-adhered to another of the plurality of binding sheets on an end edge thereof connected to the cover body; and the end edge connected to the cover body is arranged to curve inwardly when the plurality of binding sheets are opened.

8. A file comprising:

a cover body including a front cover portion, a back cover portion, and a spine portion provided between the front cover portion and the back cover portion;

a binding body which is superimposed with a plurality of binding sheets superimposed on the binding body;

a curved retaining portion adhered or bonded to an end edge of the binding body such that the binding body extends therefrom and which is curved in a direction away from an inner side of the spine portion when the cover body is opened; and a curved subsidiary portion arranged to fix a back portion thereof in a desired configuration in a region on a side of front cover portion between a folding portion of the front cover portion and the spine portion, and a region on a side of the back cover portion between a folding portion of the back cover portion and the spine portion; wherein the binding body is provided adjacent to the curved retaining portion and has an arch-shape in a direction away from an inner side of the of a front cover portion and an inner side of the back cover portion extending from the inner side of the spine portion;

the curved retaining portion includes an end edge connected to the binding body and a connecting body connected to the cover;

the connecting body includes a rigid plate body composed of a thermoplastic synthetic resin;

the connecting body includes a connecting portion on a front cover side connected to a side of the front cover portion, a connecting portion on a back cover side connected to a side of the back cover portion and an interjacent connecting portion interposed between the connecting portion on the front cover side and the connecting portion on the back cover side;

the interjacent connecting portion includes a through hole drilled in a region connected to the binding body and is formed to curve;

the interjacent connecting portion is positioned adjacent to the spine portion when the cover body is closed;

the binding body is arranged between the connecting portion on the front cover side and the connecting portion on the back cover side, moves on opposite sides of the spine portion, becomes narrower than the spine portion and is located on an inner side of the folding portion of the front cover side and the folding portion of the back cover side when the cover body is opened, and moves the interjacent connecting portion in the direction away from the inner side of the spine as a direction in which the plurality of binding sheets extend so as to be lifted as a result of expanded angles between the interjacent connecting portion and the region in the front cover portion and the region in the back cover portion, a resiliency of a material from which the curved retaining portion is made, and an elasticity adjacent to the hinge portion on the front cover side and the hinge portion on the back cover side.

9. The file according to claim 8, wherein the curved retaining portion includes a front cover portion connected to the binding body between the front cover portion and the back cover portion of the cover body;

the front cover portion includes a hinge portion between the front cover portion and the back cover portion;

the binding body includes a group of pocket sheets and is arranged such that end edges of the group of pocket sheets connected to the cover body curve towards a side in which the plurality of binding sheets extends when opened the cover body is opened; and the curved subsidiary portion is spaced from the binding body and connected with a width less than a width of the spine portion at an outer side of the hinge portion of the front cover portion and the hinge portion of the back cover portion to enable the end edge of the binding body which is connected to the cover body to curve.

10. The file according to claim 8, wherein the curved retaining portion includes a hinge portion on a front cover side connected to the front cover portion, a hinge portion on a back cover side connected to the back cover portion, and an interjacent connecting portion interposed between the hinge portion on the front cover side and the hinge portion on the back cover side; and a region on the front cover side extending to the hinge portion on the front cover side and a region on the back cover side extending to the hinge portion on the back cover side intersect at substantial right angles with the interjacent connecting portion when a load is not applied and move the interjacent connecting portion in the direction away from the inner side of the spine portion as the direction in which the plurality of binding sheets extend so as to be lifted as a result of expanded angles between the interjacent connecting portion and the regions of the front cover side and the back cover side, a resiliency of a material from which the curved retaining portion is made, and an the elasticity adjacent to the hinge portion on the front cover side and the hinge portion on the back cover side, which move on the opposite side of the spine portion and becomes narrower than the spine portion and located on the inner side of the folding portion of the front cover side and the folding portion of the back cover side when opened the cover body is opened.

11. The file according to claim 8, wherein the plurality of binding sheets include pockets combined with thermoplastic resin sheets;

each of the plurality of binding sheets is hot-adhered to another of the plurality of binding sheets on an end edge thereof connected to the cover body; and the end edge connected to the cover body is arranged to curve inwardly when the plurality of binding sheets are opened.

* * * * *